US012420134B1

(12) United States Patent
White et al.

(10) Patent No.: US 12,420,134 B1
(45) Date of Patent: Sep. 23, 2025

(54) SYSTEM AND METHODS FOR FACILITATING THE USE OF A WEIGHT PRESS MACHINE

(71) Applicant: Hypertrophy Tech LLC, Sunnyvale, CA (US)

(72) Inventors: Nicholas Alan White, Sunnyvale, CA (US); Nicholas Henry Molina, Sunnyvale (CA)

( * ) Notice: Subject to any disclaimer, the term of this patent is extended or adjusted under 35 U.S.C. 154(b) by 94 days.

(21) Appl. No.: 18/394,756

(22) Filed: Dec. 22, 2023

Related U.S. Application Data

(63) Continuation-in-part of application No. 18/221,762, filed on Jul. 13, 2023.

(60) Provisional application No. 63/389,063, filed on Jul. 14, 2022.

(51) Int. Cl.
*A63B 21/078* (2006.01)

(52) U.S. Cl.
CPC ..... *A63B 21/078* (2013.01)

(58) Field of Classification Search
CPC ..... A63B 21/078; A63B 21/0783
See application file for complete search history.

(56) References Cited

U.S. PATENT DOCUMENTS

| | | | | |
|---|---|---|---|---|
| 6,450,927 | B1 * | 9/2002 | Ellis | A63B 21/078 482/94 |
| 10,226,660 | B2 * | 3/2019 | Wilkins | A63B 21/078 |
| 2014/0187391 | A1 * | 7/2014 | Kelly | A63B 21/0724 482/104 |
| 2015/0157894 | A1 * | 6/2015 | Rulli | A63B 21/0783 482/104 |
| 2020/0121974 | A1 * | 4/2020 | Bear | A63B 21/154 |
| 2023/0149766 | A1 * | 5/2023 | Jacobson | A63B 21/0783 482/104 |

* cited by examiner

*Primary Examiner* — Zachary T Moore
(74) *Attorney, Agent, or Firm* — John Rizvi; John Rizvi, P.A.—The Patent Professor®

(57) ABSTRACT

A press partner system facilitates the use of a plate-loaded press machine. The system comprises a press partner clamp apparatus and a press partner sleeve apparatus, configured for installation on the press machine to modify the range of motion of a machine arm thereof. The clamp apparatus comprises a C-shaped lower portion attachable to a side arm contact rod of the machine arm, an upper block portion, and at least one clamp block extension. The sleeve apparatus comprises a sleeve main portion attachable to a bumper of the press machine such that the sleeve main portion fits over at least a portion of the bumper and the sleeve apparatus extends beyond the bumper. The system may include a clamp apparatus and a sleeve apparatus having a plurality of components configured to further customize the range of motion of the plate-loaded weight machine.

24 Claims, 42 Drawing Sheets

SYSTEM AND METHODS FOR FACILITATING THE USE OF A WEIGHT PRESS MACHINE

CROSS-REFERENCE TO RELATED APPLICATIONS

This application is a Continuation-In-Part of U.S. patent application Ser. No. 18/221,762 filed Jul. 13, 2023, which is incorporated herein by reference in its entirety; U.S. patent application Ser. No. 18/221,762 filed Jul. 13, 2023 claims the benefit of U.S. Provisional Patent Application No. 63/389,063, filed on Jul. 14, 2022, which is also incorporated by reference herein in its entirety.

FIELD OF THE INVENTION

The present invention relates generally to weight training exercise equipment, and more particularly to a system for facilitating the use of a weight press machine and methods for use.

BACKGROUND OF THE INVENTION

It is often necessary or desirable for a person to exercise a particular muscle or group of muscles. People exercise healthy muscles to increase strength and maintain an active lifestyle, to maintain health, to improve their appearance, or following damage to a muscle from an injury or a surgery to prevent atrophy and to strengthen the muscle for normal use.

There are two basic types of exercise movements, isolation, and compound. Isolation movements are designed to isolate a specific muscle or muscle group and to reduce body part movement to involve rotation of a single joint. Leg extensions and biceps curls are examples of isolation movements. Compound movement exercises involve more than one body part and require multiple joint action. Because of this, they exercise a greater number of muscles/muscle groups. There is also a difference in the travel path for the two types of movement. Isolation movements tend to be rotational with concentric travel paths, while compound movements tend to be curvilinear, with elliptical travel paths.

Compound movements are a natural and fundamental form of exercise and show up in everything from professional athletics to everyday activities. Jumping, rowing, swimming, and throwing all involve multi-joint movements. Squats, bench presses, chin-ups, bar dips, shoulder presses, and the like, are all compound movement exercises. While fundamental in everyday life, they can be difficult for many people to perform as exercises, requiring balance and coordination as well as strength to follow the proper movement path. Improper form by the exerciser can make the exercise more difficult, increase stress on the joints, and even lead to possible injury.

Various routines have been developed to exercise different muscle groups by forcing the muscles to contract and extend under a load, such as by moving a free weight against the force of gravity or by moving a handle whose movement is resisted by an exercise machine. The muscles of the chest, for example, may be exercised by an exercise known as the chest press. Muscles of the shoulder may be exercised by an exercise known as the shoulder press.

Various exercise machines have been developed for performing compound movement exercises involving different muscles and muscle groups. Some of these have a stationary user support, which may be linked to an exercise arm or user engagement means. One problem in most or all prior art designs is the unnatural and exaggerated arcing movement found in pivoting arm exercise machines, which do not accurately simulate the natural body movement found in free weight and/or free bar exercises.

In order to help exercisers perform weight training exercises, plate-mounted weight machines have been developed. These machines include declined press, wide chest press and low row plate-mounted machines. These machines provide stabilizing support by placing the user in a seated position with back support, preventing the user from having to lift the weights free-hand, swing weights, walk with weights, or arch the back when lifting the weights. Machines including an exercise arm pivotally mounted to the user seat or bench replaced the movement of free weights, and provided an advancement in safety. Such machines typically have an exercise arm movably mounted on a stationary frame with a seat and back pad or user support rigidly mounted on a stationary frame, operably connected to resistance weights, which may include a plate-loaded weight stack, elastic bands or hydraulic or pneumatic mechanism.

Of particular interest are plate-loaded machines which include a main frame, a user support rigidly mounted to the main frame, and a plate-loaded exercise arm pivotally mounted on the main frame. These press machines have exercise arms that may be actuated in response to movement by the user of an operably connected handle.

Machines have been developed that simulate the exercise movements of a chest press and/or a shoulder press, which machines include handles adapted to be grasped by a user supported on a declined seat and then pressed forwardly and upwardly in an arcuate path along a vertical plane for a chest press, or longitudinally upward in parallel arcs, in planes perpendicular to the back of the user for a shoulder press. Resistance to handle movement is provided by weight plates operably connected to the handles. The user's hands must follow a preset range of motion during the exercise, regardless of the user's anatomy. These machines do not permit the exerciser to select his own path of motion for the press exercise. Rather, the motion is dictated by the machines.

Current exercise machines for performing compound or multi-joint exercises do not accurately maintain proper positioning of the user throughout the exercise motion, which may result in awkward hand or wrist positions, and often involve exaggerated and unnatural arcing movements, or linear, non-arcing arm movements, rather than the smaller elliptical movement associated with free weight or natural exercise movements. There is no provision for proper positioning of the user relative to the position of the user engaging portion of the exercise arm throughout the entire exercise motion. Often, an awkward starting or finishing position is required, causing strain and potential injury.

Individuals interested in strength training often use exercise equipment such as plate-loaded or weight-stack machines, multi-station machines, circuit-training machines, or flat, upright, inclined, or declined benches. The purpose of strength training using machines is the exercise of individual muscle groups. Proper form and focus are important in isolating the appropriate muscle groups and preventing injury. However, when using a plate-loaded fitness machine such as a hammer machine, equipment with handles while in a seated position, a user must reach back beyond the normal range of motion to access the handles. This reaching beyond the normal range of motion may cause discomfort and even repetitive stress injuries.

Current solutions for this problem are not adequate and do not resolve the problem. Some users try to insert a wedge in an effort to move the handles closer to reach. Some users have tried using small plates as a wedge. Once a first user starts a first rep of lifting the weight, the plates will immediately fall down. The result is that only the first rep may be completed comfortably, and the risk of discomfort and injury will resume.

Ideally, it would be extremely useful to be able to attach an apparatus to a weight machine to modify the range of motion. No such device exists.

Accordingly, there is a need for a solution to at least one of the aforementioned problems. For instance, there is an established need for a system which includes apparatuses a user may customize and install on an exercise machine to modify the range of motion of the exercise machine. There is a further need for such a system which is user-friendly, and includes apparatuses which are easily installed and removed. There is also a need for such a system to be compact and portable for the user to bring to a gym for use.

SUMMARY OF THE INVENTION

The present invention is directed to a system for facilitating the use of a weight press machine and methods for use.

In a first implementation of the invention, a press partner system for facilitating the use of a weight press machine. The press partner system comprises components which may be removably attached to plate-loaded weight machines to alter the range of motion thereof. The press partner system comprises at least one press partner clamp apparatus and at least one press partner sleeve device or apparatus, which are configured for installation on a plate-loaded weight machine having a machine arm, to modify a range of motion of the plate machine arm. The press partner system comprises at least one press partner clamp apparatus with optional extensions, and at least one press partner sleeve apparatus with extensions.

The system and its components may be made of any suitable materials, and fabricated by any suitable fabrication process.

The press partner clamp apparatus and the press partner sleeve apparatus are able to be attached to a weight machine to modify the range of motion. The system may be used on any plate-loaded weight machine, such as, for example without limitation, a decline press machine, a wide chest press machine, or a low row machine.

A user may customize and install the apparatuses on an exercise machine to modify the range of motion of the exercise machine. The system is user-friendly, and includes apparatuses which are easily installed and removed. The system is compact and portable for the user to bring to a gym for use.

In one aspect, the present invention provides a press partner clamp apparatus configured to be easily and removably installed on an arm side contact rod of the plate-loaded weight machine. The press partner clamp apparatus comprises press partner clamp apparatus elements with coupling means for releasably interconnecting the press partner clamp apparatus elements.

In one aspect, the press partner clamp apparatus is a durable apparatus which may be attached to an arm of a plate-loaded exercise equipment in a secured, yet removable, fashion. The established range-of-motion is maintained throughout the exercise as the device does not detach and/or fall to the ground after the first rep, mitigating the potential for a hyperextension injury to the user and damage to the machine. The device also maintains its structural integrity after repetitive use.

In one aspect, if a user is using both arms of the plate-loaded exercise machine, one press partner clamp apparatus will be required for each arm.

In another aspect, the press partner clamp apparatus comprises:

- a press partner clamp body having a clamp body top, a clamp body bottom, and clamp body sides;
- a C-shaped cylindrical clamp lower portion configured for removable attachment to the arm side contact rod of the plate-loaded weight machine;
- a clamp upper block portion extending upwardly from the C-shaped clamp lower portion, the clamp upper block portion having a longitudinal direction and an upper block longitudinal length; and
- at least one clamp block extension.

In a further aspect, the C-shaped clamp lower portion and the clamp upper block portion may be of unitary construction.

In one aspect, the press partner clamp apparatus clamp body may be a single solid structure manufactured out of plastic, rubber, or foam. The clamp body may be manufactured using 3D printing, injection modeling, or some other manufacturing process.

In another aspect, the at least one clamp block extension has a block extension longitudinal length, the at least one clamp block extension being configured to be releasably coupled to the clamp upper block portion of the press partner clamp apparatus to provide an extended upper block portion.

In one aspect, the at least one clamp block extension has a block extension outer portion having a longitudinal direction and a block extension interior portion having a longitudinal direction. Each clamp block extension comprises a block extension coupling means for releasably interconnecting the clamp block extension to the clamp upper block portion at the clamp body top to provide a composite press partner clamp body and clamp block extension having a composite extended longitudinal length to increase the length of the press partner clamp apparatus. A plurality of clamp block extensions may be provided, each having a varied length, and capable of use to increase the overall length of the device. Each block extension may be removably attached to the clamp upper block portion by any suitable connector means, such as, for example without limitation, a force-fit, a magnetic attachment, or another integrated snapping attachment.

In one aspect, at least one block extension may be installed on top of a press partner clamp body for extension of the length of the press partner clamp apparatus. The press partner clamp body and the at least one block extension may be releasably connected by an interlocking coupling assembly. The interlocking coupling assembly may comprise a press partner clamp body coupling portion and at least one block extension coupling portion constructed and arranged for removable and reversible coupling. The interlocking coupling assembly may comprise a male coupling portion and a female coupling portion. The press partner clamp body coupling portion may be integrally molded with the press partner clamp, or may be machined or cut into the press partner clamp. The block extension coupling portion may be integrally molded with the block extension, or may be machined or cut into the block extension. To facilitate the installation and use of multiple block extensions, the at least one block extension coupling portion may comprise a first lower block extension coupling portion and a second upper block extension coupling portion. A first block extension may be provided and reversibly coupled with the press partner clamp body coupling portion by coupling the first lower coupling portion of the first block extension with the press partner clamp body coupling portion. The at least one block extension may comprise a plurality of block extensions. A second block extension may be provided and reversibly coupled with the first block extension to further extend the press partner clamp apparatus, by reversibly coupling the first lower coupling portion of the second block extension with the second upper coupling portion of the first block extension. Multiple block extensions may be "stacked" for further extension of the press partner clamp apparatus length. The press partner clamp apparatus may further comprise a press partner clamp cover member or press partner clamp cap configured to be reversibly coupled with the press partner clamp body coupling portion. The press partner clamp cap may comprise a clamp cap coupling portion configured for coupling with the press partner clamp body coupling portion, or with the second upper coupling portion of a block extension. The press partner clamp cap may be removed to permit installation of at least one block extension, and may then be installed over an uppermost block extension.

In one aspect, the components of the press partner clamp apparatus may be releasably connected by an interlocking coupling assembly.

In a further aspect, the interlocking coupling assembly may connect a first component of the press partner clamp apparatus and a second component of the press partner clamp apparatus. The interlocking coupling assembly may comprise a first coupling portion provided on the first press partner clamp apparatus component, the first coupling portion comprising a channel having an inverted T-shaped cross-section. The interlocking coupling assembly may further comprise a second coupling portion provided on the second component of the press partner clamp apparatus, the second coupling portion configured to extend downwardly from the second component, the second coupling portion having an inverted T-shaped cross section, wherein the second coupling portion is configured to be releasably held within the channel of first coupling portion to hold the first and second components of the press partner clamp apparatus together.

The C-shaped lower portion may be configured to be removably attached to the weight machine, to the arm side contact rod of the plate-loading weight machine. The contact rod may have a diameter of about 1". The lower clamp portion is configured to snap onto contact rod. The upper block may have a rectangular cross section, and may have a length of about 4". The upper block is configured to hold the weight machine handles in place, so a user does not have to reach beyond the user's range of motion. For example, when using a Life Fitness Hammer Strength product in a gym, the handles are positioned too far back to reach. The clamp apparatus beneficially extends the reach of the handles to a comfortable and reachable position. The clamp apparatus is securely but removably affixed to the weight machine, and will not fall when the user is doing reps, so that the user's comfortable reach is maintained.

In one aspect, the clamp body may have any suitable dimensions. The dimensions may be provided to permit the clamp apparatus to be attached to any suitable weight machine with different side contact rods.

In another aspect, the C-shaped lower clamp portion may comprise a 101.6 mm long cylinder with 50.8 mm OD and 22.25 mm ID. A 45° V-shaped cutout may be provided along an axis of the cylinder. The upper block may comprise a rectangular extrusion, 25.4 mm thick, running along the axis and protruding from the cylinder on the opposite side of the 45° V-shaped cutout, extending 101.6 mm. In one aspect, the dimensions permit the clamp apparatus to fit onto a 1-inch contact rod typically found on Life Fitness Hammer Strength products. As noted herein, the dimensions of the clamp apparatus may be customized to permit the clamp apparatus to be attached to other brand devices with different side contact rods.

In one aspect, the press partner clamp apparatus may be used by a user, by first attaching the lower clamp portion to the exercise equipment by attaching the C-shaped lower portion to the arm contact rod of the exercise equipment prior to the addition of any weighted plates. If both arms of the exercise equipment will be utilized, a second press partner clamp apparatus will be provided for attachment to the second arm contact rod. The press partner clamp apparatus may either be slid axially onto a contact rod, or forcibly snapped onto the contact rod by pressing the v-shaped cutout along the cylindrical portion of the clamp against the contact rod. If desired, one or more clamp block extensions may be secured to the clamp upper block. The press partner clamp apparatus may then be rotated around the contact rod until an optimal contact with a bumper of the exercise equipment is achieved. Weighted plates may then be added to the exercise equipment per the user's preference. The compression provided by the snap-fit of the C-shaped clamp portion of the press partner clamp apparatus prevents the clamp apparatus from rotating around the bar during use.

In one aspect, the present invention provides a press partner sleeve device or apparatus configured for installation on an exterior surface of a bumper of a plate-loaded weight machine. The sleeve apparatus is configured to interface with a pre-existing bumper that has been installed to a press weight machine. The press partner sleeve apparatus comprises press partner sleeve apparatus elements with coupling means for releasably interconnecting the press partner sleeve apparatus elements.

In another aspect, a unitary press partner sleeve device comprises:

- a press partner sleeve device upper portion and a press partner lower skirt, the press partner lower skirt having a skirt outer portion, and a skirt interior portion configured to be releasably coupled to the exterior surface of the bumper of the plate-loaded weight machine, such that the press partner lower skirt fits over at least a portion of the bumper.

In another aspect, a press partner sleeve apparatus configured to be releasably coupled to a bumper of a plate-loaded weight machine, comprises a press partner lower skirt configured to fit over the bumper, a press partner main sleeve, at least on press partner sleeve extension and a press partner sleeve cap.

In another aspect, a press partner sleeve apparatus comprises:

- a press partner lower skirt having a skirt outer portion, a skirt interior portion, a skirt upper portion, a skirt lower portion, and a skirt top surface, the skirt interior portion being configured to be releasably coupled to the exterior surface of the bumper of the plate-loaded weight machine, such that the skirt lower portion fits over at least a portion of the bumper and the skirt upper portion extends beyond the bumper;
- a press partner main sleeve having a main sleeve longitudinal length, a main sleeve top, and a main sleeve bottom, the press partner main sleeve portion being configured to be releasably coupled to the press partner lower skirt portion;

at least one press partner sleeve extension having a sleeve extension longitudinal length, a sleeve extension top, a sleeve extension bottom, the at least one press partner sleeve extension being configured to be releasably coupled to the press partner main sleeve to provide an extended press partner sleeve having an extended press partner sleeve longitudinal length; and a press partner sleeve cap being configured to be releasably coupled to the main sleeve top, and further being configured to be releasably coupled to the sleeve extension top of the at least one press partner sleeve extension, so that the cap may be placed on the press partner main sleeve or the at least one press partner sleeve extension.

In one aspect, the sleeve apparatus may be installed on the bumper of the machine by any suitable attachment means. The attachment means may comprise one or more of the following and combinations thereof:

Force fit: The sleeve device and components of the sleeve apparatus may include a plurality of pegs configured to fit into the plurality of holes provided in the bumper. The pegs act as a guide to align the skirt of the sleeve (portion which covers the bumper) with the bumper. Both the pegs and the sleeve can be designed to make a snug fit with the bumper. The sleeve device and the sleeve apparatus may be attached and removed by hand.

Attachment Strap: A strap may be attached to the bottom of the sleeve which wraps around the bumper (and post to which it is mounted on the machine) and attach to the other side of the sleeve.

Compression Fit: The skirt of the sleeve can be designed so it is slightly smaller than the bumper, but elastic enough to be stretched and placed over the bumper allowing for a compression fit.

In one aspect, the sleeve device and apparatus are configured to interface with a pre-existing bumper that has been installed to a press weight machine. The sleeve device and the sleeve apparatus may be installed on a machine by a method including one or more of the following steps and combinations thereof. The sleeve skirt may be attached directly to the bumper provided on the machine. The bumper has a pair of holes by which it is bolted to the machine. The sleeve skirt may comprise a pair of pegs shaped to mate with the pair of holes of the bumper. The pair of pegs act as a guide to align the sleeve skirt to the bumper. Further, each of the components of the sleeve apparatus may be provided with a pair of pegs to enable attachment directly to the bumper. A strap may be used to attach and/or secure the sleeve apparatus to the bumper.

In another aspect, the sleeve apparatus main sleeve may be added to the sleeve skirt to provide an additional base and to add 2 inches of height to the original resting position of the handles of the press machine. The sleeve skirt may be provided with an upper pair of holes, and the main sleeve may include pegs extending downward by which the main sleeve may be attached to the sleeve skirt.

In another aspect, a sleeve extension may be connected to the main sleeve. The main sleeve may be provided with an upper pair of holes, and the sleeve extension may include pegs extending downward by which the sleeve extension may be attached to the main sleeve.

In a further aspect, the components of the press partner sleeve apparatus are capable of being connected by the peg and hole construction, so that a variety of configurations may be provided to customize the extended height provided to the bumper on which the sleeve apparatus is installed.

In one aspect, the components of the press partner sleeve apparatus may comprise a magnetic connection means.

In one aspect, the components of the press partner sleeve apparatus may be held together by a retention strap to help keep them together when they are in the gym bag. This strap may be the same strap that may be used to further secure the apparatus to the bumper when in use.

In one aspect, to provide a variety of configurations of the press partner sleeve apparatus to customize the extended height provided to the bumper on which the press partner sleeve apparatus is installed, the components of the press partner sleeve apparatus may be connected by a sleeve coupling means comprises an interlocking coupling assembly. The interlocking coupling assembly may comprise an upper coupling portion and a lower coupling portion. The interlocking coupling assembly may comprise a male coupling portion and a female coupling portion. The coupling portions may be integrally molded, or may be machined or cut into the components of the press partner sleeve apparatus. The components may be reversibly coupled by coupling an upper coupling portion of a first lower sleeve apparatus component with a lower coupling portion of a second upper sleeve apparatus component.

The press partner lower skirt may have a skirt upper coupling portion on the skirt top surface. The press partner main sleeve may have a main sleeve lower coupling portion located at the main sleeve bottom which is configured to be releasably coupled to the skirt upper coupling portion. The press partner main sleeve may further include a main sleeve upper coupling portion provided on the main sleeve top. The at least one press partner sleeve extension may have a sleeve extension lower coupling portion and a sleeve extension upper coupling portion. The sleeve extension lower coupling portion is configured to be releasably coupled with the main sleeve upper coupling portion. The at least one press partner sleeve extension may comprise a first press partner sleeve extension, and one or more additional press partner sleeve extensions. The at least one press partner sleeve extension may comprise a first press partner sleeve extension, and a second press partner sleeve extension which are releasably coupled. The press partner sleeve cap has a sleeve cap lower coupling portion, and is configured to be releasably coupled to the skirt upper coupling portion, the main sleeve upper coupling portion, or a sleeve extension upper coupling portion. The press partner sleeve cap may be removed from the press partner skirt or the press partner main sleeve to permit installation of at least one sleeve extension, and may then be installed over an uppermost sleeve extension.

In another aspect, a press partner sleeve apparatus comprises:

a press partner main sleeve having a main sleeve longitudinal length, a main sleeve top, a main sleeve bottom, and a main sleeve interior portion, the press partner main sleeve portion being configured to be releasably coupled to the exterior surface of the bumper of the plate-loaded weight machine, such that the main sleeve fits over at least a portion of the bumper and main sleeve top extends beyond the bumper;

at least one press partner sleeve extension having a sleeve extension longitudinal length, a sleeve extension top, a sleeve extension bottom, the at least one press partner sleeve extension being configured to be releasably coupled to the press partner main sleeve to provide an extended press partner sleeve having an extended press partner sleeve longitudinal length; and a press partner sleeve cap being configured to be releasably coupled to the main sleeve top, and further being configured to be releasably coupled to the sleeve extension top of the at least one press partner sleeve extension, so that the cap may be placed on the press partner main sleeve or the at least one press partner sleeve extension.

In one aspect, the components of the press partner sleeve apparatus may be releasably connected by an interlocking coupling assembly.

In a further aspect, the interlocking coupling assembly may connect a first component of the press partner sleeve apparatus and a second component of the press partner sleeve apparatus. The interlocking coupling assembly may comprise a first coupling portion provided on the first press partner sleeve apparatus component, the first coupling portion comprising a channel having an inverted T-shaped cross-section. The interlocking coupling assembly may further comprise a second coupling portion provided on the second component of the press partner sleeve apparatus, the second coupling portion configured to extend downwardly from the second component, the second coupling portion having an inverted T-shaped cross section, wherein the second coupling portion is configured to be releasably held within the channel of first coupling portion to hold the first and second components of the press partner sleeve apparatus together.

In one aspect, the press partner sleeve apparatus is configured to add height to the resting position of the press machine, so it is not as close to the user's chest when the user is seated at the machine.

In one aspect, the sleeve interior portion is constructed and arranged to provide a "one size fits all" sleeve which may fit on a bumper of any commercially available weight machine to modify and customize the range of motion of the weight machine.

In one aspect, the system of the present invention provides an unprecedented fitness equipment accessory for plate-loaded equipment. The system solves the problem of the user when seated at the machine, having to reach backward out of the user's range of motion of motion. Unlike previous solutions, the present invention permits the user to add a system apparatus to the machine to define and select a path of motion for the press exercise. Thus, this present invention would help to prevent injury as well as improve overall personal fitness by modifying the range of motion of the device on which it is installed.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed to a system for facilitating the use of a weight press machine, and methods for its use.

Referring initially to FIGS. 1-31, a press partner system 100 for facilitating the use of a weight press machine, referred to as system 100, is shown in accordance with an illustrative embodiment of the present invention.

Figure 1:
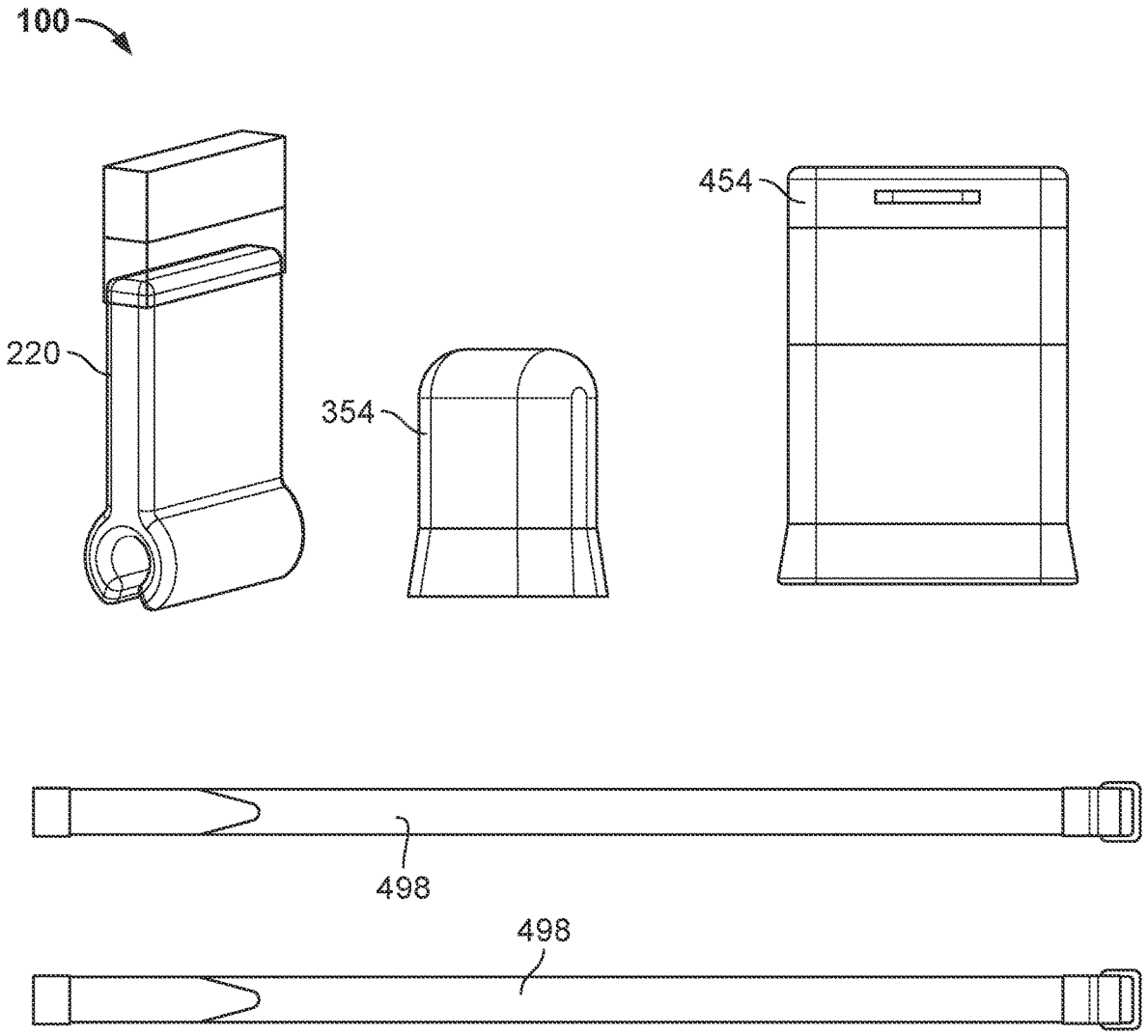
FIG. 1 presents a view of an exemplary press partner system for facilitating the use of a press weight machine in accordance with an illustrative embodiment of the present invention.

As shown at FIG. 1, the press partner system 100 comprises at least one press partner clamp apparatus and at least one press partner sleeve apparatus. The press partner clamp apparatus 220 may include optional extensions 244. The at least one press partner sleeve apparatus may comprise a first unitary press partner sleeve device 354, and a second press partner sleeve apparatus 454 including a skirt 458, a main sleeve 474, at least one extension 478 and a cap 486. The press partner sleeve system components are configured for installation on a plate-loaded weight machine to modify the range of motion of the machine arm. The components may be removably attached to plate-loaded weight machines to customize the range-of-motion thereof.

Figure 2:
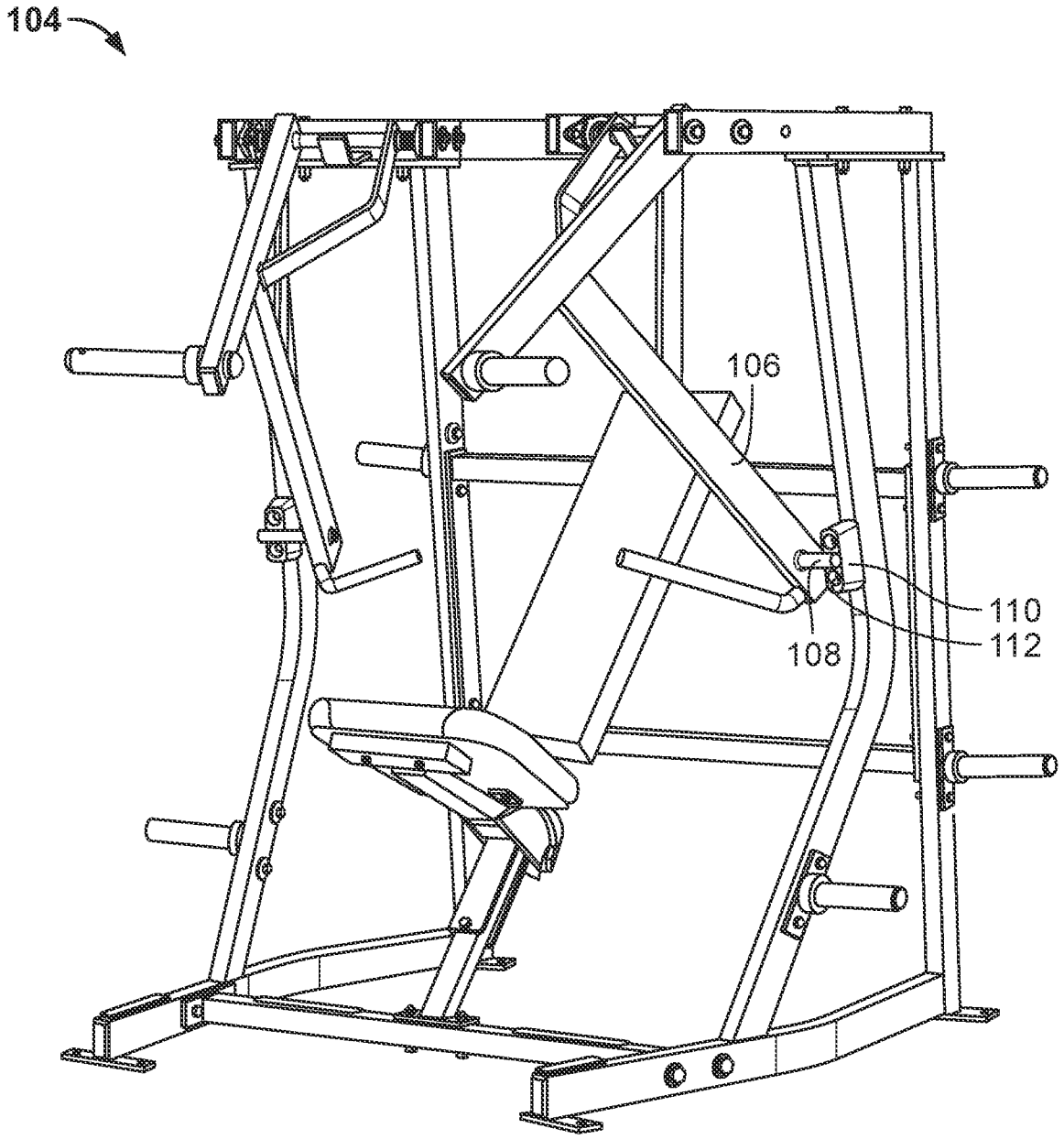
FIG. 2 presents a perspective view of a representative plate-loaded declined press weight machine with which the system of the present invention may be used.
Figure 3:
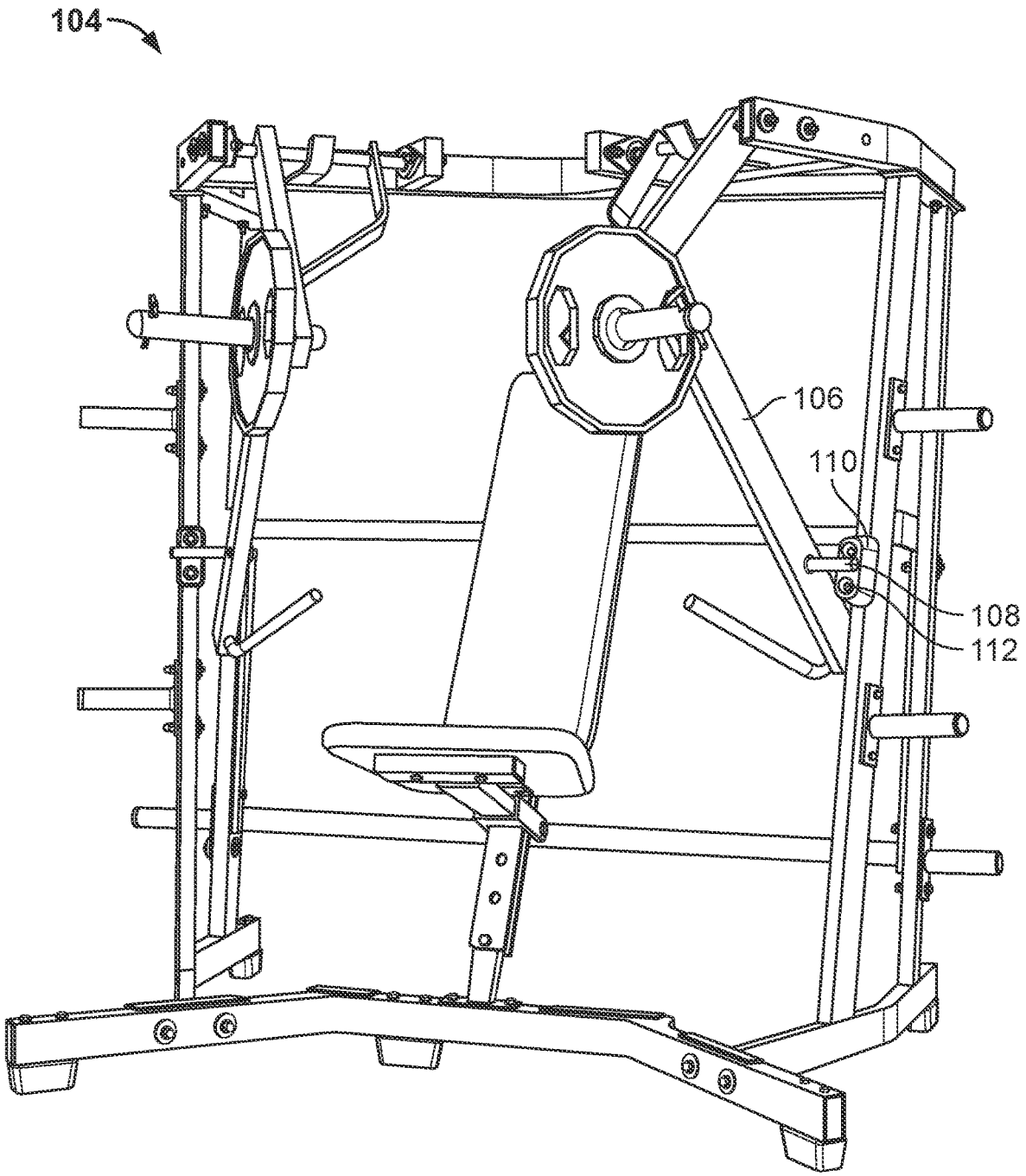
FIG. 3 presents a perspective view of a representative plate-loaded wide chest press weight machine with which the system of the present invention may be used.
Figure 4:
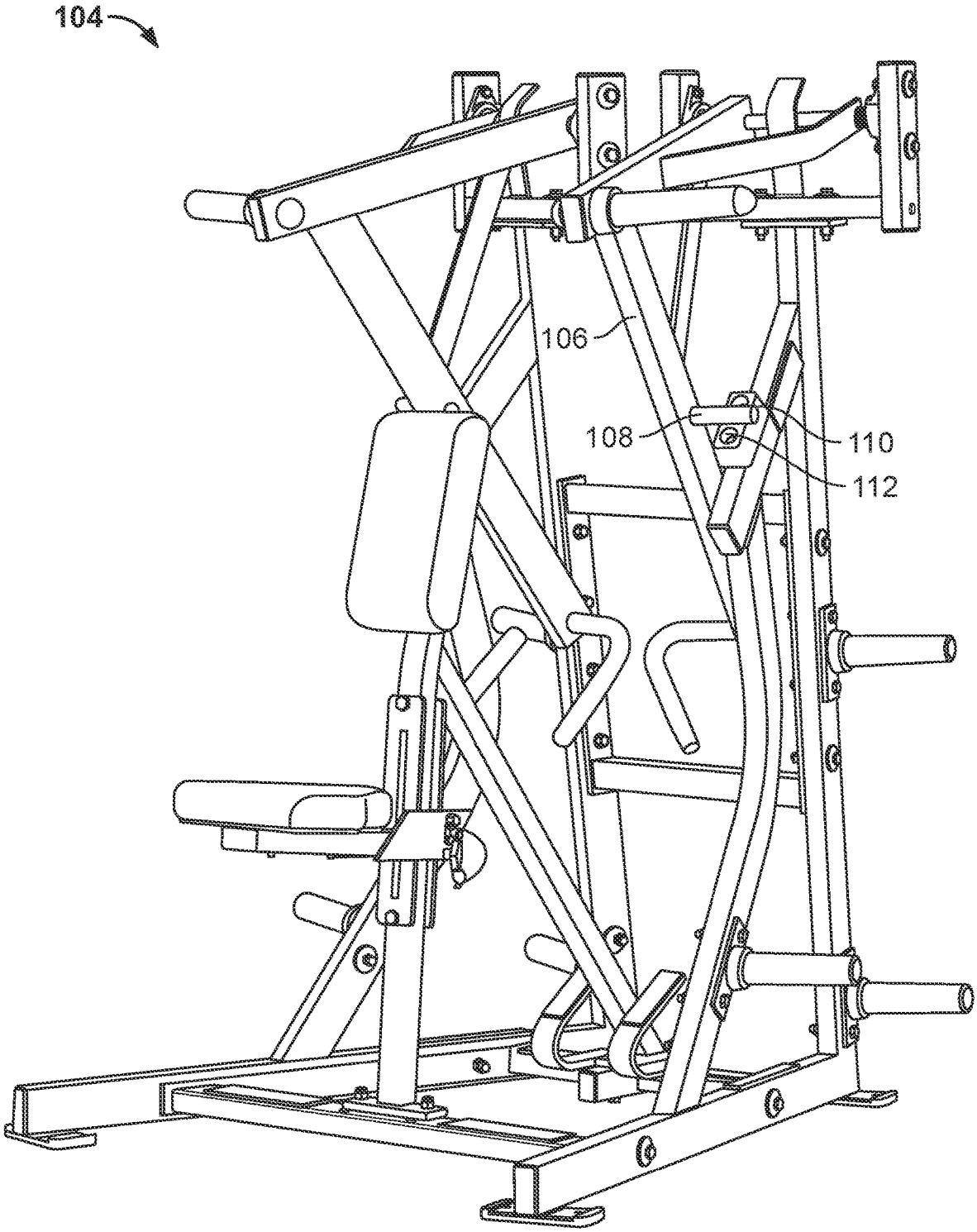
FIG. 4 presents a perspective view of a representative plate-loaded low row weight machine with which the system of the present invention may be used.
Figure 5:
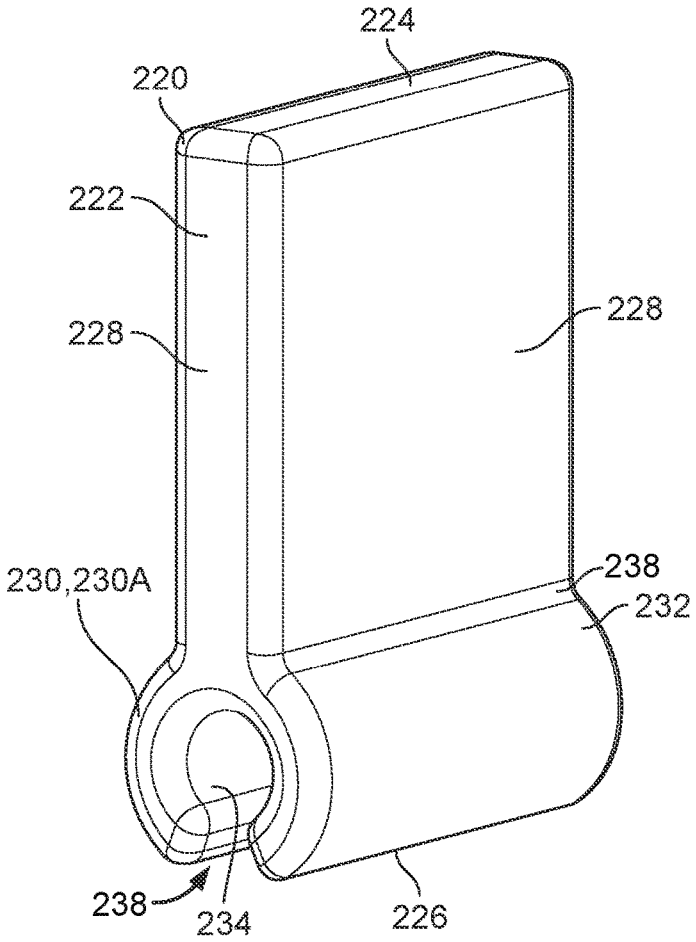
FIG. 5 presents an isometric view of a press partner clamp apparatus in accordance with a second illustrative embodiment of the present invention.
Figure 6:
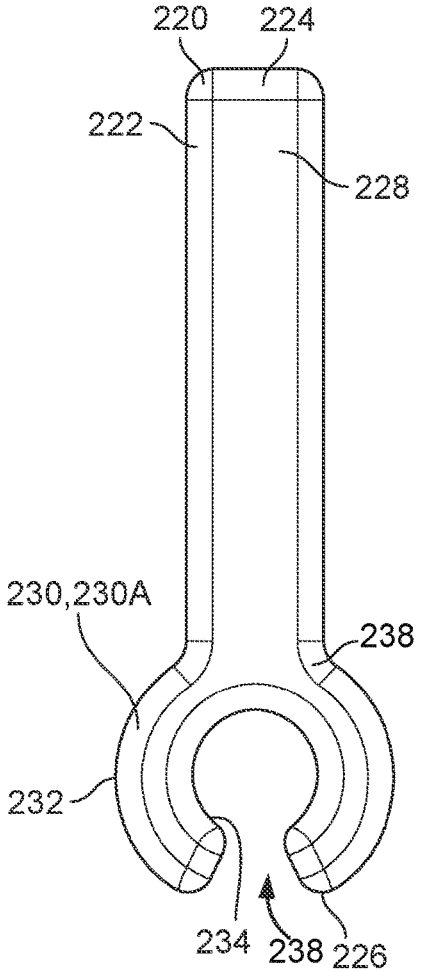
FIG. 6 presents a side elevation view of the apparatus as in FIG. 5.
Figure 7:
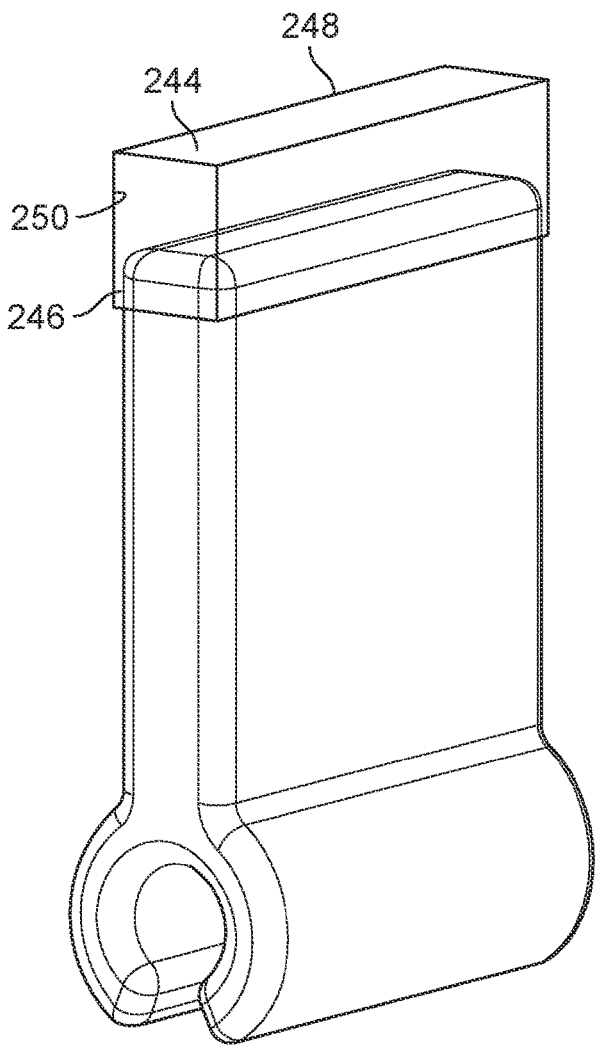
FIG. 7 presents an isometric view of a press partner clamp apparatus as in FIG. 5 shown with one clamp block extension attached thereto.
Figure 8:
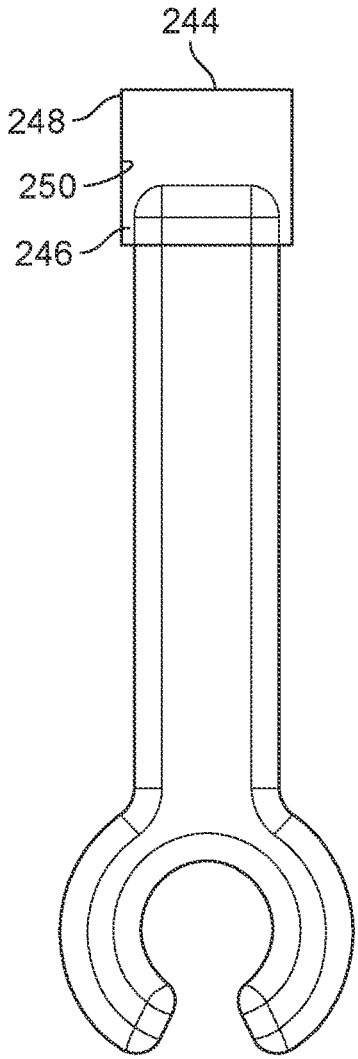
FIG. 8 presents a side elevation view of the apparatus as in FIG. 7.
Figure 9:
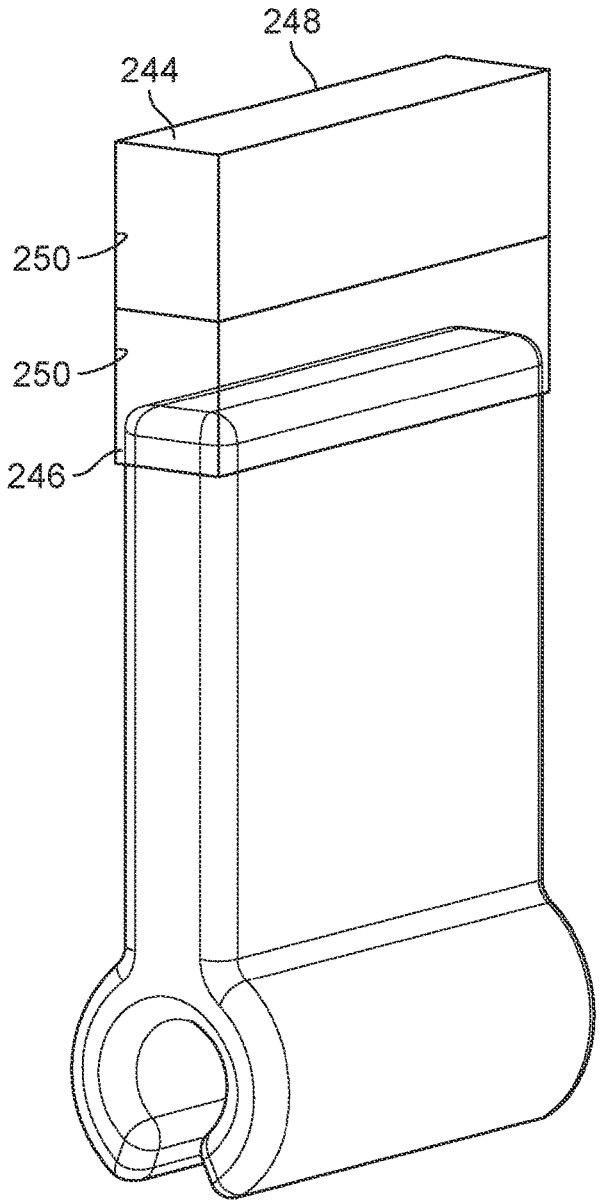
FIG. 9 presents an isometric view of a press partner clamp apparatus as in FIG. 5 shown with two clamp block extensions.
Figure 10:
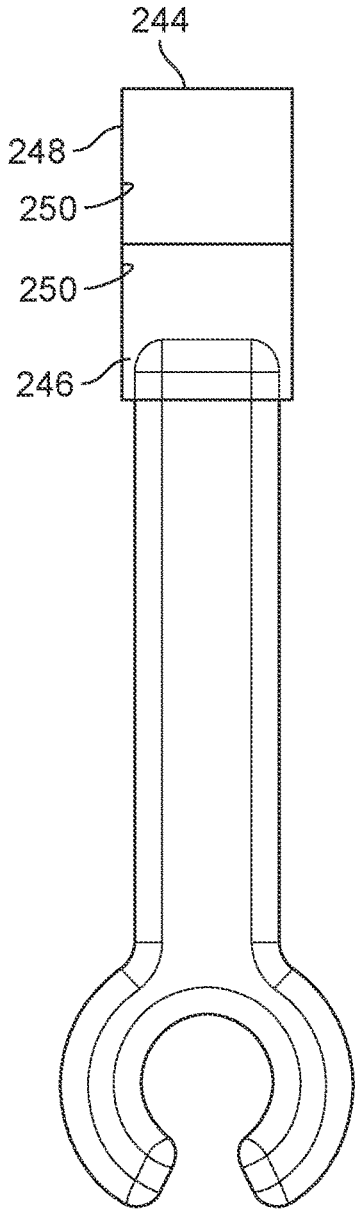
FIG. 10 presents a side elevation view of the apparatus as in FIG. 9.

As seen at FIGS. 2-4 representative plate-loaded weight machines 104 with which the system 100 of the present invention may be used. For example, FIG. 2 presents a perspective view of a representative plate-loaded declined press weight machine, FIG. 3 presents a perspective view of a representative plate-loaded wide chest press weight machine, and FIG. 4 presents a perspective view of a representative plate-loaded low row weight machine.

As shown at FIGS. 5-13, a press partner clamp apparatus 220 is shown in accordance with an illustrative embodiment of the invention. The press partner clamp apparatus configured for easy, removable installation on an arm side contact rod 108 of an arm 106 of a plate-loaded weight press machine 104. The press partner clamp apparatus 220 comprises press partner clamp apparatus elements with coupling means for releasably interconnecting the press partner clamp apparatus elements.

The press partner clamp apparatus 220 comprises a press partner clamp body 222 having a clamp body top 224, a clamp body bottom 226, and clamp body sides 228. The press partner clamp apparatus clamp body 222 further comprises a C-shaped clamp lower portion 230, a clamp upper block portion 240, and at least one clamp block extension 244.

The C-shaped clamp lower portion 230 is configured for removable attachment to the arm side contact rod 108 of the plate-loaded weight machine 104.

The clamp upper block portion 240 extends upwardly from the C-shaped clamp lower portion 230, the clamp upper block portion 240 having a longitudinal direction and an upper block longitudinal length.

The C-shaped clamp lower portion 230 and the clamp upper portion 240 may be of unitary construction.

The at least one clamp block extension 244 has a block extension longitudinal length, the at least one clamp block extension 244 being configured to be releasably coupled to the clamp upper block portion 240 of the press partner clamp apparatus 220 to provide an extended upper block portion. The at least one clamp block extension has a block extension outer portion having a longitudinal direction and a block extension interior portion having a longitudinal direction. The clamp block extension 244 comprises a block extension coupling means for releasably interconnecting the clamp block extension 244 to the clamp upper block portion 240 at the clamp body top 224 to provide a composite press partner clamp body 222 and clamp block extension 244 having a composite extended longitudinal length to increase the length of the press partner clamp apparatus 220.

Figure 11:
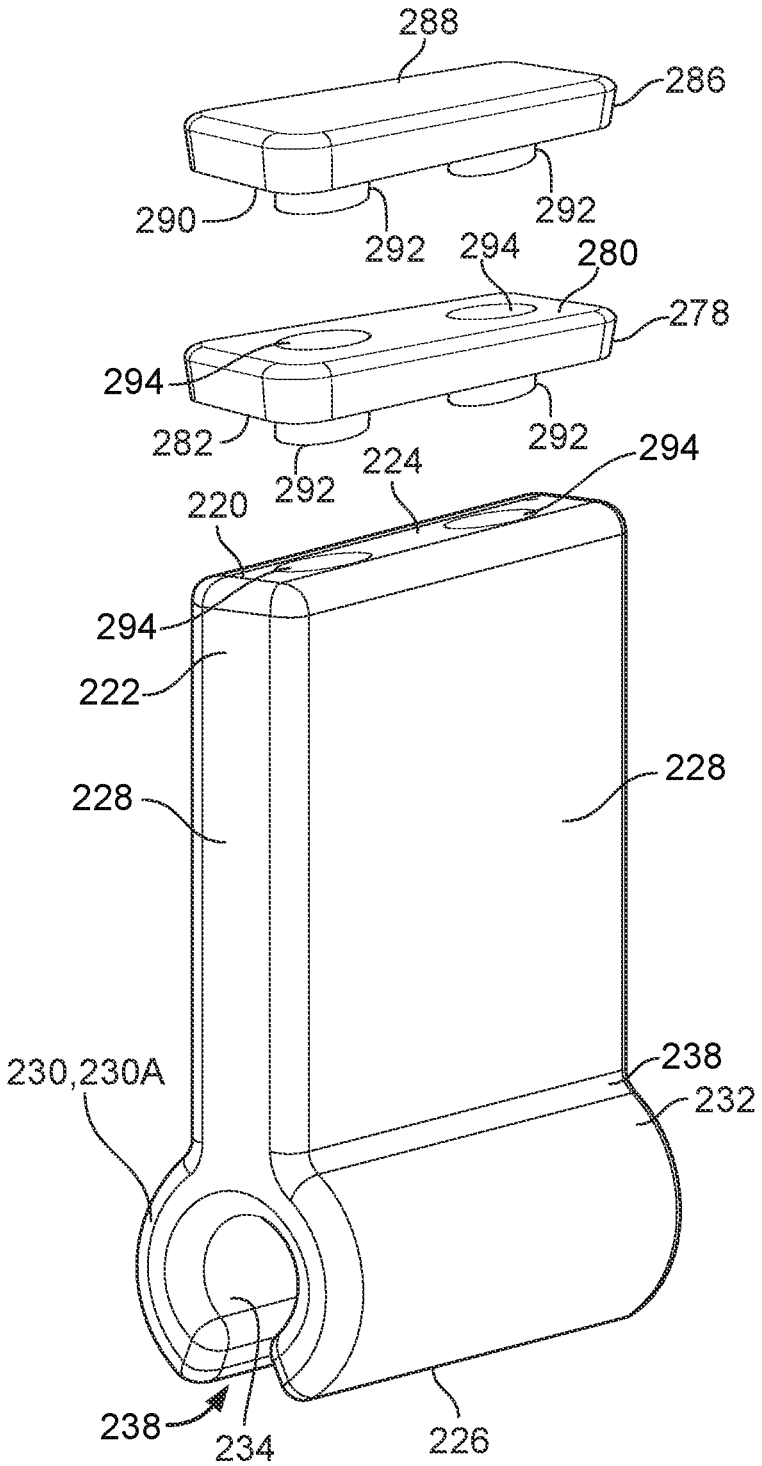
FIG. 11 presents an isometric exploded view of a press partner clamp apparatus as in FIGS. 5-10, with an alternative configuration of one or more block extensions in accordance with the present invention.

As shown in the exploded views of FIGS. 11-12, in some embodiments, the elements of the press partner clamp apparatus 220 may comprise coupling means for releasably interconnecting the elements of the press partner clamp apparatus, of the type also described in FIGS. 27-32 hereinbelow. The press partner clamp apparatus 220 further comprises the at least one clamp block extension 244 and a block extension coupling means for releasably interconnecting at least one clamp block extension 244 to the clamp upper block portion 240 at the clamp body top 224 to provide a composite press partner clamp body 222 and clamp block extension 244 having a composite extended longitudinal length to increase the length of the press partner clamp apparatus 220. The at least one clamp block extension 244 may comprise at least one intermediate clamp block extension 278 and a clamp block extension cap 286. The at least one intermediate clamp block extension may comprise a plurality of intermediate clamp block extensions. The at least one intermediate clamp block extension 278 and the clamp block extension cap 286 may be releasably interconnected together, and releasably interconnected to the clamp upper body top 224 by a peg and hole coupling means. In some embodiments, the clamp block extension cap 286 may be directly releasably interconnected to the clamp upper body top 224 by the peg and hole coupling means.

The clamp upper body top 224 may be provided a pair of peg receiving channels 294.

Each intermediate clamp block extension 278 has an intermediate clamp block upper portion 280 and an intermediate clamp block extension lower portion 282. A pair of peg receiving channels 294 may be provided on the intermediate clamp block extension upper portion 280, and a pair of downwardly extending pegs 292 may extend downwardly from the intermediate clamp block extension lower portion 282.

The clamp block extension cap 286 has a cap exterior top 288 and a cap lower surface 290. The cap 286 further comprises downwardly extending pegs 292 which extend downwardly from the cap lower surface 290.

The peg receiving channels 294 are configured to receive the pegs 292, so the components of the press partner clamp apparatus 220 may be assembled with one intermediate clamp block extension 278 or with a plurality of intermediate clamp block extensions 278 directly releasably interconnected to the clamp upper body top 224 by the peg and hole coupling means, and the cap 286 may then be releasably interconnected with an uppermost intermediate clamp block extension. Alternatively the press partner clamp apparatus 220 may be assembled without an intermediate clamp block extension, and may be directly releasably interconnected to the clamp upper body top 224 by the peg and hole coupling means. The press partner clamp apparatus may be assembled in a multitude of configurations to enable the user to further customize the press partner clamp apparatus 220. The user may thereby determine and customize the range of motion of the exercise machine 104.

The peg receiving channels 294 may be integrally molded with the press partner clamp body 230, or may be machined or cut into the press partner clamp body 230. The pegs 292 may be integrally molded with each block extension 278, or may be machined or cut into each block extension 278.

Figure 12:
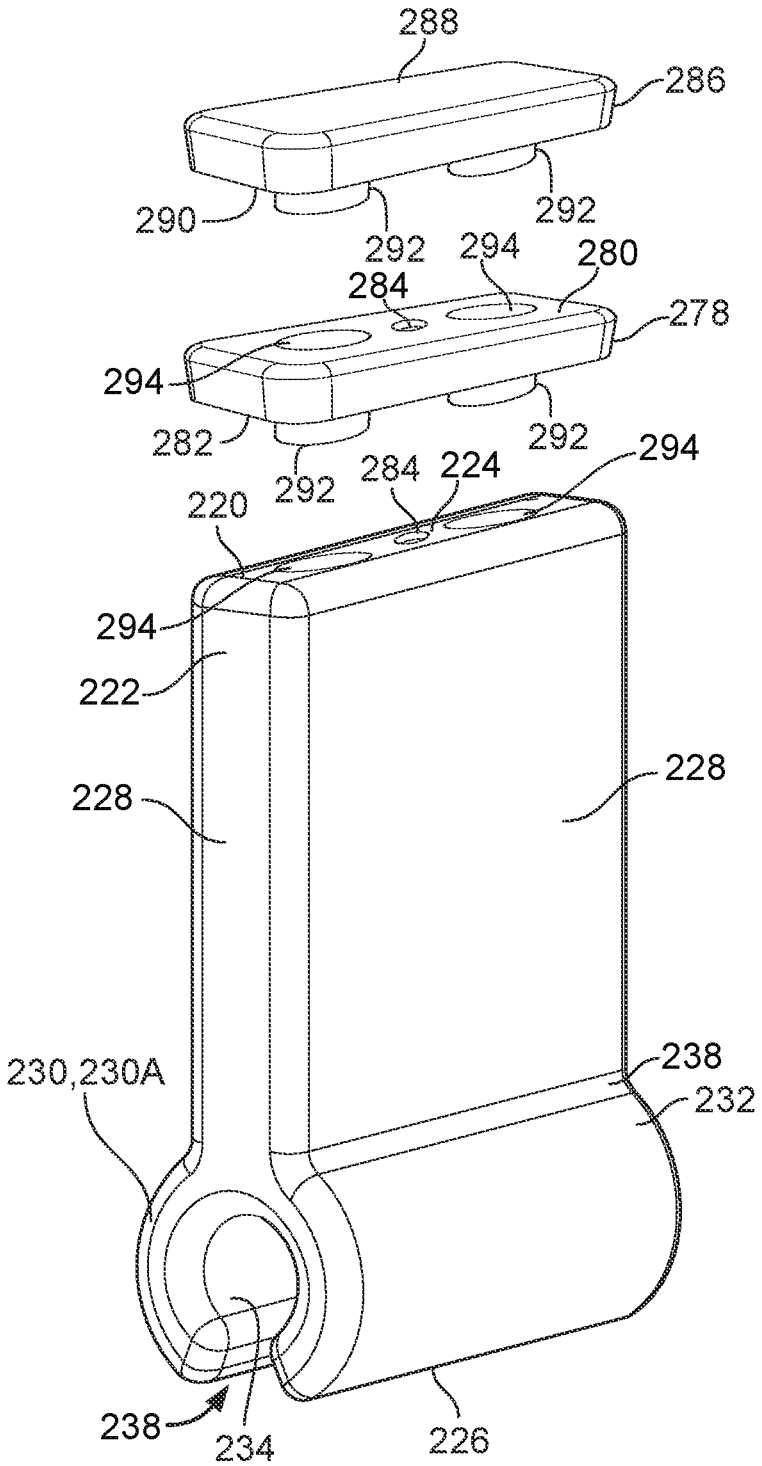
FIG. 12 presents an isometric exploded view of a press partner clamp apparatus as in FIGS. 5-10, with an alternative configuration of one or more block extensions in accordance with the present invention.
Figure 13:
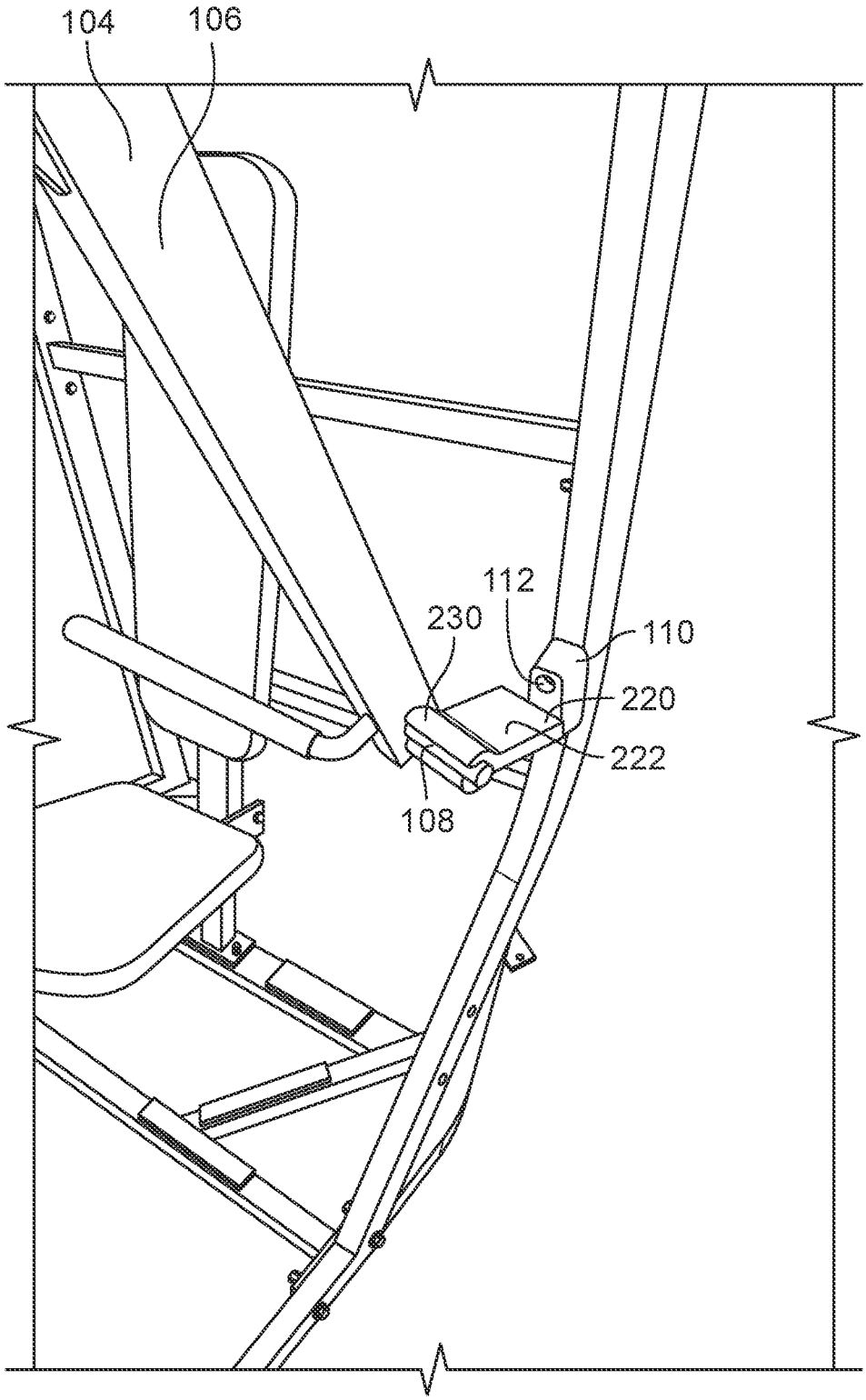
FIG. 13 presents a view of a press partner clamp apparatus in accordance with the present invention, in use on a plate-loaded weight machine.

As shown at FIG. 12, the press partner clamp apparatus coupling means may include one or more magnetic attachment means 284 configured to releasably secure the apparatus components together. The magnetic attachment means may be provided with the pegs 292 and peg-receiving holes 294. As described hereinbelow, the press partner clamp and the at least one block extension may comprise an interlocking coupling assembly.

The press partner clamp body 222 may be a single, unitary solid structure that may be manufactured out of plastic, rubber, or foam. It may be manufactured using 3D printing, injection modeling, or some other manufacturing process. If using both arms 106 of the plate-loaded exercise machine, a pair of press partner clamp apparatuses 220 will be required; one for each arm 206.

The C-shaped lower portion 230 may comprise a 101.6 mm long cylinder 230A having a 50.8 mm OD and a 22.25 mm ID. A 45° V-shaped cutout 238 is located along the axis of the cylinder 230A. The clamp upper block portion 240 may comprise a rectangular extrusion 240A, having a length of 101.6 mm and a thickness of 25.4 mm, extending along the axis and protruding from the cylinder 240A on a side opposite the 45° V-shaped cutout 238. The dimensions allow for the apparatus 220 to fit onto a contact rod 108 which has a diameter of about 1 inch. This size contact rod is typically found on Life Fitness Hammer Strength products. However, the dimensions of the components of the press partner clamp apparatus may be altered to allow attachment to other brand devices with different side contact rods.

To use the press partner clamp apparatus 220, a user may first attach the clamp apparatus 220 to the exercise equipment by attaching the C-shaped lower portion 230 to the arm contact rod 108 of the exercise machine 104 prior to the addition of any weighted plates. If both arms 106 of the exercise equipment will be utilized, a second press partner clamp apparatus 220 will be required for attachment to the second arm contact rod 108. The press partner clamp apparatus 220 may either be slid axially onto the rods 108 or forcibly snapped onto the rods 108 by pressing the V-shaped cutout 238 along the C-shaped lower portion 230 cylindrical portion 230A of the clamp apparatus 220 against the contact rods 108. One or more block extensions 244 may be secured to the upper block portion 240. The clamp apparatus 220 may then be rotated around the contact rods 108 until an optimal contact with the bumper 110 of the exercise machine 104 is achieved. Weighted plates may then be added to the exercise machine 104 equipment per the preference of the user. The compression provided by the snap-fit of the clamp apparatus 220 prevents it from rotating around the contact rod 108 during use.

Referring next to FIGS. 14-27, a press partner sleeve device 354 is shown in accordance with an illustrative embodiment of the invention. Reference numerals which correspond to like elements of the system 100 and the press partner clamp apparatus 220 heretofore described with respect to FIGS. 1-13 are designated by the same reference numerals in the 100-199 series and 200-299 series in FIGS. 1-13.

Figure 14:
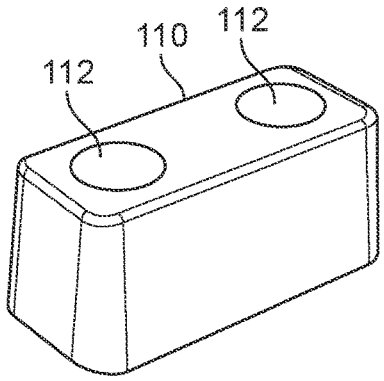
FIG. 14 presents an isometric view of a bumper of a plate-loaded weight machine.
Figure 15:
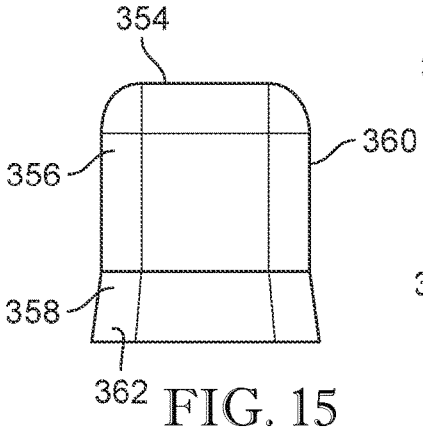
FIG. 15 presents a front elevation view of a unitary press partner sleeve device in accordance with an illustrative embodiment of the present invention.
Figure 16:
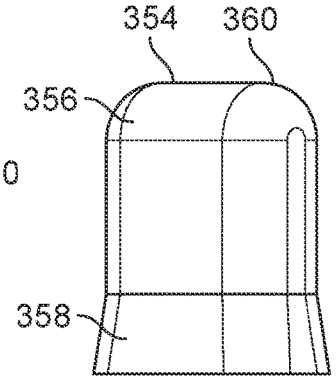
FIG. 16 presents an isometric view of a unitary press partner sleeve device as in FIG. 13.
Figure 17:
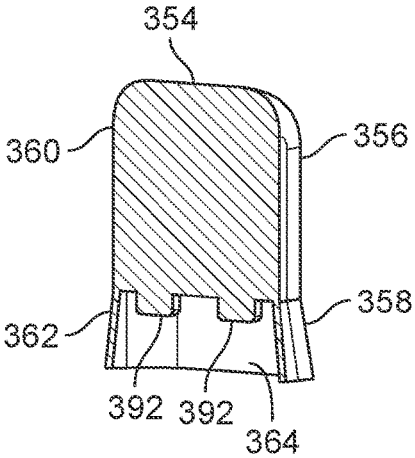
FIG. 17 presents a sectional view of a unitary press partner sleeve device as in FIG. 14.
Figure 18:
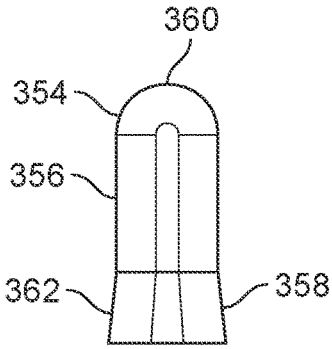
FIG. 18 presents a side elevation view of a unitary press partner sleeve device as in FIG. 13.
Figure 19:
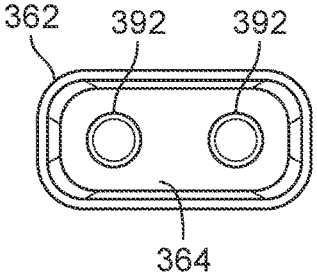
FIG. 19 presents a bottom plan view of a unitary press partner sleeve device as in FIG. 13.
Figure 20:
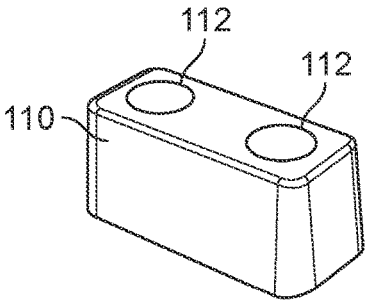
FIG. 20 presents an isometric view of a bumper of a plate-loaded weight machine.
Figure 21:
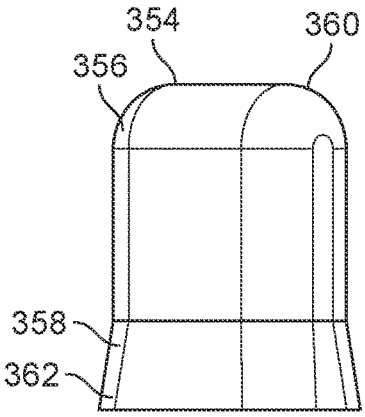
FIG. 21 presents an isometric view of a unitary press partner sleeve device.
Figure 22:
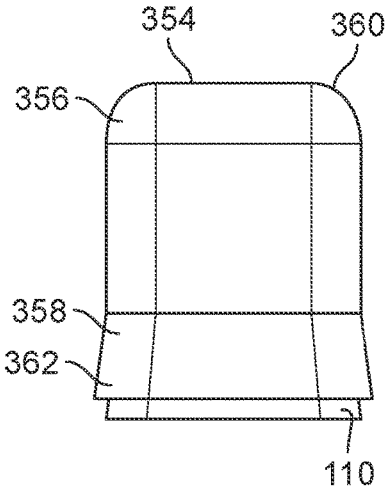
FIG. 22 presents a front elevation view of a unitary press partner sleeve device installed on a bumper of a representative plate-loaded weight machine.
Figure 23:
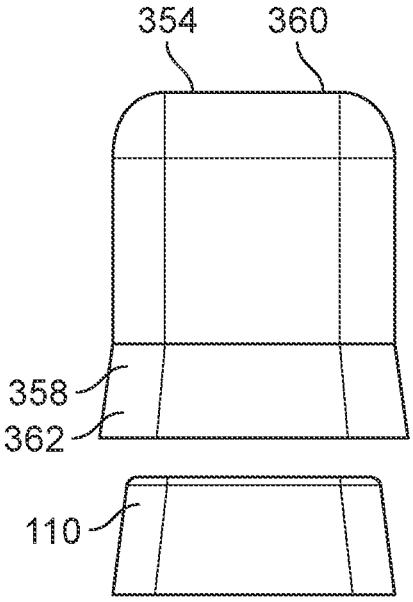
FIG. 23 presents a side elevation view of a unitary press partner sleeve device being installed on a bumper of a representative plate-loaded weight machine.
Figure 24:
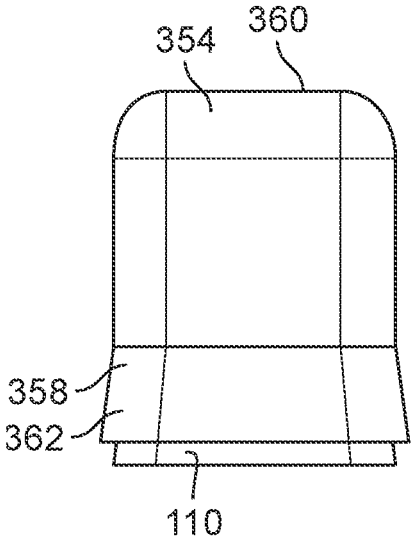
FIG. 24 presents a rear elevation view of a unitary press partner sleeve device installed on a bumper of a representative plate-loaded weight machine.
Figure 25:
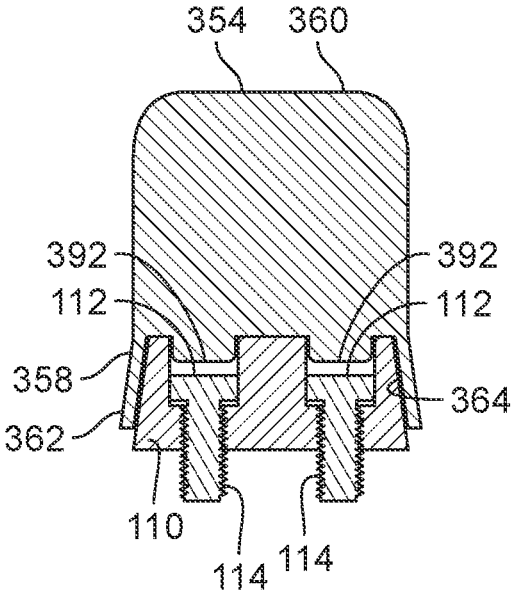
FIG. 25 presents a cross-section view of a unitary press partner sleeve device installed on a bumper of a representative plate-loaded weight machine, enlarged to show detail.
Figure 26:
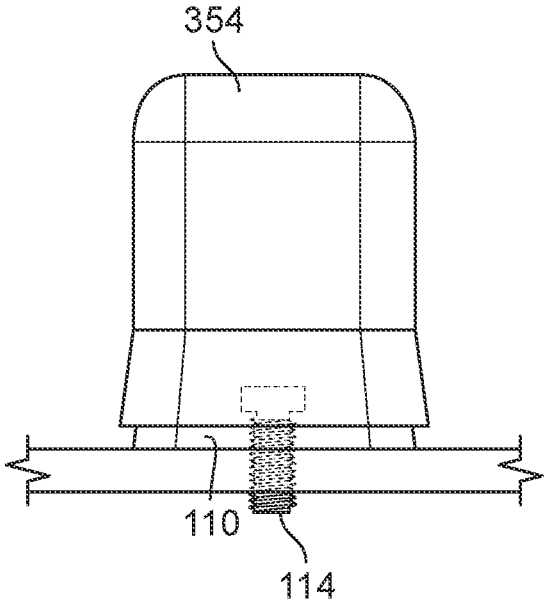
FIG. 26 presents a partial section view of a representative plate-loaded weight machine with a unitary press partner sleeve device installed thereon, enlarged to show detail.
Figure 27:
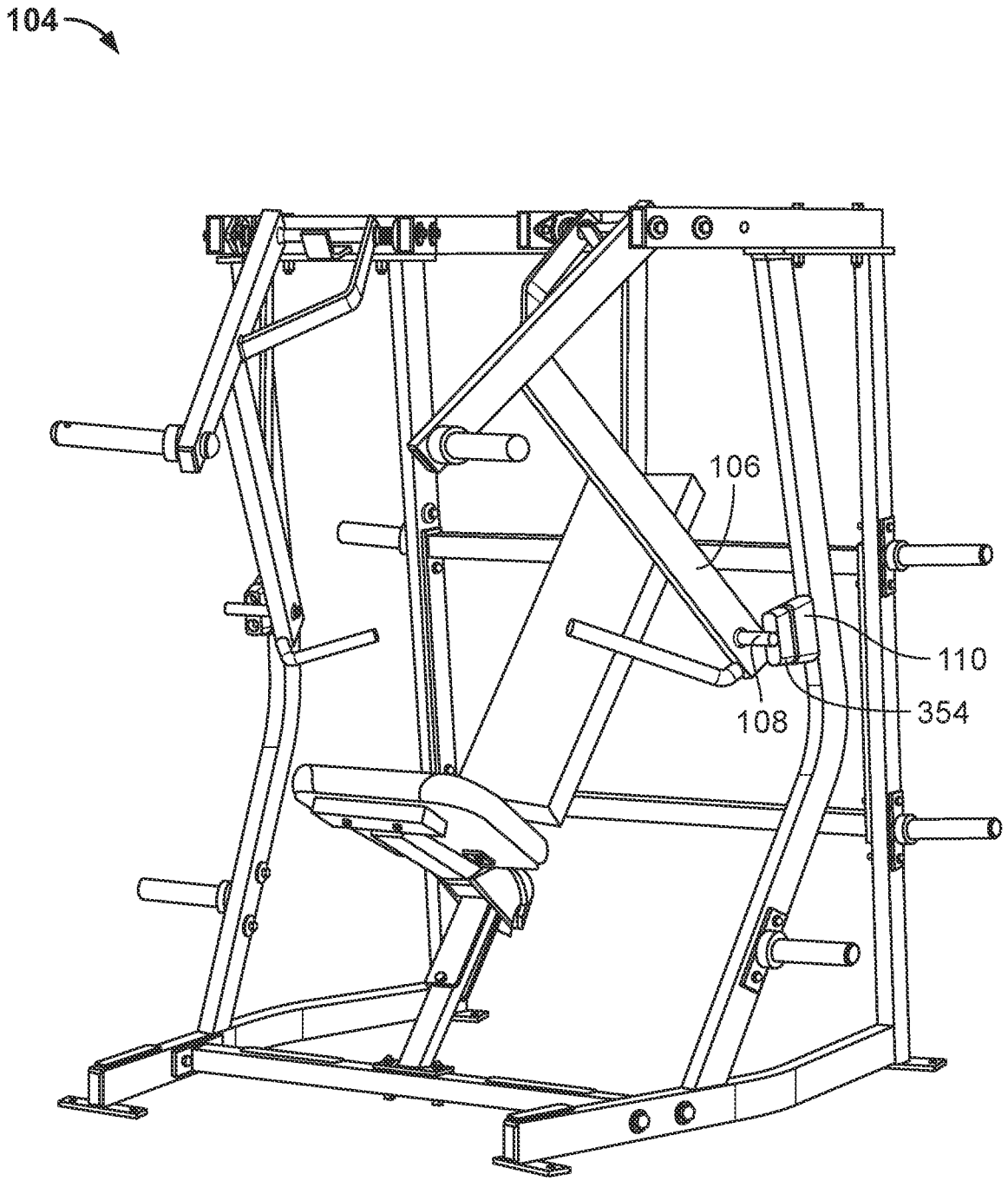
FIG. 27 presents an isometric view of a representative plate-loaded weight machine with the unitary press partner sleeve device installed thereon.

FIG. 14 shows a representative bumper 110 of a plate-loaded weight machine 104. As illustrated in FIG. 25, the unitary press partner sleeve device 354 is configured for installation on an exterior surface of a bumper 110 of a plate-loaded weight machine 104. The press partner sleeve device 354 comprises press partner sleeve device elements with coupling means for releasably interconnecting the press partner sleeve device elements.

The press partner sleeve device 354 further comprises a sleeve device upper portion 356, a press partner lower skirt portion 358, and has a sleeve device exterior surface 360.

The press partner lower skirt portion 358 has a skirt exterior 362 and a skirt interior 364. The skirt interior 364 is configured to be releasably coupled to the exterior surface of the bumper 110 of the plate-loaded weight machine 104, such that the skirt lower portion 358 fits over at least a portion of the bumper 110.

The bumper 110 of the exercise machine 104 has a pair of bolt channels 112. The skirt interior 364 includes downwardly extending pegs 392 shaped to mate with the bolt channels 112 of the bumper 110.

Referring next to FIGS. 28-33, a press partner sleeve apparatus 454 is shown in accordance with an illustrative embodiment of the invention. Reference numerals which correspond to like elements of the system 100, the press partner clamp 220, and the unitary press partner sleeve device 354, heretofore described with respect to FIGS. 1-13, and FIGS. 14-27 are designated by the same reference numerals in the 100-199 series, the 200-299 series, and the 300-399 series as in the 400-499 series shown at FIGS. 28-33.

As illustrated in FIG. 28-33, the press partner sleeve apparatus 454 is configured for installation on an exterior surface of a bumper 110 of a plate-loaded weight machine 104. The press partner sleeve apparatus 454 comprises press partner sleeve apparatus elements with coupling means for releasably interconnecting the press partner sleeve apparatus elements.

The press partner sleeve apparatus 454 further comprises a press partner lower skirt 458, a press partner main sleeve 474, at least one press partner sleeve extension 478 and a press partner sleeve cap 486.

The press partner lower skirt 458 has a skirt outer portion 462, a skirt interior portion 464, a skirt upper portion 466, a skirt lower portion 468, and a skirt top surface 470. The skirt interior portion 464 is configured to be releasably coupled to the exterior surface of the bumper 110 of the plate-loaded weight machine 104, such that the skirt lower portion 468 fits over at least a portion of the bumper 110 and the skirt upper portion 466 extends beyond the bumper 110.

The press partner main sleeve 474 has a main sleeve longitudinal length, a main sleeve top 476, and a main sleeve bottom 476. The press partner main sleeve 474 is configured to be releasably coupled to the press partner lower skirt portion 468.

The at least one press partner sleeve extension 478 has a sleeve extension longitudinal length, a sleeve extension top 480, and a sleeve extension bottom 482. The at least one press partner sleeve extension 478 is configured to be releasably coupled to the press partner main sleeve 474 to provide an extended press partner sleeve having an extended press partner sleeve longitudinal length.

The press partner sleeve cap 486 comprising a cap exterior 488 and a cap interior 490. The cap 486 is configured to be releasably coupled to the main sleeve top 476, and is further configured to be releasably coupled to the sleeve extension top 480 of the at least one press partner sleeve extension 478, so that the cap 486 may be placed on the press partner main sleeve 474 or the at least one press partner sleeve extension 478.

The bumper 110 of the exercise machine 104 has a pair of bolt channels 112. Each component of the press partner sleeve apparatus 454 may be provided with downwardly extending pegs 492 shaped to mate with the bolt channels 112 of the bumper 110. The lower skirt 458 may include a pair of pegs 492A, the main sleeve 474 may include a pair of pegs 492B, and the sleeve extension may include a pair of pegs 492C.

Further, the lower skirt 458, the main sleeve 474, and the sleeve extension 478 may each be provided with a pair of peg-receiving channels 494. The lower skirt 458 may include a pair of peg-receiving channels 494A, the main sleeve 474 includes a pair of peg-receiving channels 494B, and the sleeve extension includes a pair of peg-receiving channels 494C. The channels 494 are configured to receive the pegs 492, so the components of the press partner sleeve apparatus may be assembled in a multitude of configurations to enable the user to further customize the sleeve apparatus 454. The user may thereby determine and customize the range of motion of the exercise machine 104.

Figure 29:
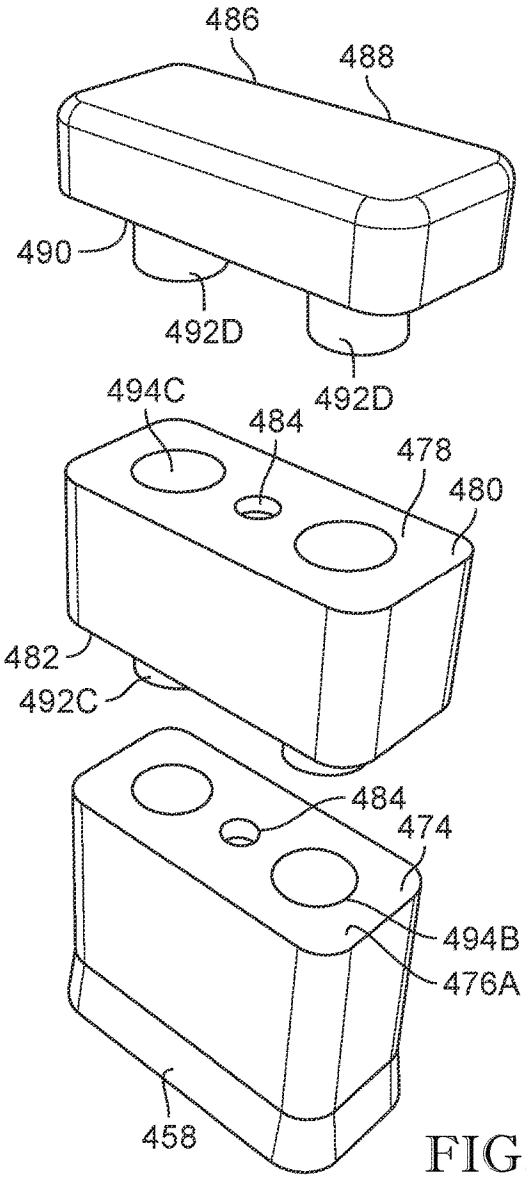
FIG. 29 presents a partial exploded view of the press partner sleeve apparatus showing the lower skirt portion attached to the main sleeve.
Figure 28:
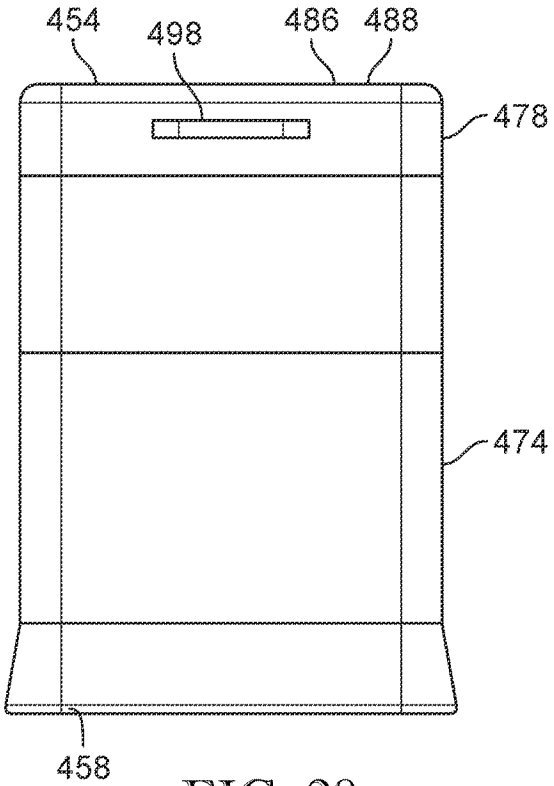
FIG. 28 presents a front elevation view of the press partner sleeve apparatus components assembled without the retention strap.
Figure 30:
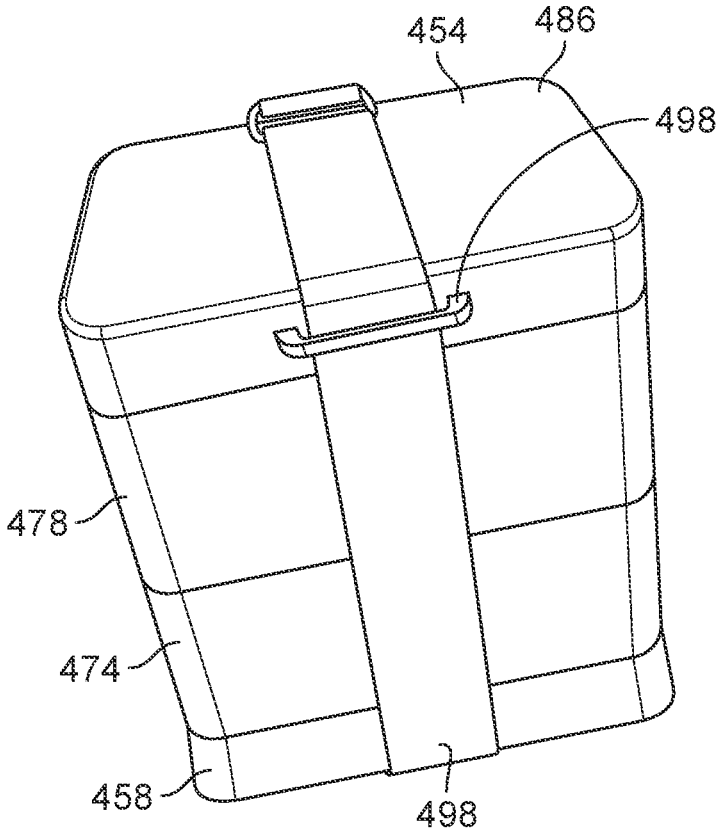
FIG. 30 presents a top front isometric view of the press partner sleeve apparatus components assembled with the retention strap for storage or portability.
Figure 31:
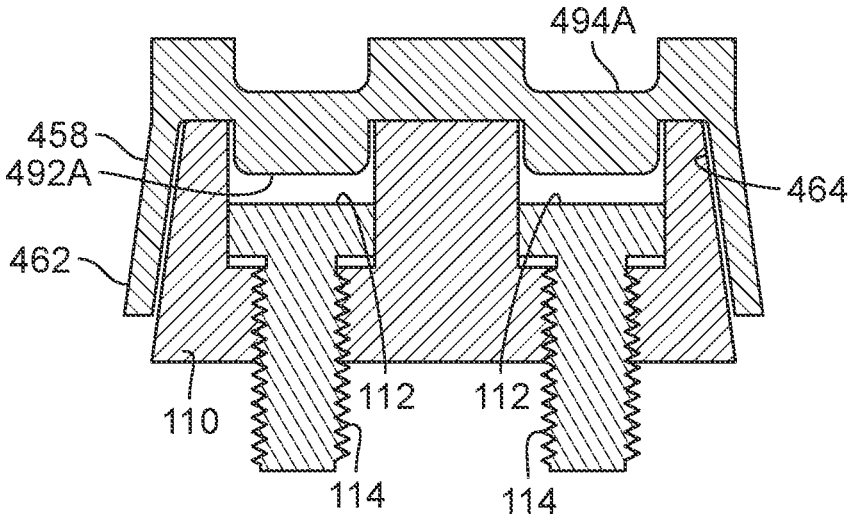
FIG. 31 presents a cross-sectional view of the press partner lower skirt portion installed on a bumper of a plated-loaded weight machine.
Figure 32:
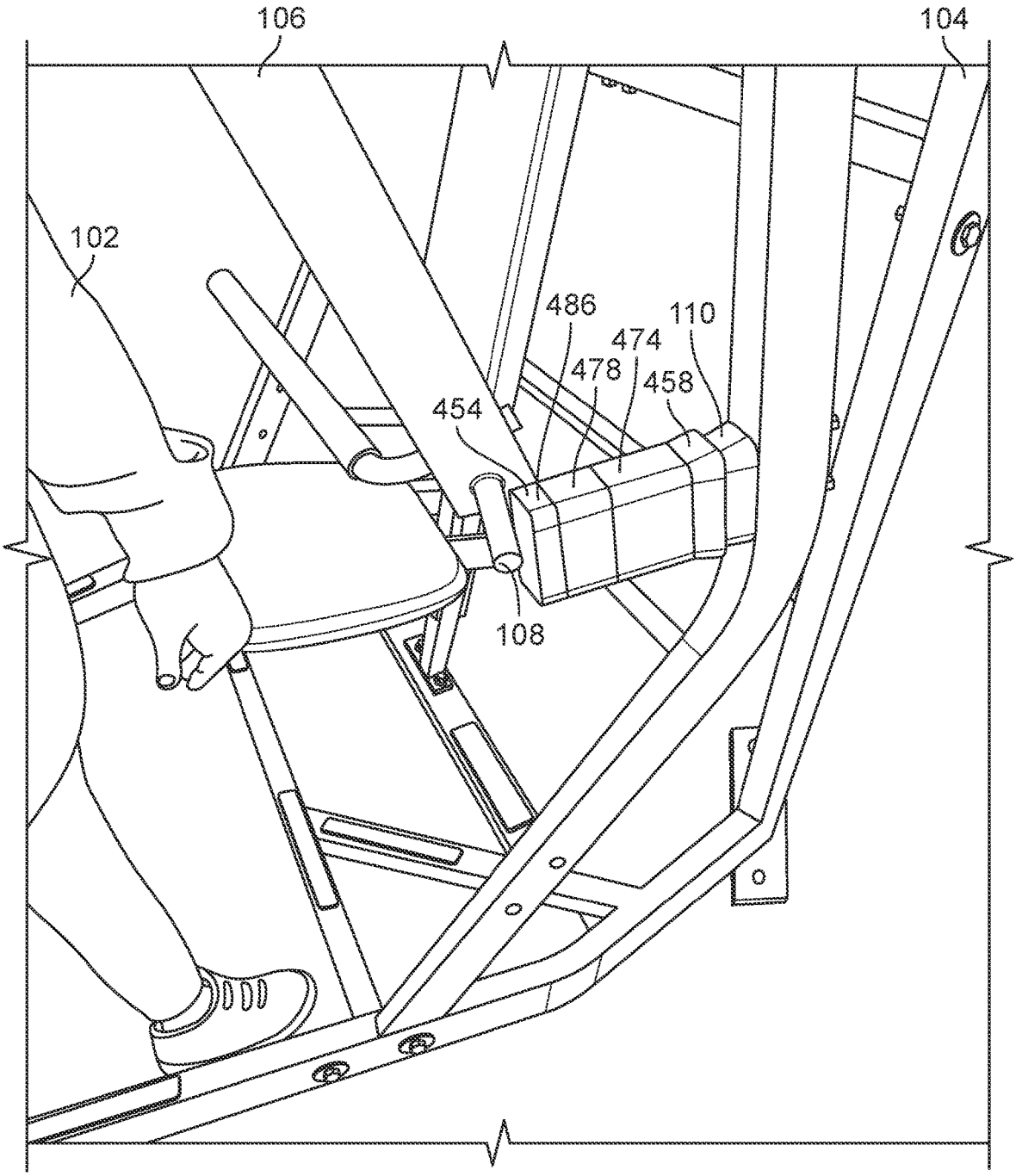
FIG. 32 presents an isometric view of the press partner sleeve apparatus installed on a plate-loaded weight machine, enlarged to show detail.
Figure 33:
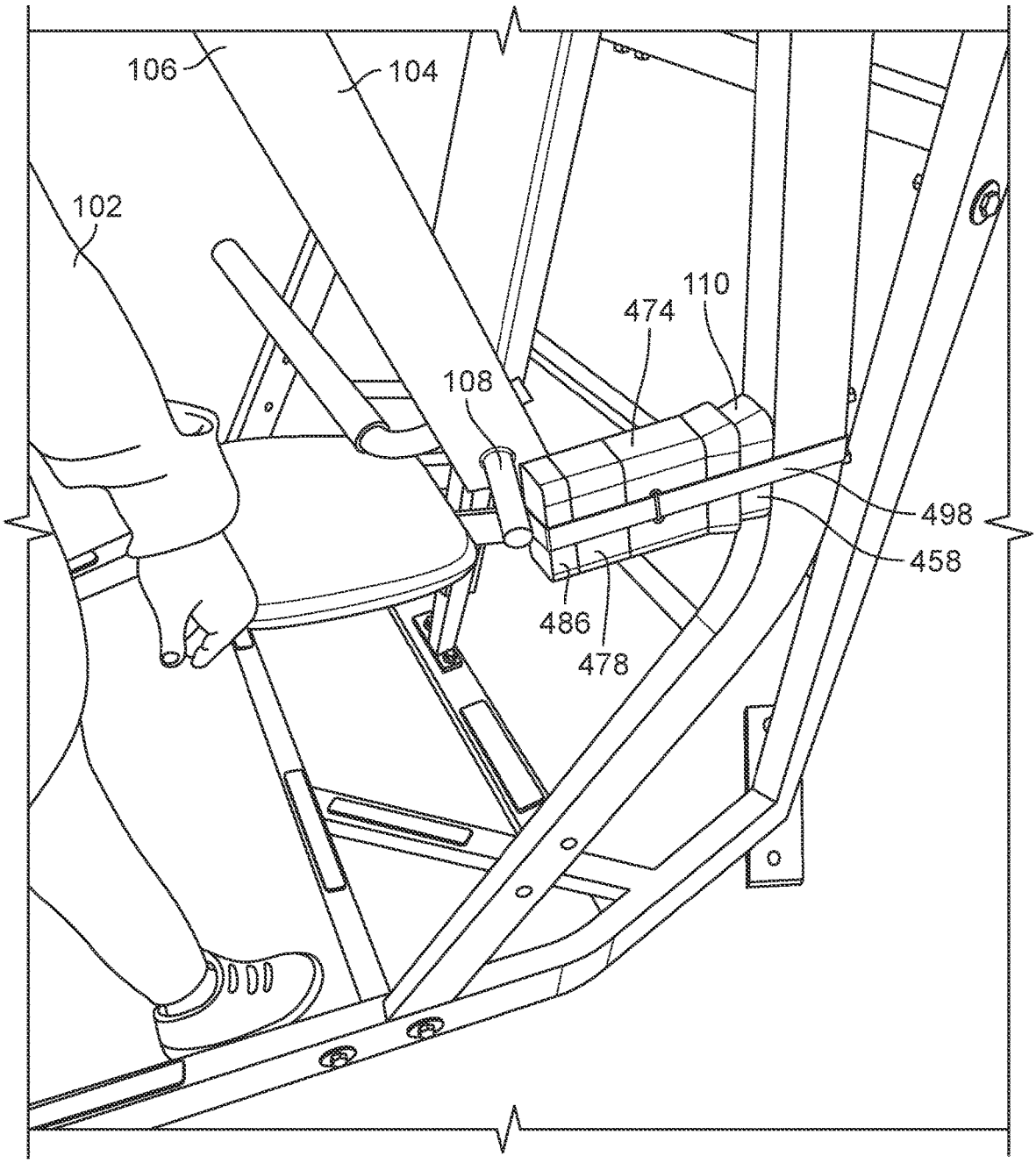
FIG. 33 presents an isometric view of the press partner sleeve apparatus installed on a plate-loaded weight machine, enlarged to show detail.

As seen at FIG. 29, the press partner sleeve apparatus coupling means may include one or more magnetic attachment means 484 configured to releasably secure the apparatus components together, and secure the apparatus to the bumper 110. The magnetic attachment means may be provided with the pegs 492 and peg-receiving holes 494.

Figure 34:
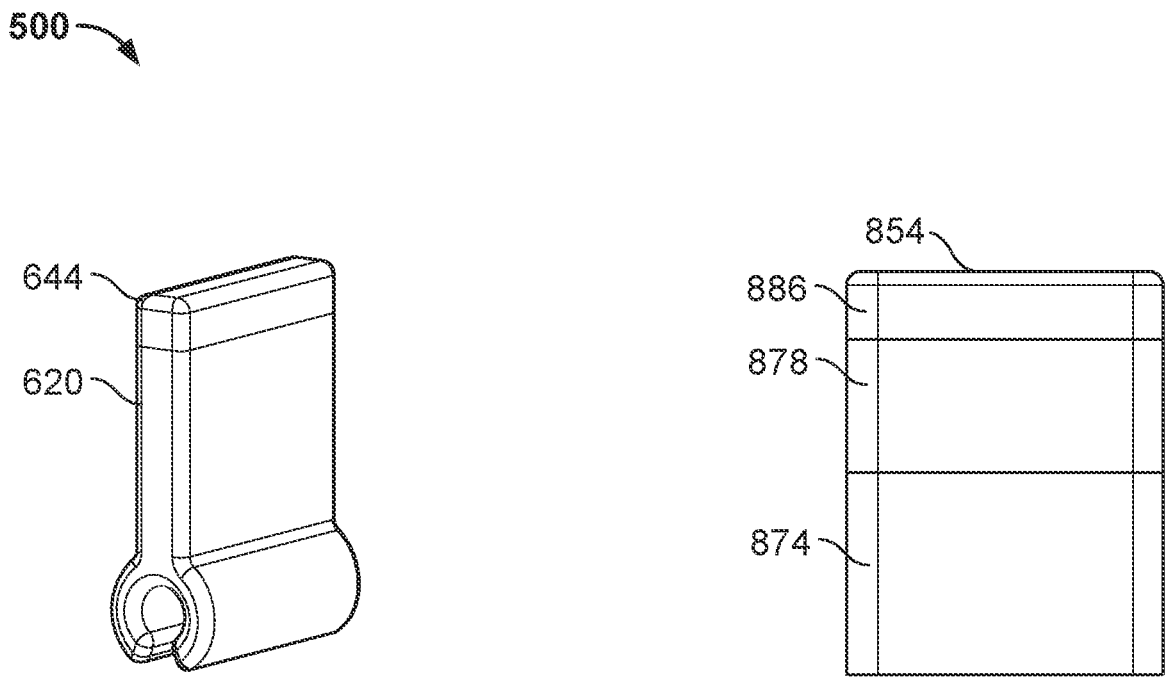
FIG. 34 presents a view of an exemplary press partner system for facilitating the use of a press weight machine in accordance with an illustrative embodiment of the present invention.
Figure 35:
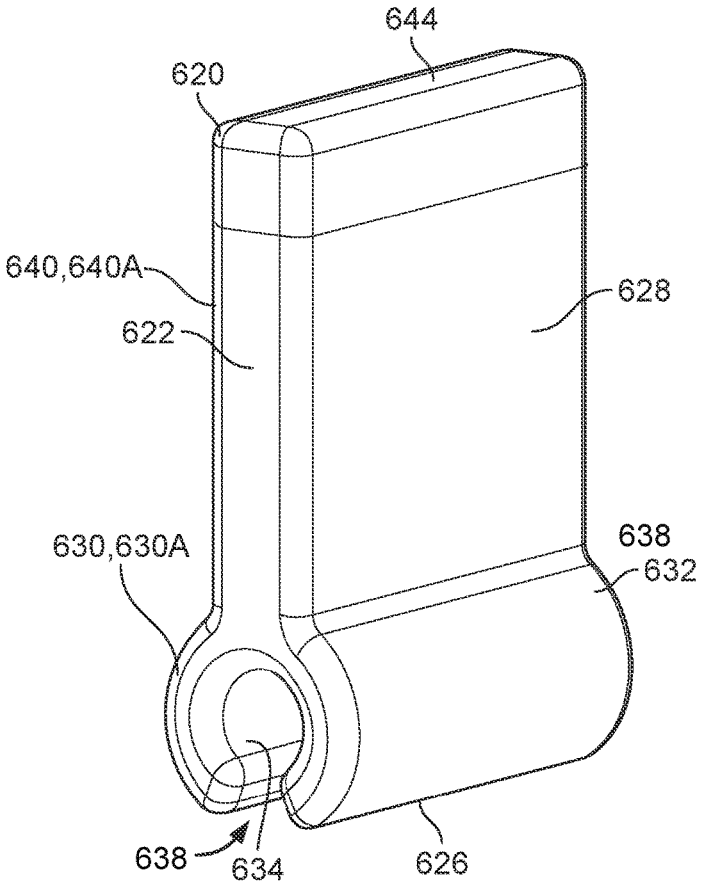
FIG. 35 presents an isometric view of a press partner clamp apparatus with one clamp block extension attached thereto in accordance with an illustrative embodiment of the present invention.
Figure 36:
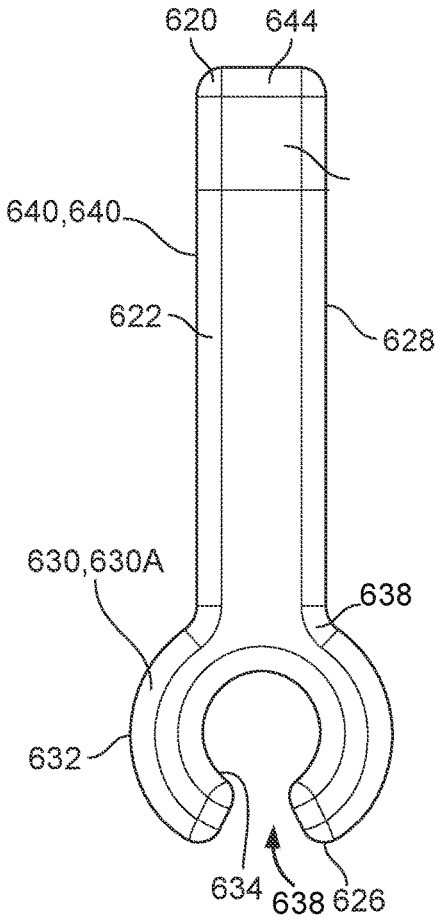
FIG. 36 presents an isometric view of a press partner clamp apparatus in accordance with an illustrative embodiment of the present invention.
Figure 37:
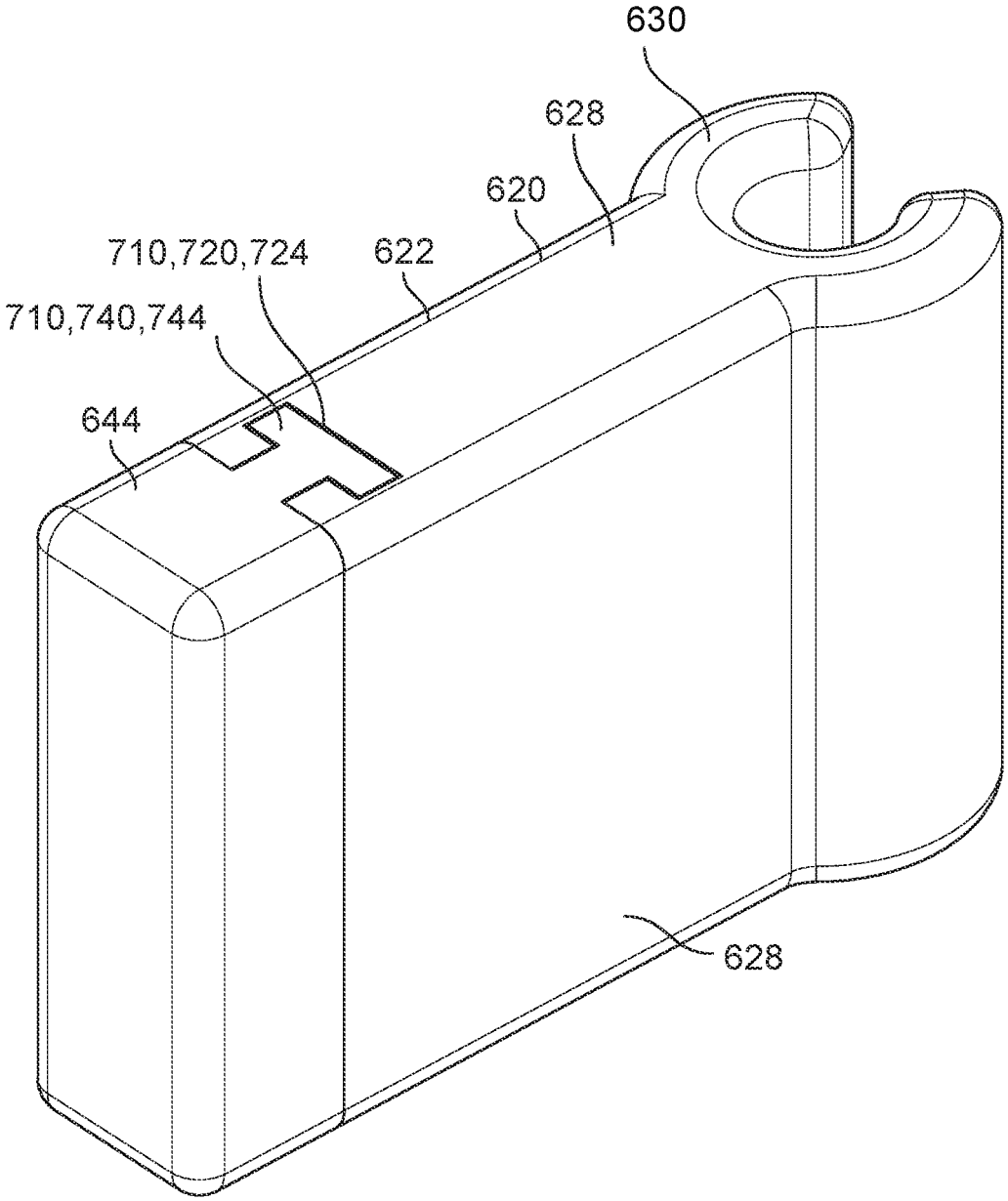
FIG. 37 presents an isometric view of a press partner clamp apparatus in accordance with an illustrative embodiment of the present invention.
Figure 38:
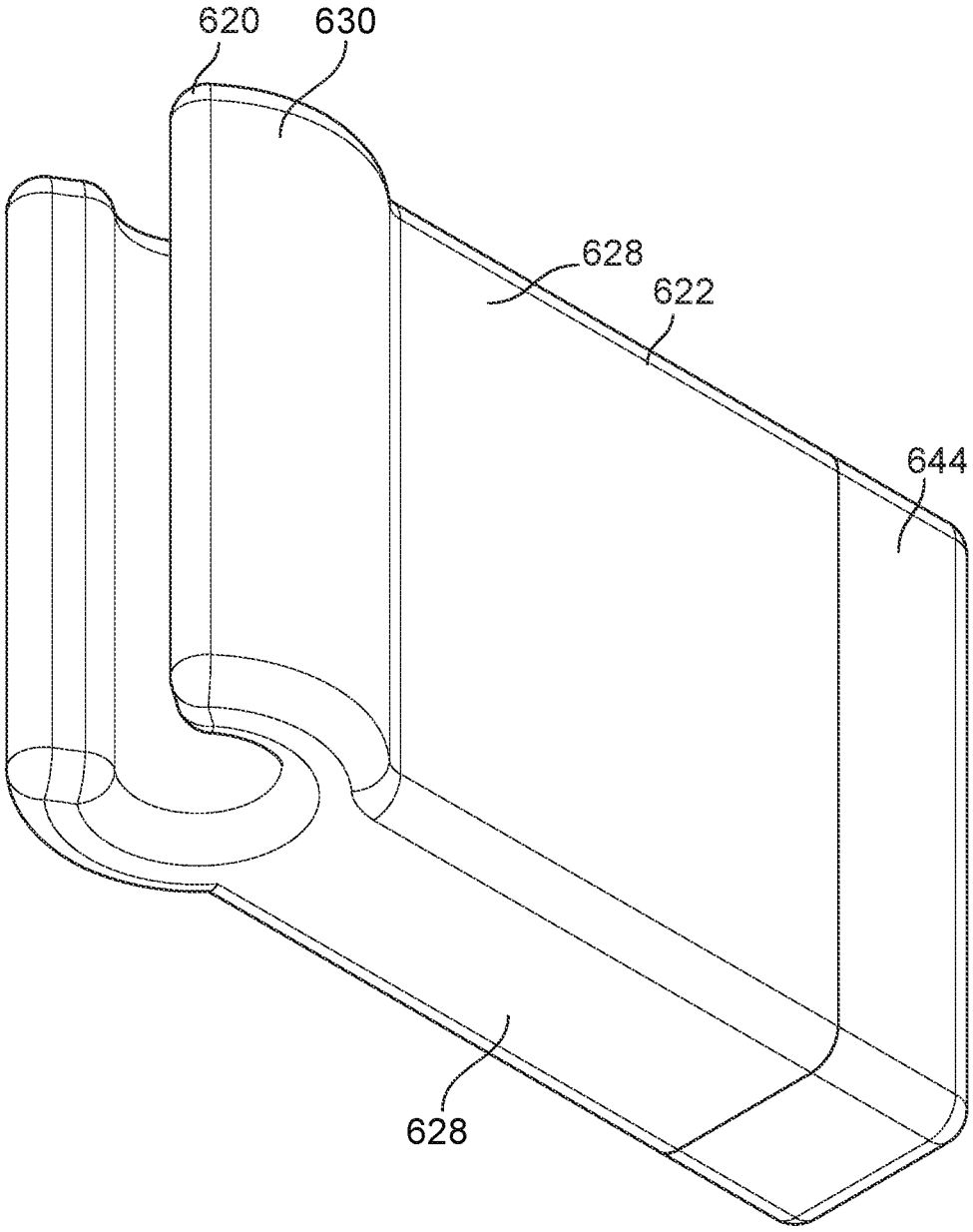
FIG. 38 presents an isometric view of a press partner clamp apparatus in accordance with an illustrative embodiment of the present invention.

Referring next to FIG. 34, a press partner system 500 for facilitating the use of a weight press machine, referred to as system 500, is shown in accordance with an illustrative embodiment of the invention. As shown at FIG. 34, in one embodiment, a press partner system 500 comprises at least one press partner clamp apparatus 620 and at least one press partner sleeve apparatus 854. The press partner clamp apparatus 620 may include optional extensions 644. The at least one press partner sleeve apparatus may comprise a press partner sleeve apparatus 854 including a main sleeve 874, at least one extension 878 and a cap 886. The press partner sleeve system components are configured for installation on a plate-loaded weight machine to modify the range of motion of the machine arm. The components may be removably attached to plate-loaded weight machines to customize the range-of-motion thereof.

Referring now to FIGS. 34-43, a press partner clamp apparatus 620 is shown in accordance with an illustrative embodiment of the present invention. Reference numerals which correspond to like elements of the press partner clamp apparatus 220 heretofore described with respect to FIGS. 5-13, are designated by the same reference numerals in the 600-799 series shown at FIGS. 34-43 as in the 200-299 series of FIGS. 5-13.

Figure 41:
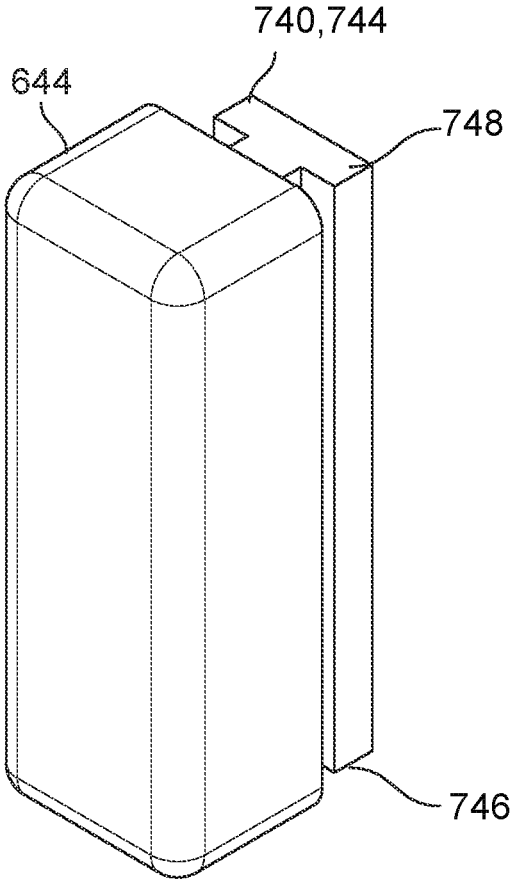
FIG. 41 presents an isometric view of a clamp block extension of a press partner clamp apparatus in accordance with an illustrative embodiment of the present invention.
Figure 42:
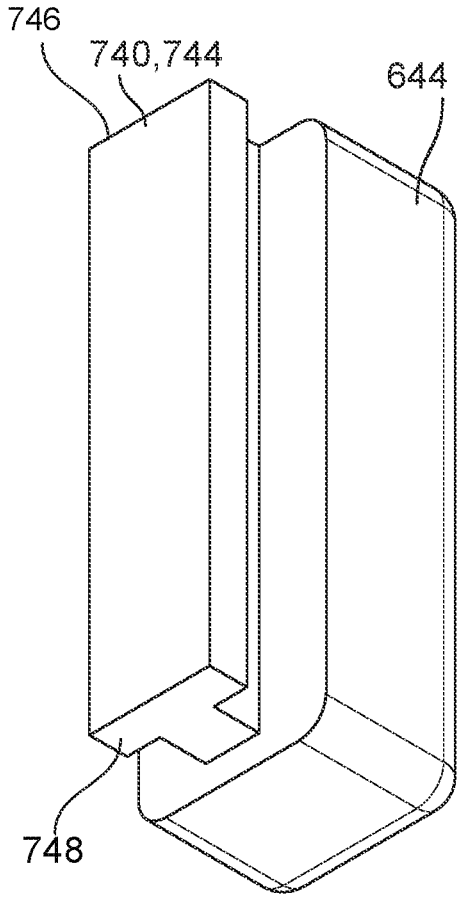
FIG. 42 presents an isometric view of a clamp block extension of a press partner clamp apparatus in accordance with an illustrative embodiment of the present invention.
Figure 43:
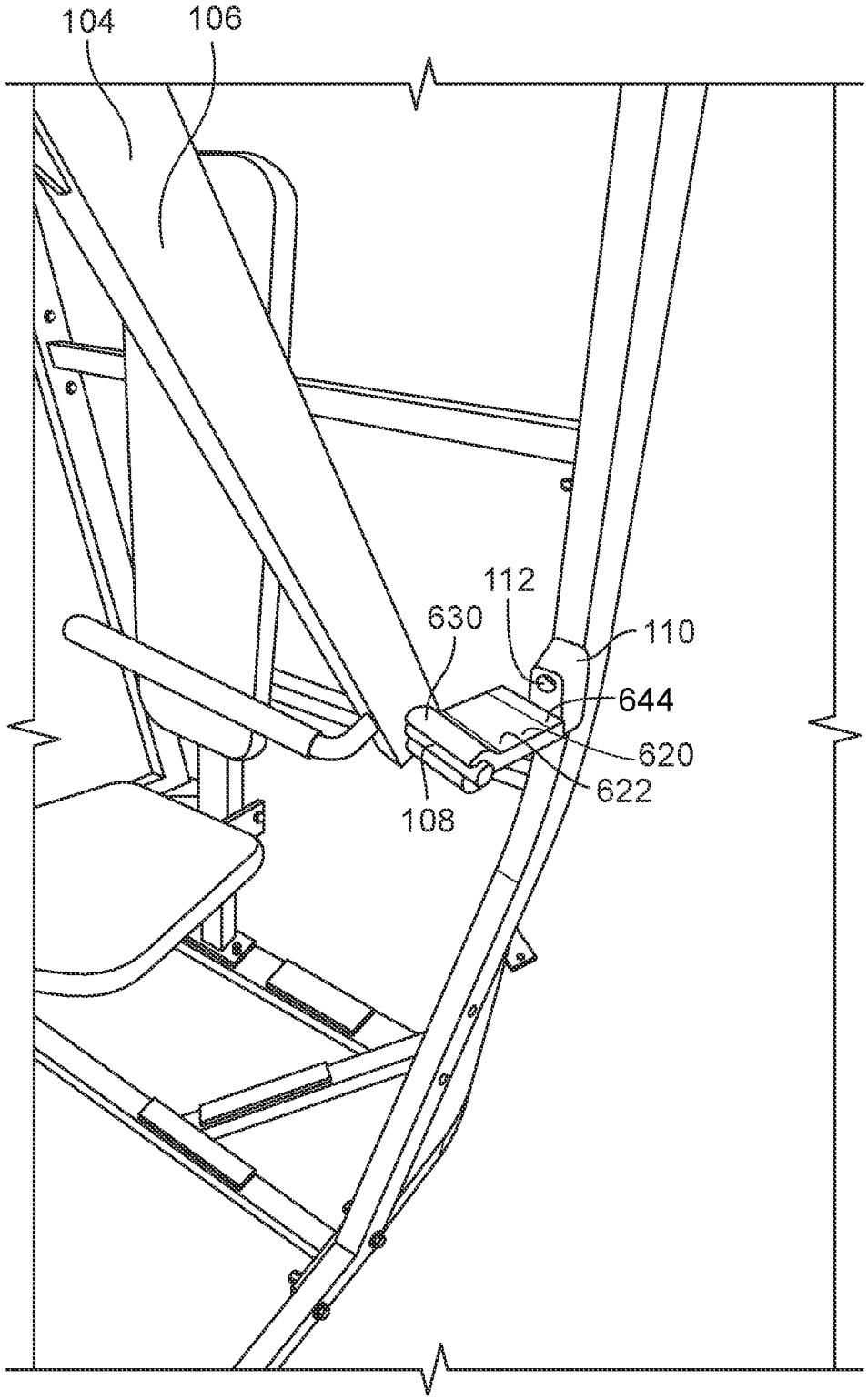
FIG. 43 presents an isometric view of the press partner clamp apparatus installed on a plate-loaded weight machine, enlarged to show detail.
Figure 44:
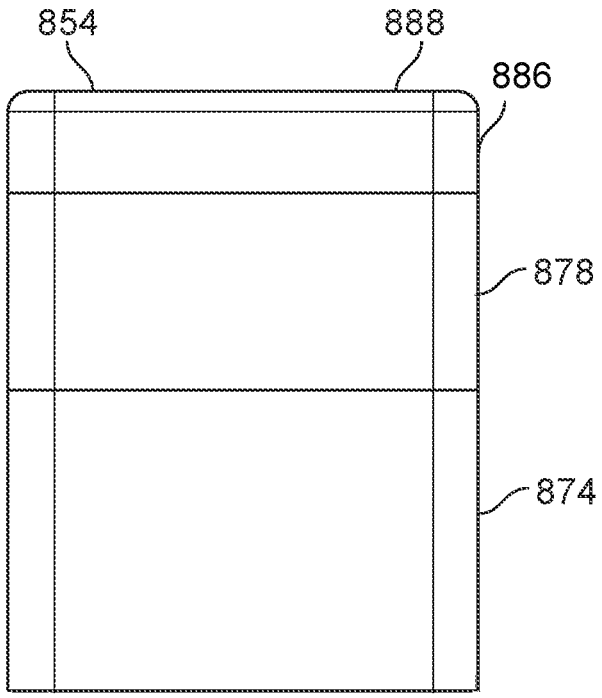
FIG. 44 presents an isometric view of a press partner sleeve apparatus in accordance with an illustrative embodiment of the present invention.

The press partner clamp apparatus 620 is configured for easy, removable installation on an arm side contact rod 108 of an arm 106 of a plate-loaded weight press machine 104, best seen at FIG. 41. The press partner clamp apparatus 620 comprises press partner clamp apparatus elements with coupling means for releasably interconnecting the press partner clamp apparatus elements.

Figure 39:
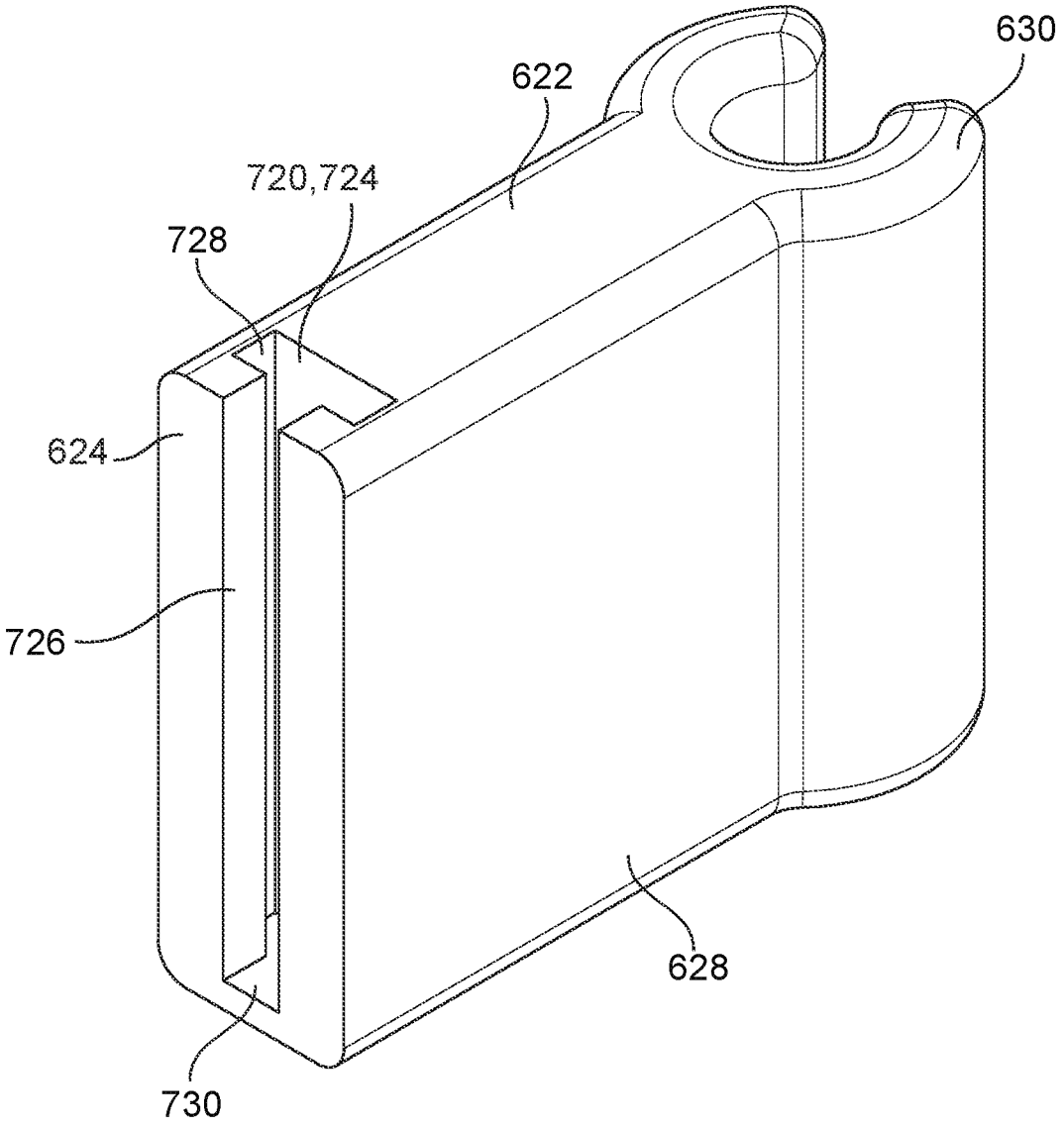
FIG. 39 presents an isometric view of a clamp body and C-shaped clamp lower portion of a press partner clamp apparatus in accordance with an illustrative embodiment of the present invention.
Figure 40:
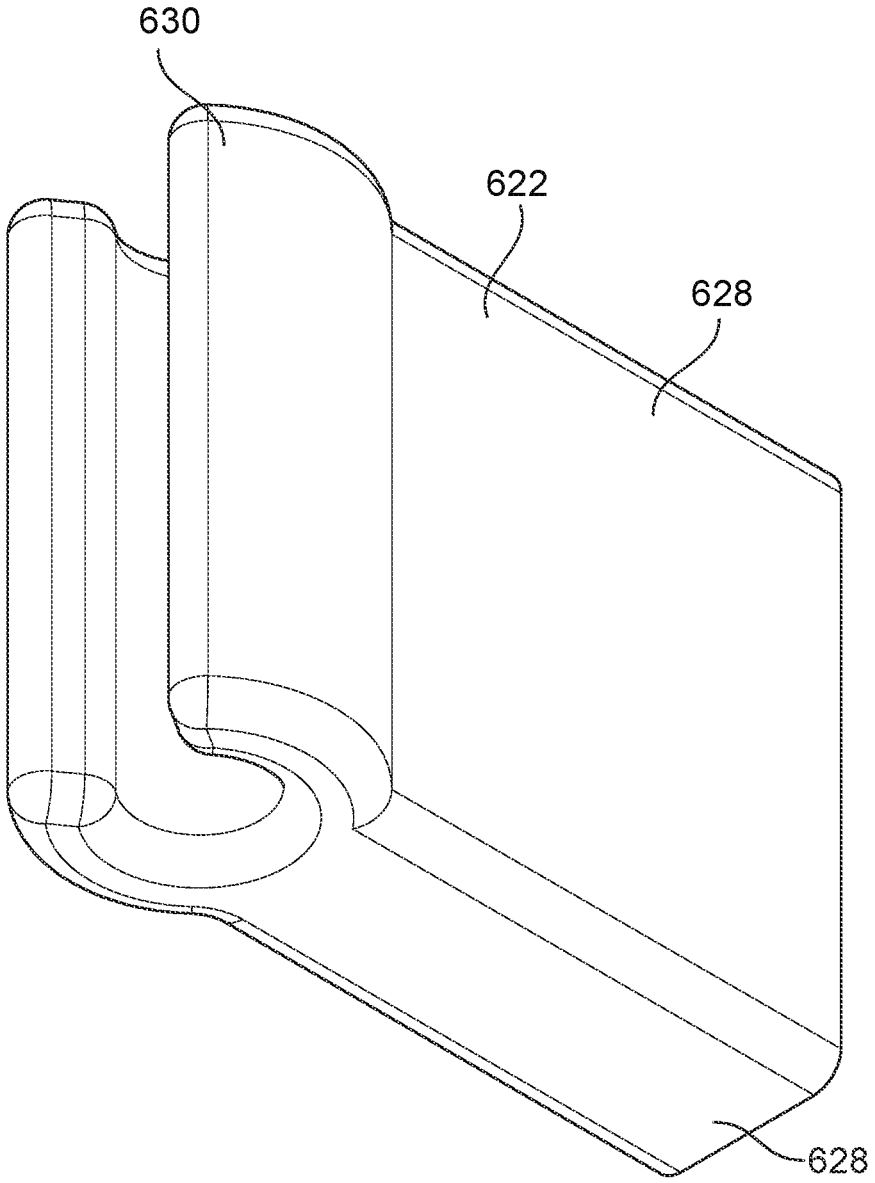
FIG. 40 presents an isometric view of a clamp body and a C-shaped clamp lower portion of a press partner clamp apparatus in accordance with an illustrative embodiment of the present invention.

The press partner clamp apparatus 620 comprises a press partner clamp body 622 having a clamp body top 624 (best seen at FIG. 39), a clamp body bottom 626, and clamp body sides 628. The press partner clamp apparatus clamp body 622 further comprises a C-shaped clamp lower portion 630, a clamp upper block portion 640, and at least one clamp block extension 644. As shown at FIG. 39, the C-shaped clamp lower portion 630 is configured for removable attachment to the arm side contact rod 108 of the plate-loaded weight machine 104.

The clamp upper block portion 640 extends upwardly from the C-shaped clamp lower portion 630, the clamp upper block portion 640 having a longitudinal direction and an upper block longitudinal length.

The C-shaped clamp lower portion 630 and the clamp upper portion 640 may be of unitary construction.

The at least one clamp block extension 644 has a block extension longitudinal length, the at least one clamp block extension 644 being configured to be releasably coupled to the clamp upper block portion 640 of the press partner clamp apparatus 620 to provide an extended upper block portion. The at least one clamp block extension has a block extension outer portion having a longitudinal direction and a block extension interior portion having a longitudinal direction.

At least one block extension 644 may be installed on top of the press partner clamp body 622 for extension of the length of the press partner clamp apparatus 620. The clamp apparatus 620 comprises a clamp block extension coupling means 710 for releasable coupling of the clamp body 622 to the clamp block extension 644. The clamp block extension coupling means 710 comprises a press partner clamp body coupling portion 720 and a block extension coupling means 740, which are configured for releasable connection of the clamp block extension 644 to the clamp body 622 to provide a composite press partner clamp body 622 and clamp block extension 644 having a composite extended longitudinal length to increase the length of the press partner clamp apparatus 620.

The coupling means 710 may comprise an interlocking coupling assembly 710. The press partner clamp body coupling portion 720 may comprise a clamp coupling portion 720 and the block extension coupling means 740 may comprise a block extension coupling portion 740, the press partner clamp body coupling portion 720 and the block extension coupling portion 740 being constructed and arranged for removable and reversible coupling. The interlocking coupling assembly 710 may comprise a male coupling portion and a female coupling portion.

The press partner clamp body coupling portion 720 may be integrally molded with the press partner clamp body 630, or may be machined or cut into the press partner clamp body 630. The block extension coupling portion 740 may be integrally molded with the block extension 644, or may be machined or cut into the block extension 644.

The portions of the interlocking coupling assembly 710 may be any shape or configuration capable of interlocking. In some embodiments, the interlocking coupling assembly 710 comprises portions having an inverted T-shaped cross-section. The press partner clamp body coupling portion 720 comprises a channel 724 having an inverted T-shaped cross-section. The block extension 644 has a downwardly extending block extension coupling portion 734 which has an inverted T-shaped cross-section. The press partner clamp body coupling portion channel 724 is configured to receive the downwardly extending block extension coupling portion 734 of the block extension 644.

In some embodiments, the interlocking coupling assembly 710 comprises portions having an inverted T-shaped cross-section. The press partner clamp body coupling portion 720 comprises a channel 724 having an inverted T-shaped cross-section. The channel 724 is provided in the clamp upper block portion 640 of the press partner clamp body 622 and extends downwardly from the clamp upper body top 624. The channel 724 has a channel upper opening 726, a channel first open end 728 provided in a clamp body side 628, and a channel second closed end 730. The block extension 644 has a downwardly extending block extension coupling portion 744 which has an inverted T-shaped cross-section. The block extension coupling portion 744 has a block extension coupling portion first end 746 that is coplanar with a block extension side 646, and a block extension coupling portion second recessed end 748. The press partner clamp body coupling portion channel 724 is configured to receive the downwardly extending block extension coupling portion 744 of the block extension 644.

In some embodiments, the press partner clamp assembly may comprise a plurality of block extensions and a removable press partner clamp cover member or cap. The configuration of the plurality of block extensions and the removable cover member or cap may be analogous to the at least one press partner sleeve extension and press partner sleeve cap described hereinbelow with reference to FIGS. 44-59. To facilitate the installation and use of multiple block extensions, the at least one block extension coupling portion may comprise a first lower block extension coupling portion and a second upper block extension coupling portion. A first block extension may be provided and reversibly coupled with the press partner clamp coupling portion by coupling the first lower coupling portion of the first block extension with the press partner clamp coupling portion. The at least one block extension may comprise a plurality of block extensions. A second block extension may be provided and reversibly coupled with the first block extension to further extend the length of the press partner clamp apparatus, by reversibly coupling the first lower coupling portion of the second block extension with the second upper coupling portion of the first block extension. Multiple block extensions may be "stacked" for further extension of the press partner clamp apparatus length. The press partner clamp apparatus may further comprise a press partner clamp cover member or cap configured to be reversibly coupled with the press partner clamp coupling portion. The press partner clamp cap may comprise a clamp cap coupling portion configured for coupling with the press partner clamp body coupling portion, or with the second upper coupling portion of a block extension. The press partner clamp cap may be removed to permit installation of at least one block extension, and may then be installed over an uppermost block extension. The portions of the interlocking coupling assemblies may be any shape or configuration capable of interlocking. In some embodiments, the interlocking coupling assembly comprises portions having an inverted T-shaped cross-section. The press partner clamp body coupling portion comprises a channel having an inverted T-shaped cross-section. Each block extension has a downwardly extending first lower block extension coupling portion which has an inverted T-shaped cross-section, and a second upper block extension coupling portion which comprises a channel having an inverted T-shaped cross-section. The clamp cover member or cap comprises a downwardly extending coupling portion which has an inverted T-shaped cross-section. The press partner clamp body coupling portion channel is configured to receive the downwardly extending first lower block extension coupling portion of a block extension; or the clamp cap coupling portion of a press partner clamp cover member or cap. The second upper block extension coupling portion of a block extension is configured to receive the downwardly extending first lower block extension coupling portion of another block extension; or the clamp cap coupling portion of the press partner clamp cover member or cap. Multiple block extensions may be "stacked" for further extension of the press partner clamp apparatus length. The press partner clamp cap 686 may be removed from a press partner clamp body coupling portion channel to permit installation of at least one block extension, and may then be installed over an uppermost block extension.

The press partner clamp body 622 may be a single, unitary solid structure that may be manufactured out of plastic, rubber, or foam. It may be manufactured using 3D printing, injection modeling, or some other manufacturing process. If using both arms 106 of the plate-loaded exercise machine, a pair of press partner clamp apparatuses 620 will be required; one for each arm 106.

The C-shaped lower portion 630 may comprise a 101.6 mm long cylinder 630A having a 50.8 mm OD and a 22.25 mm ID. A 45° V-shaped cutout 638 is located along the axis of the cylinder 630A. The clamp upper block portion 640 may comprise a rectangular extrusion 640A, having a length of 101.6 mm and a thickness of 25.4 mm, extending along the axis and protruding from the cylinder 640A on a side opposite the 45° V-shaped cutout 238. The dimensions allow for the apparatus 620 to fit onto a contact rod 108 which has a diameter of about 1 inch. This size contact rod is typically found on Life Fitness Hammer Strength products. However, the dimensions of the components of the press partner clamp apparatus may be altered to allow attachment to other brand devices with different side contact rods.

To use the press partner clamp apparatus 620, a user may first attach the clamp apparatus 620 to the exercise equipment by attaching the C-shaped lower portion 630 to the arm contact rod 108 of the exercise machine 104 prior to the addition of any weighted plates. If both arms 106 of the exercise equipment will be utilized, a second press partner clamp apparatus 620 will be required for attachment to the second arm contact rod 108. The press partner clamp apparatus 620 may either be slid axially onto the rods 108 or forcibly snapped onto the rods 108 by pressing the V-shaped cutout 638 along the C-shaped lower portion 630 cylindrical portion 630A of the clamp apparatus 620 against the contact rods 108. One or more block extensions 644 may be secured to the upper block portion 640. The clamp apparatus 620 may then be rotated around the contact rods 108 until an optimal contact with the bumper 110 of the exercise machine 104 is achieved. Weighted plates may then be added to the exercise machine 104 equipment per the preference of the user. The compression provided by the snap-fit of the C-shaped lower portion 630 of the clamp apparatus 620 prevents it from rotating around the contact rod 108 during use.

Referring next to FIGS. 44-57, a press partner sleeve apparatus 854 is shown in accordance with an illustrative embodiment of the present invention. Reference numerals which correspond to like elements of the press partner sleeve apparatus 454 heretofore described with respect to FIGS. 28-33 in the 400-499 series, are designated by the same reference numerals in the 800-999 shown at FIGS. 44-57.

Figure 59:
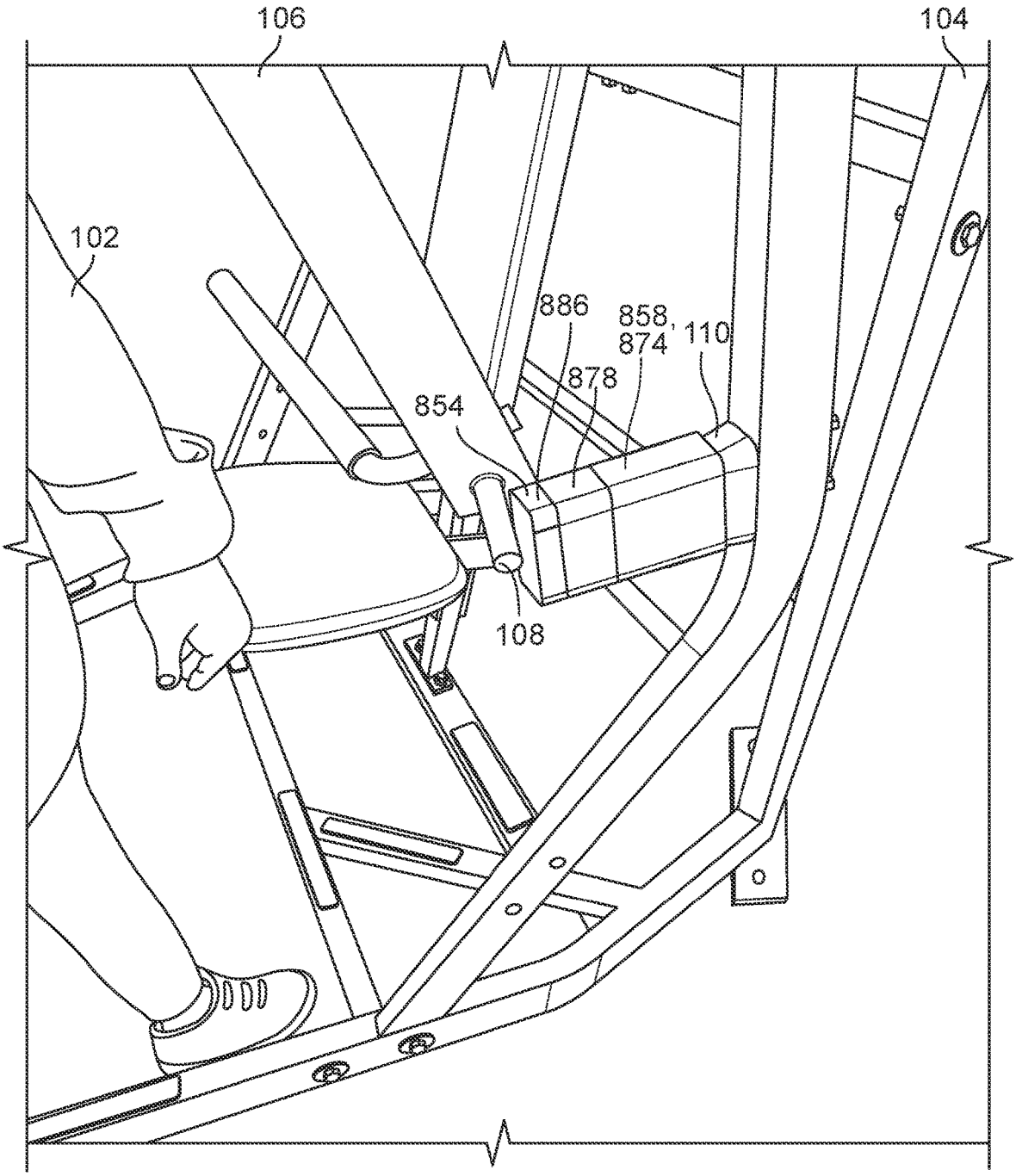
FIG. 59 presents an isometric view of the press partner sleeve apparatus installed on a plate-loaded weight machine, enlarged to show detail.

The press partner sleeve apparatus 854 is configured for installation on an exterior surface of a bumper 110 of a plate-loaded weight machine 104 as shown at FIG. 59. The press partner sleeve system components are configured for installation on a plate-loaded weight machine to modify the range of motion of the machine arm. The components may be removably attached to plate-loaded weight machines to customize the range-of-motion thereof.

The press partner sleeve apparatus 854 comprises press partner sleeve apparatus elements with coupling means for releasably interconnecting the press partner sleeve apparatus elements. The press partner sleeve apparatus 854 further comprises a press partner main sleeve 874, at least one press partner sleeve extension 878 and a press partner sleeve cap 886.

Figure 45:
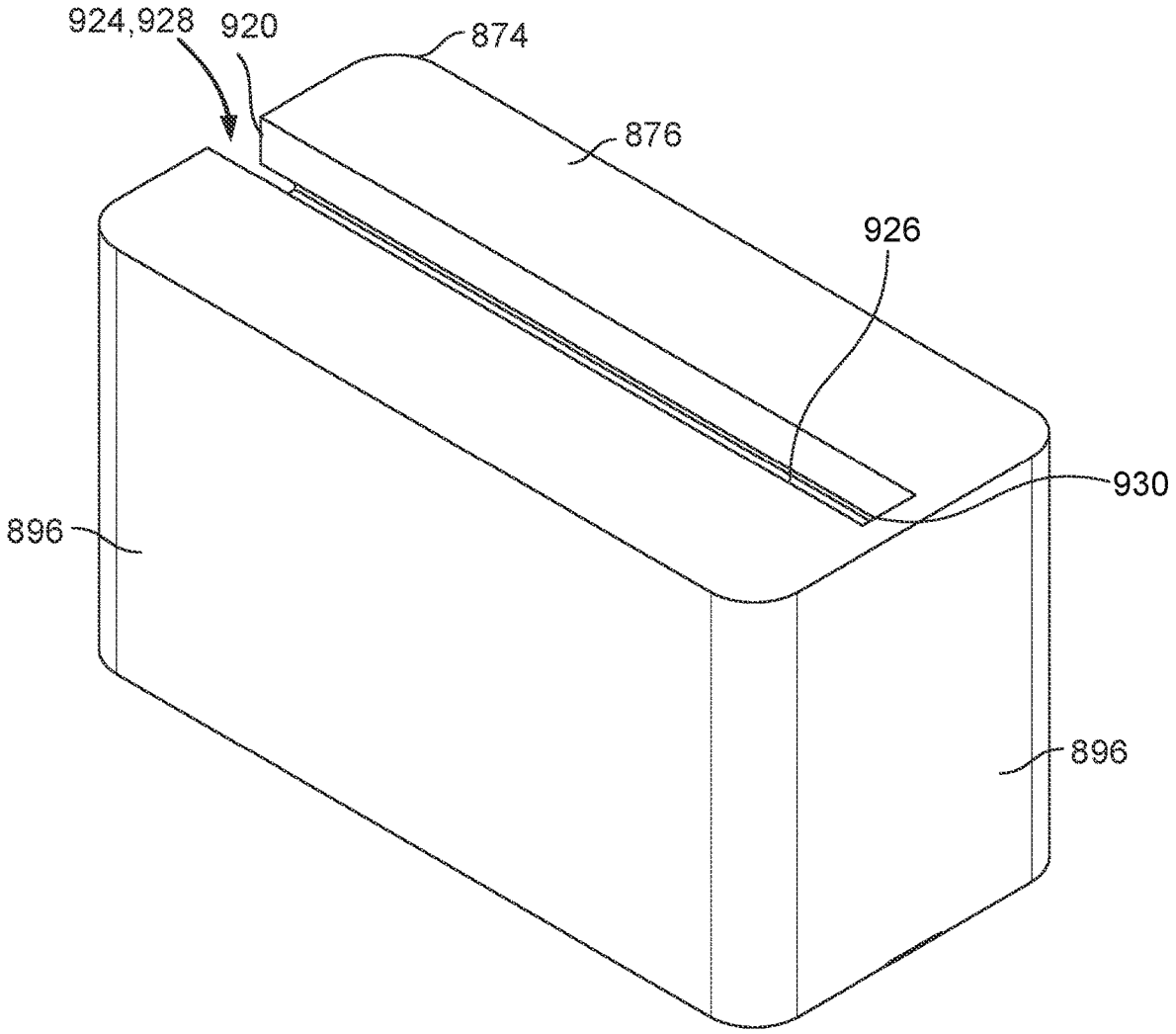
FIG. 45 presents an isometric view of a main sleeve of a press partner sleeve apparatus in accordance with an illustrative embodiment of the present invention.
Figure 46:
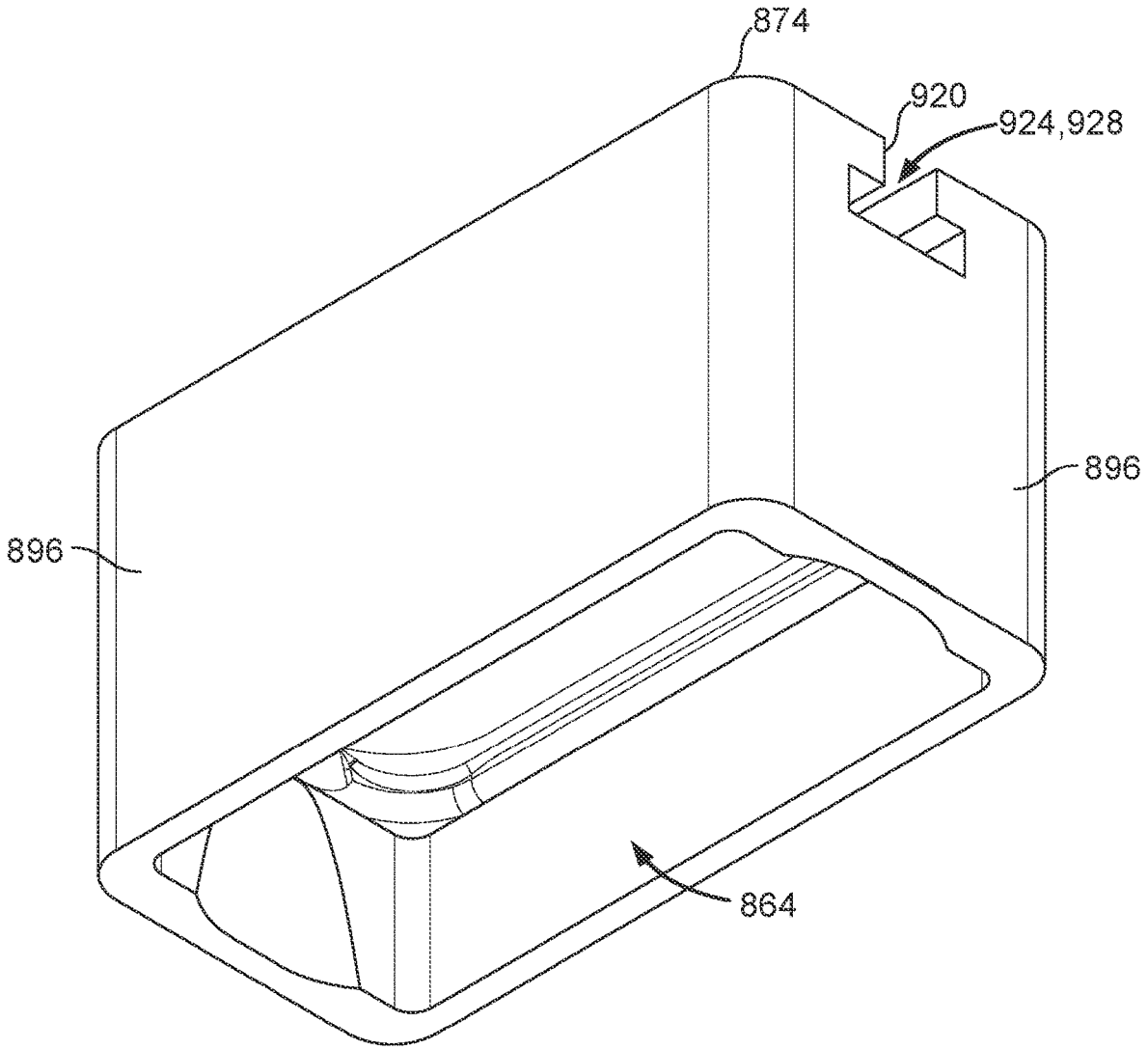
FIG. 46 presents an isometric view of a main sleeve of a press partner sleeve apparatus in accordance with an illustrative embodiment of the present invention.
Figure 47:
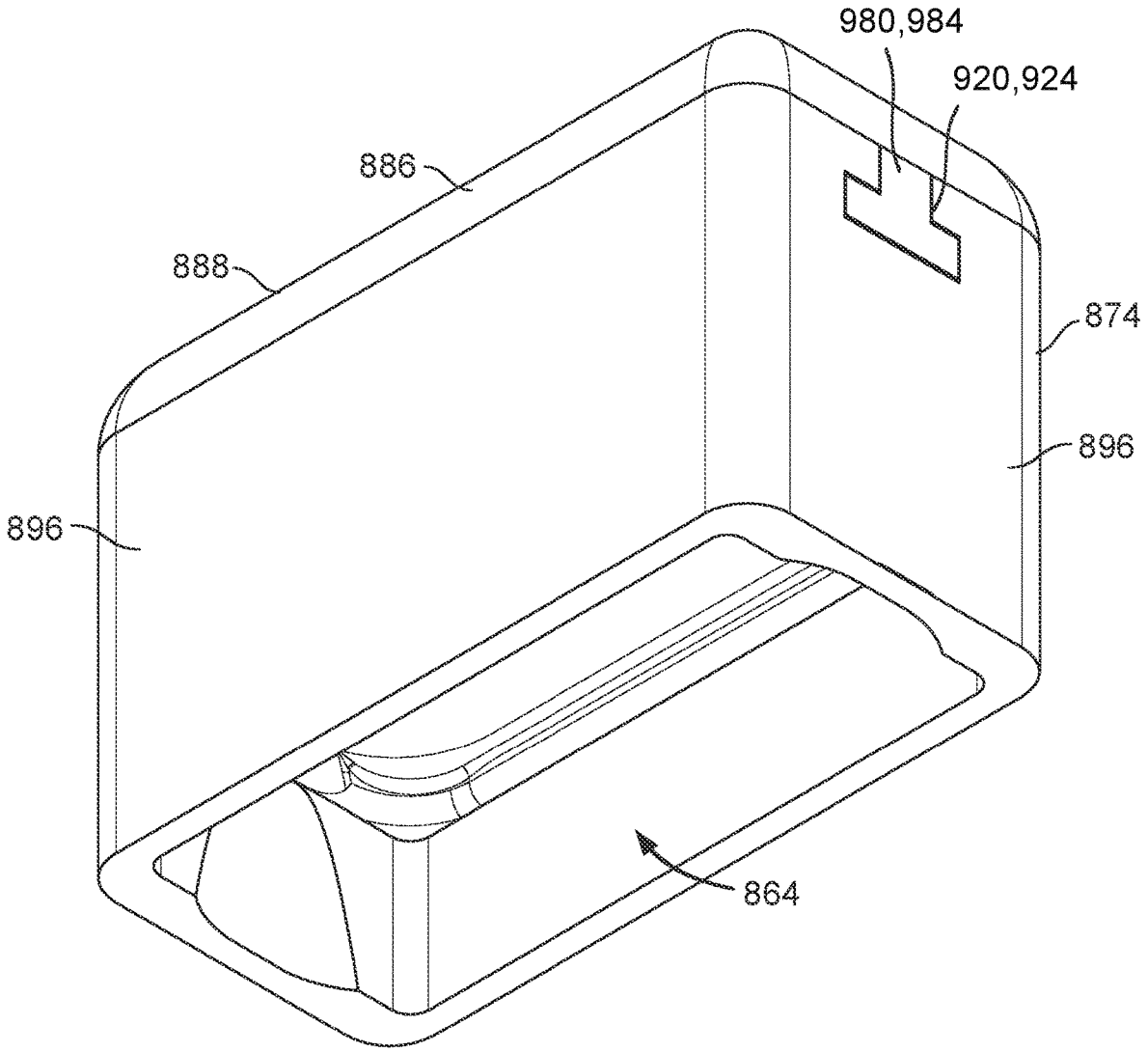
FIG. 47 presents an isometric view of a main sleeve and sleeve cap of a press partner sleeve apparatus in accordance with an illustrative embodiment of the present invention.
Figure 48:
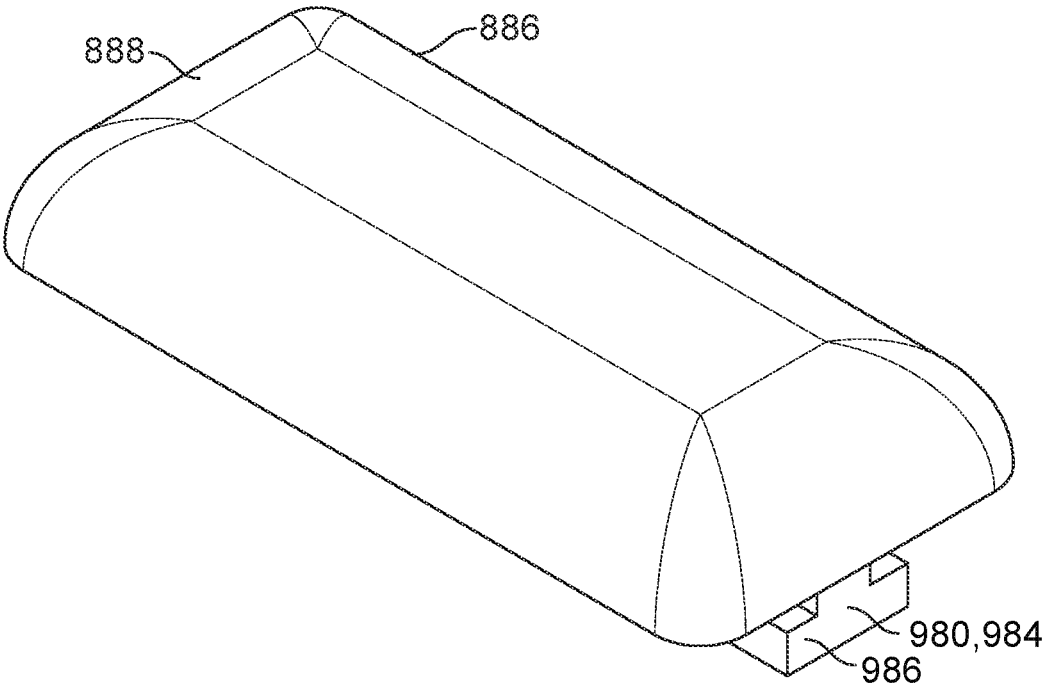
FIG. 48 presents an isometric view of a sleeve cap of a press partner sleeve apparatus in accordance with an illustrative embodiment of the present invention.

Referring to FIGS. 45-47, the press partner main sleeve 874 has a main sleeve top 876 (best seen at FIG. 45) and a main sleeve longitudinal length. Structurally, the press partner main sleeve 874 may be similar to a combination of the main sleeve 474 and the lower skirt 458 of the press partner sleeve apparatus 454 described hereinabove. As shown at FIGS. 46-47, 52 and 55, the press partner main sleeve 874 has an interior portion 864 configured to be releasably coupled to the exterior surface of the bumper 110 of the plate-loaded weight machine 104, such that the press partner main sleeve 874 fits over at least a portion of the bumper 110, as shown at FIG. 59. The interior portion 864 is constructed and arranged to provide a "one size fits all" sleeve which may fit on a bumper of any commercially available weight machine to modify and customize the range of motion of the weight machine.

Figure 54:
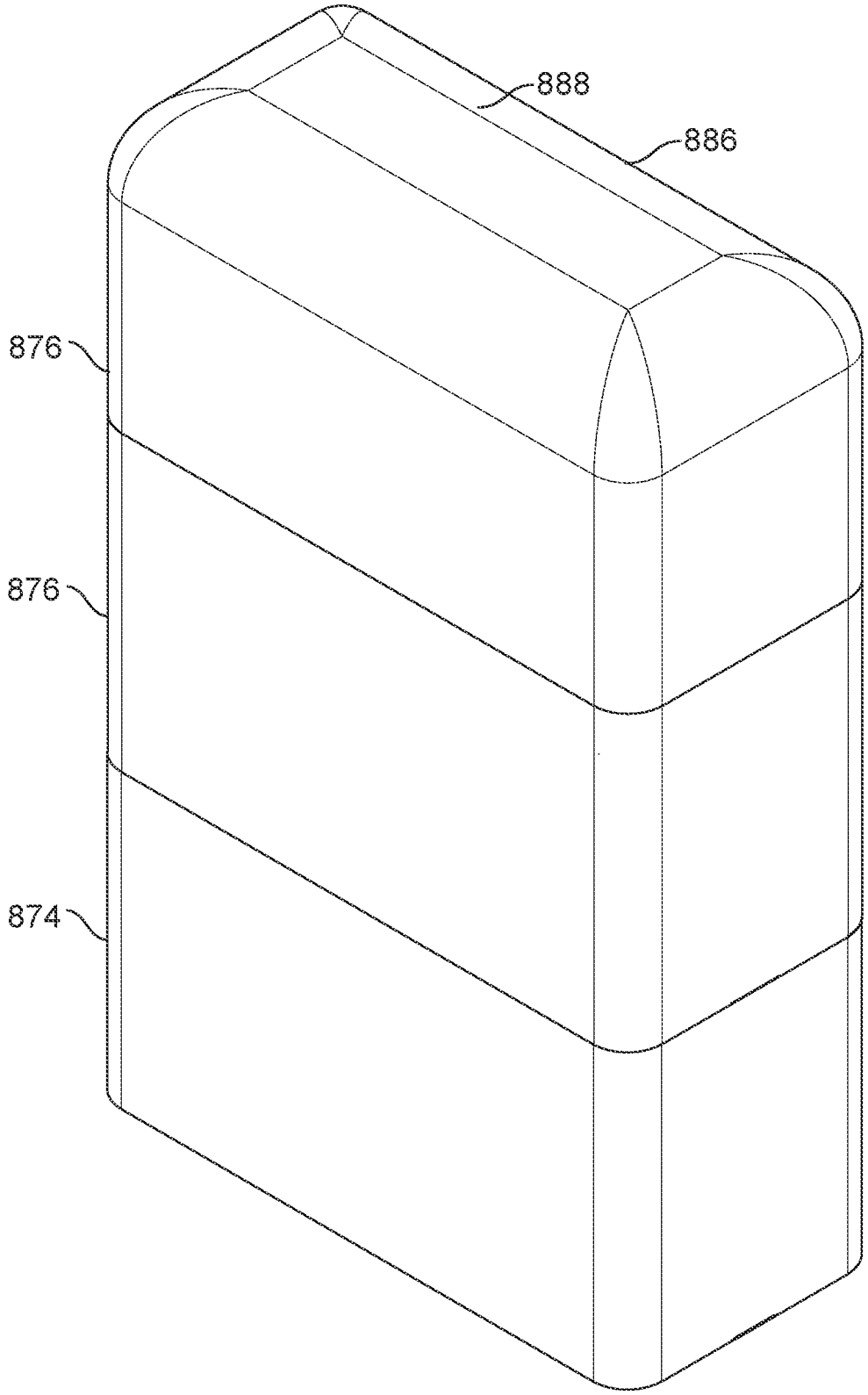
FIG. 54 presents an isometric view of a press partner sleeve apparatus in accordance with an illustrative embodiment of the present invention.
Figure 55:
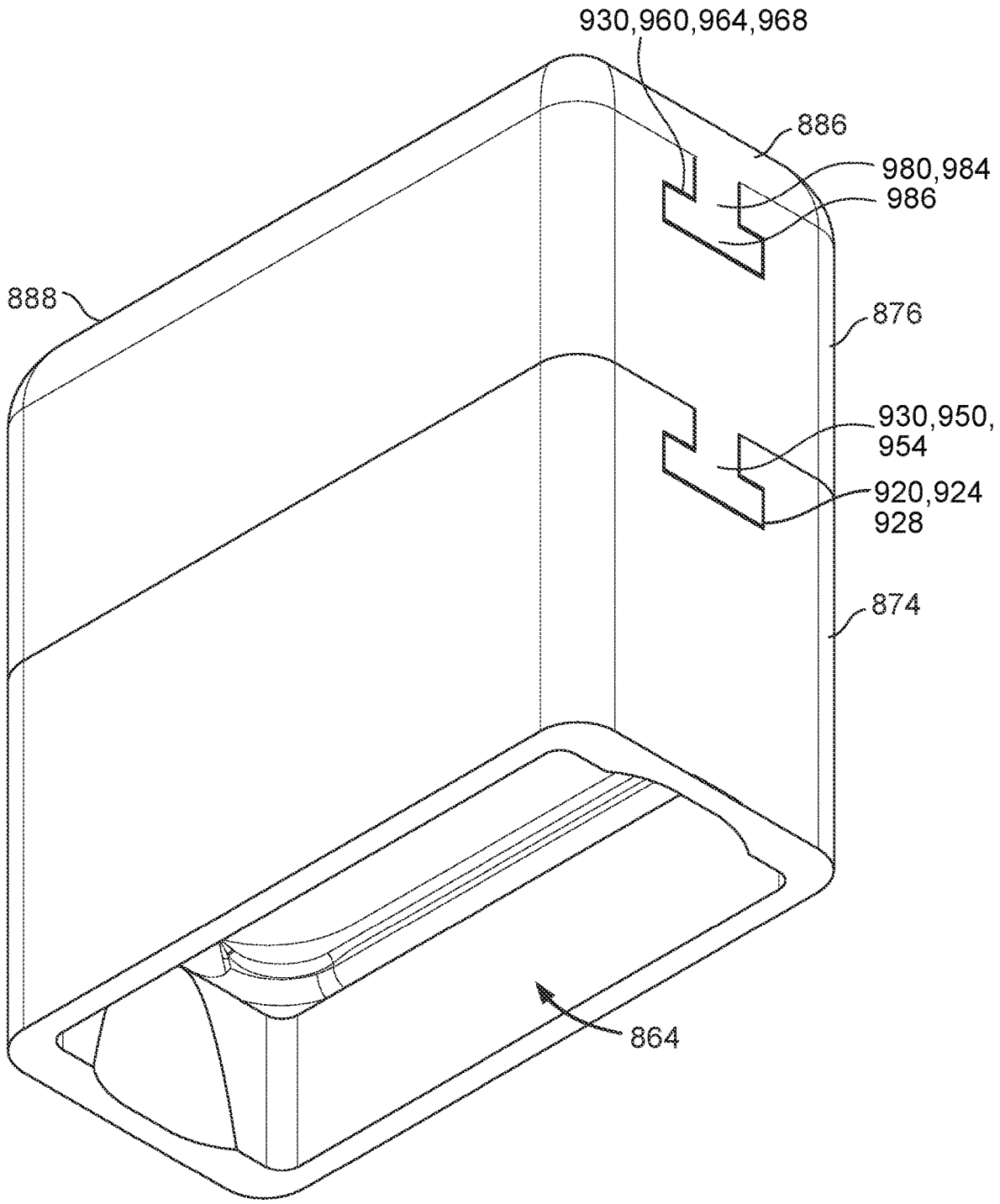
FIG. 55 presents an isometric view of a press partner sleeve apparatus in accordance with an illustrative embodiment of the present invention.
Figure 56:
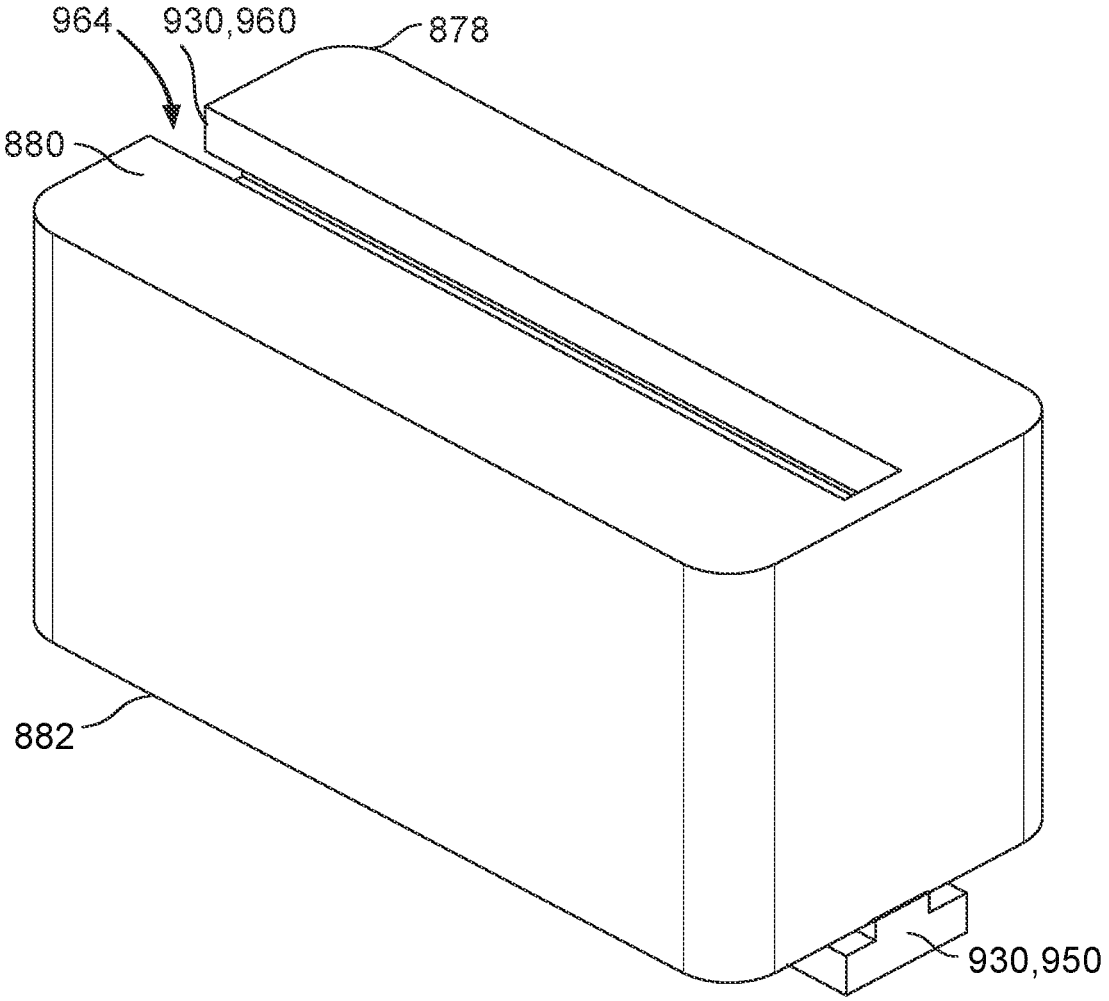
FIG. 56 presents an isometric view of a sleeve extension of a press partner sleeve apparatus in accordance with an illustrative embodiment of the present invention.
Figure 57:
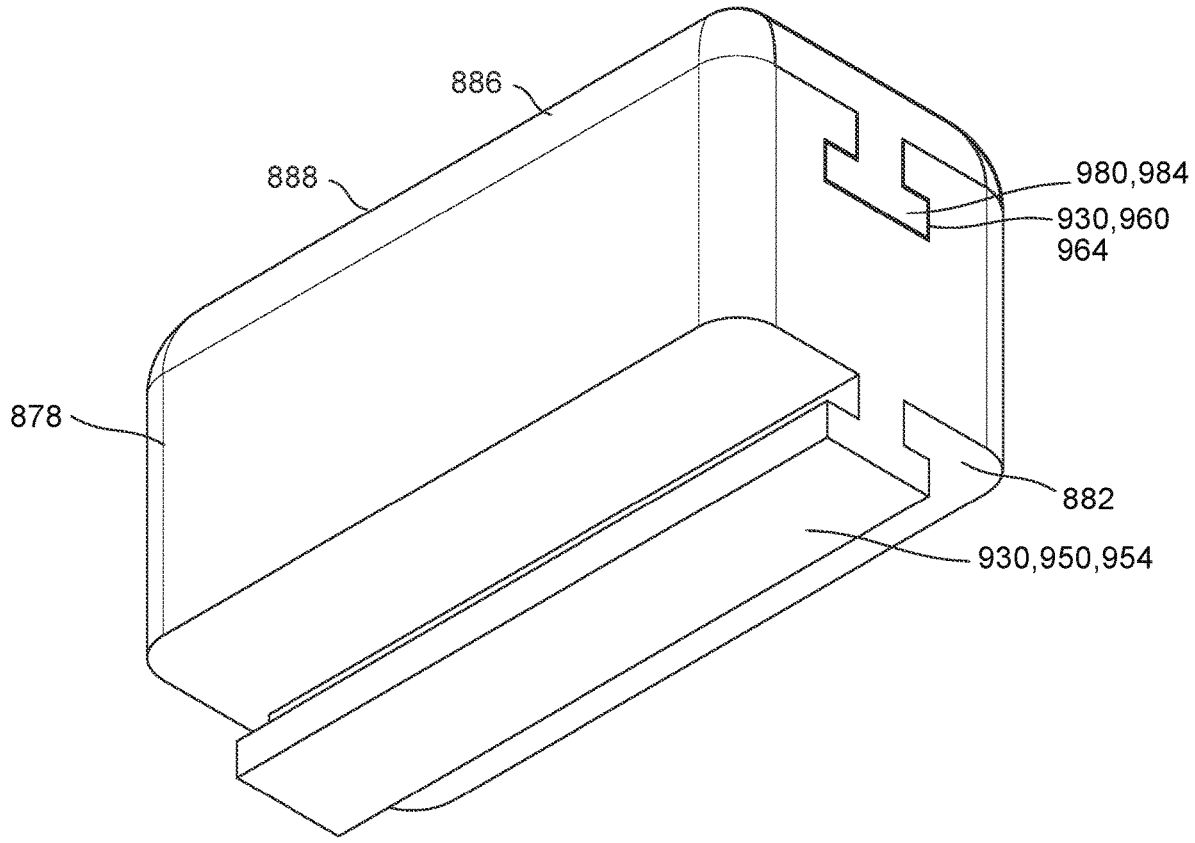
FIG. 57 presents an isometric view of a press partner sleeve extension and a press partner sleeve cap of a press partner sleeve apparatus in accordance with an illustrative embodiment of the present invention.
Figure 58:
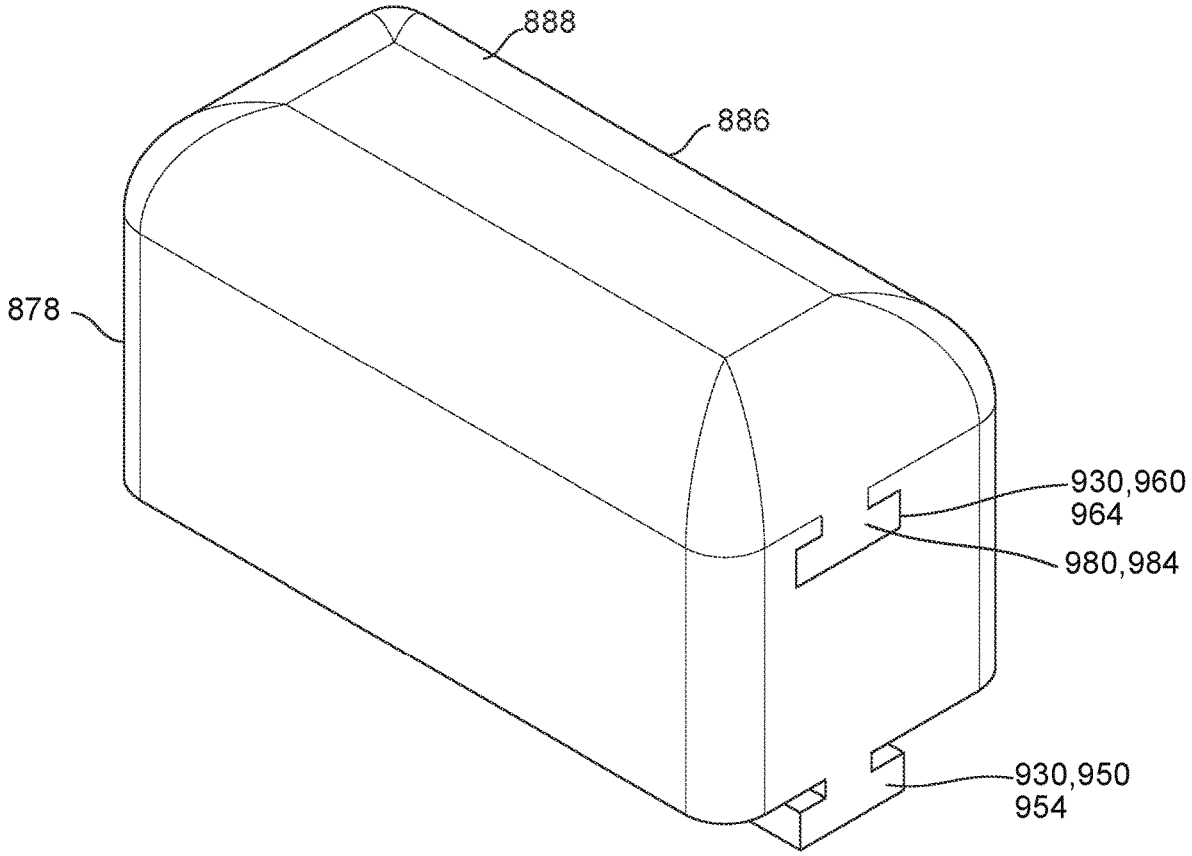
FIG. 58 presents an isometric view of a press partner sleeve extension and a press partner sleeve cap of a press partner sleeve apparatus in accordance with an illustrative embodiment of the present invention.

Referring to FIGS. 44, and 55-58, the at least one press partner sleeve extension 878 is shown. The at least one press partner sleeve extension 878 has a sleeve extension longitudinal length, a sleeve extension top 880 (best seen at FIG. 56), and a sleeve extension bottom 882 (best seen at FIG. 57). The at least one press partner sleeve extension 878 is configured to be releasably coupled to the press partner main sleeve 874 to provide an extended press partner sleeve having an extended press partner sleeve longitudinal length. As described hereinbelow, the at least one press partner sleeve extension may be configured to be releasably coupled to another press partner sleeve extension (as shown at FIG. 54).

The press partner sleeve cap 886 is shown at FIGS. 44, 47-55 and 57-58.

Figure 49:
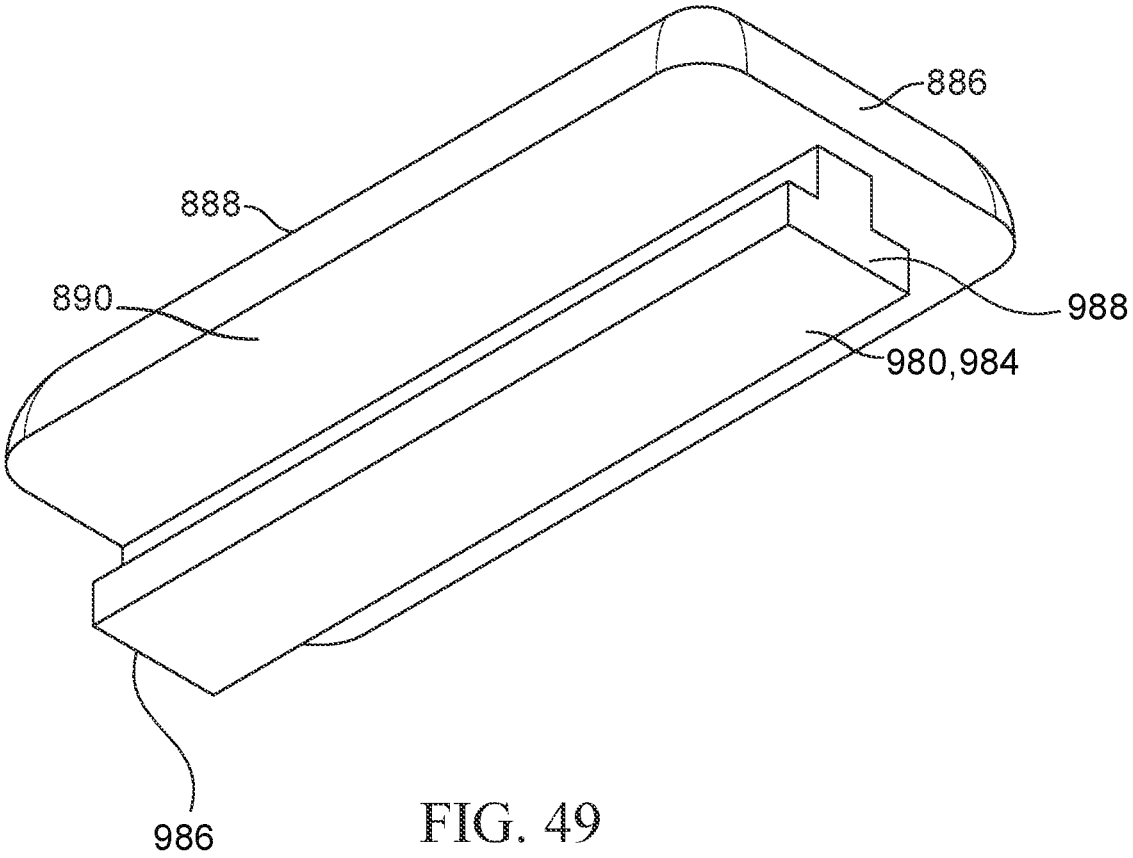
FIG. 49 presents an isometric view of a sleeve cap of a press partner sleeve apparatus in accordance with an illustrative embodiment of the present invention.
Figure 50:
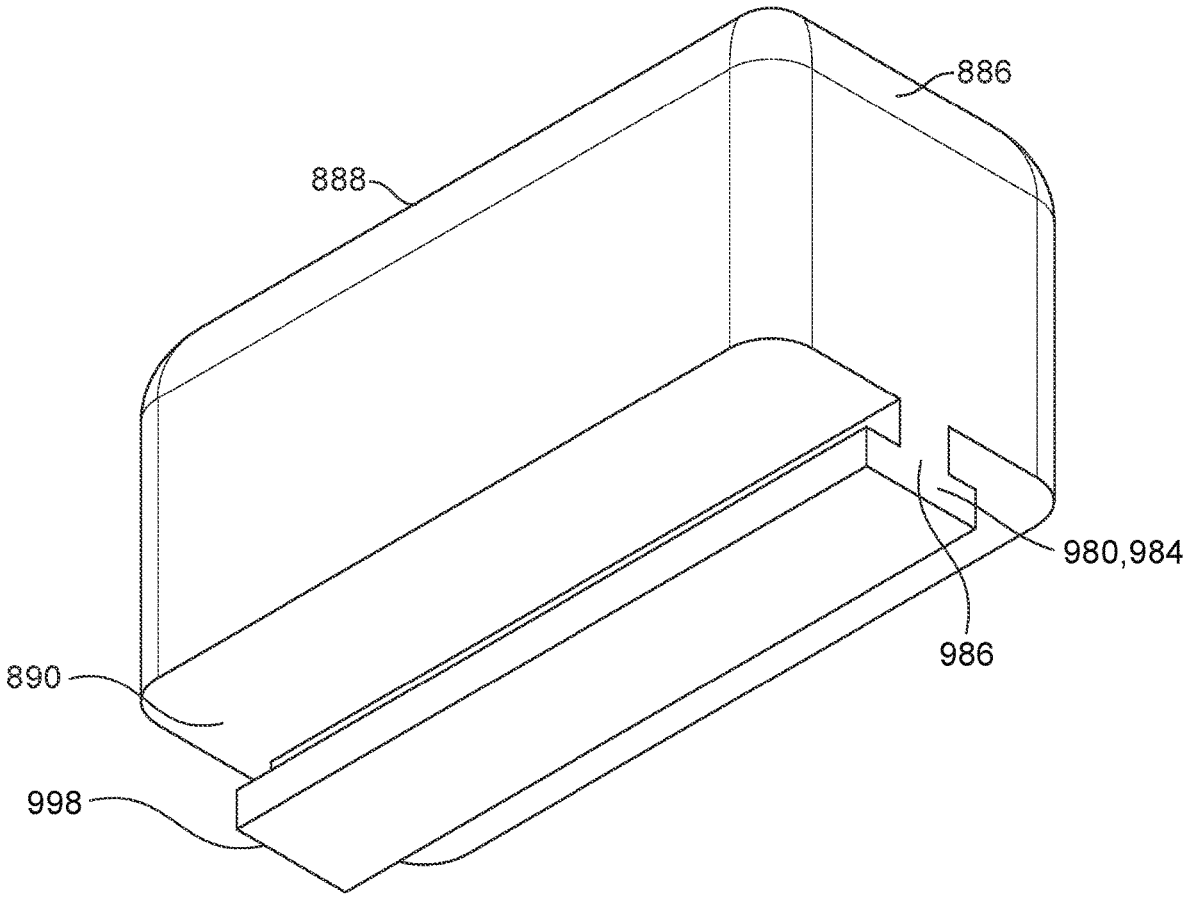
FIG. 50 presents an isometric view of an extension cap of a press partner sleeve apparatus in accordance with an illustrative embodiment of the present invention.
Figure 51:
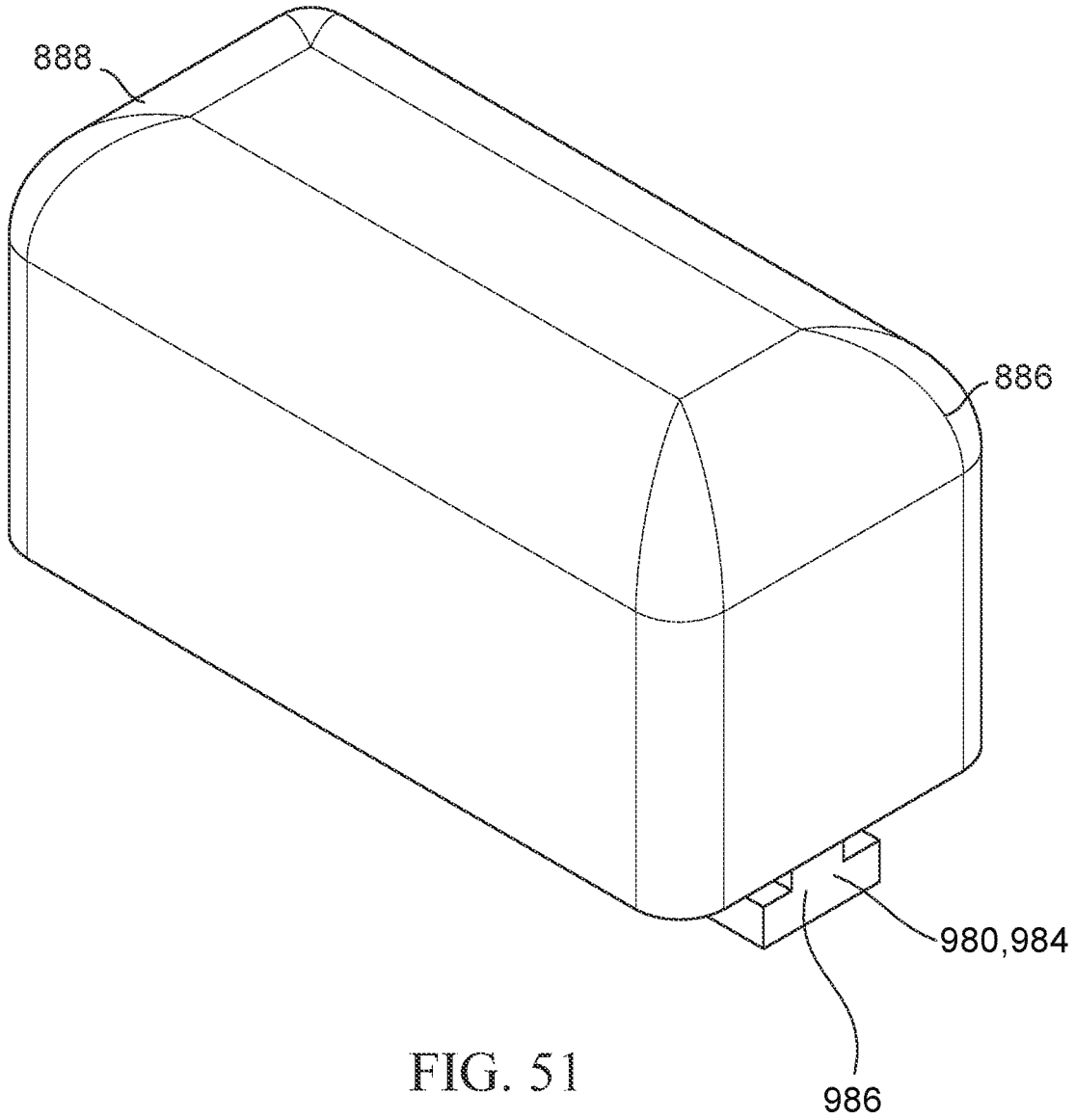
FIG. 51 presents an isometric view of an extension cap of a press partner sleeve apparatus in accordance with an illustrative embodiment of the present invention.
Figure 52:
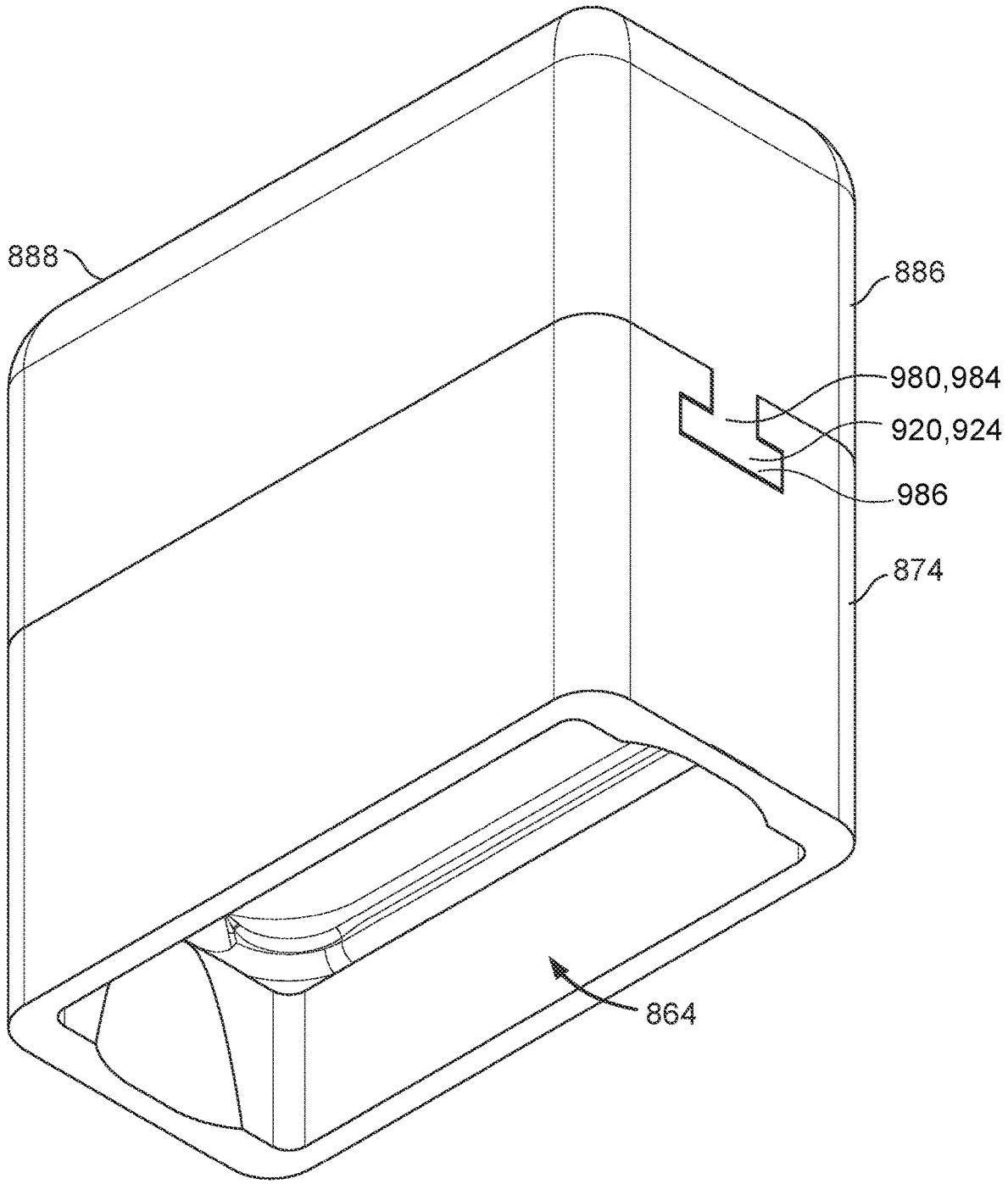
FIG. 52 presents an isometric view of a press partner sleeve apparatus in accordance with an illustrative embodiment of the present invention.
Figure 53:
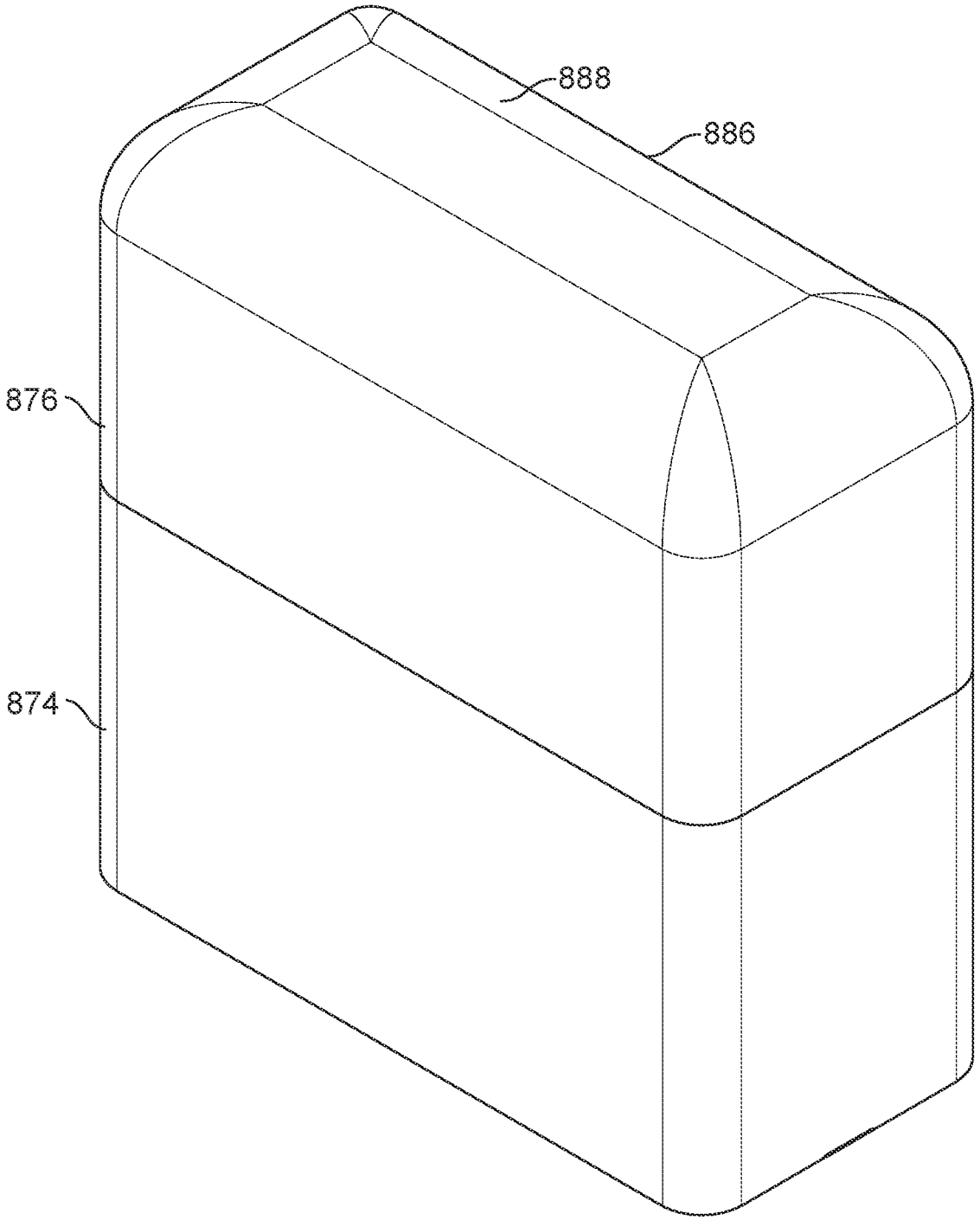
FIG. 53 presents an isometric view of a press partner sleeve apparatus in accordance with an illustrative embodiment of the present invention.

With particular reference to FIGS. 49 and 50, the press partner sleeve cap 886 comprises a cap exterior 888 and a cap underside 890. Also seen at FIGS. 49-50), the press partner sleeve cap 886 may be provided in embodiments having varying heights to enable a user to further customize the press partner sleeve apparatus 854. The cap 886 is configured to be releasably coupled to the main sleeve top 876 (as seen at FIGS. 47, 52 and 53), and is also configured to be releasably coupled to the sleeve extension top 880 of the at least one press partner sleeve extension 878 (as seen at FIGS. 54-55 and 57-59), so that the cap 886 may be placed on the press partner main sleeve 874 or the at least one press partner sleeve extension 878.

The components of the press partner sleeve apparatus 854 may be assembled in a multitude of configurations to enable the user to further customize the sleeve apparatus 854. The user may thereby determine and customize the range of motion of the exercise machine 104.

The coupling means may be any suitable coupling means such as, for example without limitation, pegs/peg-receiving holes, magnetic elements, or the like. The coupling means may include elements as described with reference to press partner sleeve apparatus 454 heretofore described with reference to FIGS. 28-33.

In some embodiments, the at least one press partner sleeve extension 878 may be installed on top of a press partner main sleeve 874 for extension of the length of the press partner sleeve apparatus 854. The press partner main sleeve 874 and the at least one press partner sleeve extension 878 may comprise an interlocking coupling assembly 910. The interlocking coupling assembly 910 may comprise a press partner main sleeve coupling portion 920 and at least one press partner sleeve extension coupling portion 930 constructed and arranged for removable and reversible coupling. The interlocking coupling assembly 910 may comprise a male coupling portion and a female coupling portion. The press partner main sleeve coupling portion 920 may be integrally molded with the press partner main sleeve 874, or may be machined or cut into the press partner main sleeve 874. The at least one press partner sleeve extension coupling portion 930 may be integrally molded with the at least one press partner sleeve extension 878, or may be machined or cut into the at least one press partner sleeve extension.

The press partner sleeve apparatus further comprises a press partner sleeve cover member or press partner sleeve cap 886 configured to be reversibly coupled with the press partner main sleeve coupling portion 920. The press partner sleeve cap 886 may comprise a sleeve cap coupling portion 970 configured for coupling with the press partner main sleeve coupling portion 920, or with the second upper coupling portion 960 of the sleeve extension 878. The press partner sleeve cap 886 may be removed from the press partner main sleeve coupling portion 920 to permit installation of at least one sleeve extension 878, and may then be installed over an uppermost sleeve extension.

To facilitate the installation and use of multiple press partner sleeve extensions 878, the at least one press partner sleeve extension coupling portion 930 may comprise a first lower sleeve extension coupling portion 950 and a second upper sleeve extension coupling portion 960. As shown at FIG. 52, a plurality of sleeve extensions may be provided. For example, a first sleeve extension 878A and a second sleeve extension 878B may be provided. The first sleeve extension 878A may be reversibly coupled with the press partner main sleeve coupling portion 920 by coupling the first lower coupling portion 950 of the first sleeve extension 878A with the press partner main sleeve coupling portion 920. The at least one sleeve extension may comprise a plurality of sleeve extensions. The second sleeve extension 878B may be reversibly coupled with the first sleeve extension 878A to further extend the press partner sleeve apparatus 854, by reversibly coupling the first lower coupling portion 950B of the second sleeve extension 878B with the second upper coupling portion 960A of the first sleeve extension 878A. Multiple sleeve extensions may be "stacked" for further extension of the press partner sleeve apparatus length.

The portions of the interlocking coupling assembly 910 may be any shape or configuration capable of interlocking. In some embodiments, the interlocking coupling assembly 910 comprises portions having an inverted T-shaped cross-section.

The press partner main sleeve coupling portion 920 may comprise a channel 924 having an inverted T-shaped cross-section. The channel 924 has a channel upper opening 926, a channel first open end 928 provided in a main sleeve side 896, and a channel second closed end 930.

Each sleeve extension 878 may comprise a first lower sleeve extension coupling portion 950 and a second upper sleeve extension 960. The first lower sleeve extension coupling portion 950 may comprise a downwardly extending inverted T-shaped cross-section first lower sleeve coupling portion 954 which has a sleeve extension coupling portion first end 956 that is coplanar with a sleeve coupling portion side, and a sleeve extension coupling portion second recessed end 958. The second upper sleeve extension coupling portion 960 may comprise a channel 964 having an inverted T-shaped cross-section, and having a channel upper opening 966, a channel first open end 968 provided in a main sleeve side 896, and a channel second closed end 970.

The sleeve cap coupling portion 980 of the sleeve cover member or cap 886 may comprise a downwardly extending coupling portion 984 which has an inverted T-shaped cross-section which has a sleeve cap coupling portion first end 986 that is coplanar with a sleeve cover member side, and a sleeve cap coupling portion second recessed end 988. The press partner main sleeve coupling portion channel 924 is configured to receive the downwardly extending first lower sleeve coupling portion 954 of a sleeve extension 878; or the sleeve cap coupling portion 984 of a press partner sleeve cap 886. The second upper sleeve extension coupling portion channel 964 of a sleeve extension 878 is configured to receive a downwardly extending first lower sleeve extension coupling portion 954 of another sleeve extension 878; or the sleeve cap coupling portion 984 of the sleeve cap 886. Multiple sleeve extensions may be "stacked" for further extension of the press partner sleeve apparatus length. The press partner sleeve cap coupling portion 970 may be removed from a press partner main sleeve coupling portion 920 to permit installation of at least one sleeve extension 878, and may then be installed over an uppermost block extension. In summary, the present invention provides a press partner system for facilitating the use of a weight press machine, and methods for its use. The press partner system comprises a press partner clamp apparatus and at least one press partner sleeve device or apparatus, configured for installation on a plate-loaded weight machine having a machine arm, to modify a range of motion of the plate machine arm.

The press partner clamp apparatus is configured for removable installation on an arm side contact rod of the plate-loaded weight machine. The press partner clamp apparatus comprises press partner clamp apparatus elements with coupling means for releasably interconnecting the press partner clamp apparatus elements.

The press partner clamp apparatus further comprises:

a press partner clamp body having a clamp body top, a clamp body bottom, and clamp body sides;

a C-shaped clamp lower portion configured for removable attachment to the arm side contact rod of the plate-loaded weight machine;

a clamp upper block portion extending upwardly from the C-shaped clamp lower portion, the clamp upper block portion having a longitudinal direction and an upper block longitudinal length; and at least one clamp block extension.

The at least one clamp block extension has a block extension longitudinal length, the at least one clamp block extension being configured to be releasably coupled to the clamp upper block portion of the press partner clamp apparatus to provide an extended upper block portion. The at least one clamp block extension has a block extension outer portion having a longitudinal direction and a block extension interior portion having a longitudinal direction. The clamp block extension comprises a block extension coupling means for releasably interconnecting the clamp block extension to the clamp upper block portion at the clamp body top to provide a composite press partner clamp body and clamp block extension having a composite extended longitudinal length to increase the length of the press partner clamp apparatus.

The press partner sleeve apparatus is configured for installation on an exterior surface of a bumper of a plate-loaded weight machine. The press partner sleeve apparatus comprises press partner sleeve apparatus elements with coupling means for releasably interconnecting the press partner sleeve apparatus elements.

The system may include a unitary press partner sleeve device comprising a press partner device upper portion, and a press partner device lower skirt portion which has a skirt interior configured to be releasably secured to the coupled to the exterior surface of the bumper of the plate-loaded weight machine, such that the lower skirt portion fits over at least a portion of the bumper, and the skirt upper portion extends beyond the bumper.

The system may include a press partner sleeve apparatus comprising:

a press partner lower skirt having a skirt outer portion, a skirt interior portion, a skirt upper portion, a skirt lower portion, and a skirt top surface, the skirt interior portion being configured to be releasably coupled to the exterior surface of the bumper of the plate-loaded weight machine, such that the skirt lower portion fits over at least a portion of the bumper and the skirt upper portion extends beyond the bumper;

a press partner main sleeve having a main sleeve longitudinal length, a main sleeve top, and a main sleeve bottom, the press partner main sleeve portion being configured to be releasably coupled to the press partner lower skirt portion;

at least one press partner sleeve extension having a sleeve extension longitudinal length, a sleeve extension top, a sleeve extension bottom, the at least one press partner sleeve extension being configured to be releasably coupled to the press partner main sleeve to provide an extended press partner sleeve having an extended press partner sleeve longitudinal length; and a press partner sleeve cap being configured to be releasably coupled to the main sleeve top, and further being configured to be releasably coupled to the sleeve extension top of the at least one press partner sleeve extension, so that the cap may be placed on the press partner main sleeve or the at least one press partner sleeve extension.

The system may include a press partner sleeve apparatus comprising:

a press partner main sleeve having a main sleeve longitudinal length, a main sleeve top, and a main sleeve bottom, the press partner main sleeve further comprising an interior portion configured to be releasably coupled to an exterior surface of a bumper of a plate-loaded weight machine, such that the press partner main sleeve fits over at least a portion of the bumper;

at least one press partner sleeve extension having a sleeve extension longitudinal length, a sleeve extension top, a sleeve extension bottom, the at least one press partner sleeve extension being configured to be releasably coupled to the press partner main sleeve to provide an extended press partner sleeve having an extended press partner sleeve longitudinal length; and a press partner sleeve cap being configured to be releasably coupled to the main sleeve top, and further being configured to be releasably coupled to the sleeve extension top of the at least one press partner sleeve extension, so that the cap may be placed on the press partner main sleeve or the at least one press partner sleeve extension.

A press partner system configured for installation on a plate-loaded weight machine having a machine arm, the press partner system comprising:

at least one press partner clamp apparatus; and at least one press partner sleeve apparatus;

wherein the at least one press partner clamp apparatus and the at least one press partner sleeve apparatus may be installed on the plate-loaded weight machine to modify a range of motion of the plate machine arm.

In some embodiments, the at least one press partner clamp apparatus may be configured for removable installation on at least one arm side contact rod of the plate-loaded weight machine, and comprises a plurality of press partner clamp apparatus elements with coupling means for releasably interconnecting the plurality of press partner clamp apparatus elements.

In some embodiments, the at least one press partner clamp apparatus further comprises:

a press partner clamp body having a clamp body top, a clamp body bottom, and clamp body sides;

a C-shaped clamp lower portion configured for removable attachment to the at least one arm side contact rod of the plate-loaded weight machine;

a clamp upper block portion extending upwardly from the C-shaped clamp lower portion, the clamp upper block portion having a longitudinal direction and an upper block longitudinal length; and at least one clamp block extension having a block extension longitudinal length, the at least one clamp block extension being configured to be releasably coupled to the clamp upper block portion of the press partner clamp apparatus to provide an extended upper block portion, the at least one clamp block extension having a block extension outer portion having a longitudinal direction and a block extension interior portion having a longitudinal direction, the at least one clamp block extension comprising a block extension coupling means for releasably interconnecting the at least one clamp block extension to the clamp upper block portion at the clamp body top to provide a composite press partner clamp body and clamp block extension having a composite extended longitudinal length to increase the length of the press partner clamp apparatus;

whereby a user of the plate-loaded weight machine may install the at least one press partner clamp apparatus to the at least one arm side contact rod of the plate-loaded weight machine to customize the range of motion of the plate-loaded weight machine.

In some embodiments, the plate-loaded weight machine has two arms, the at least one arm side contact rod comprises two arm side contact rods, and the at least one press partner clamp apparatus comprises two press partner clamp apparatuses, whereby the user may install the two press partner clamp apparatuses on the two arm side contact rod of the two arms of the plate-loaded weight machine to customize the range of motion of the plate-loaded weight machine.

In some embodiments, the C-shaped clamp lower portion and the clamp upper block portion are of unitary construction.

In some embodiments, the clamp body comprises a single solid structure manufactured out of plastic, rubber, or foam.

In some embodiments, the clamp body is manufactured using 3D printing or injection molding.

In some embodiments, the block extension coupling means is selected from a force-fit, a magnetic attachment, an integrated snapping attachment, an interlocking coupling assembly, and combinations thereof.

In some embodiments, the at least one clamp block extension comprises a plurality of clamp block extensions configured for attachment to another clamp block extension of said plurality of clamp block extensions.

In some embodiments, the block extension coupling means comprises an interlocking coupling assembly comprising a clamp coupling portion and a block extension coupling portion configured for removable and reversible coupling.

In some embodiments, the clamp coupling portion and the block extension coupling portion each have an inverted T-shaped cross-section.

In some embodiments of the press partner system:

the clamp coupling portion comprises a channel having an inverted T-shaped cross-section; and the block extension coupling portion extends downwardly from the block extension and has an inverted T-shaped cross section;

wherein the channel of the clamp coupling portion is configured to receive the downwardly extending block coupling portion.

In some embodiments, the C-shaped clamp lower portion of the at least one clamp apparatus is configured to be removably attached to the weight machine, to the at least one arm side contact rod of the plate-loading weight machine.

In some embodiments, the C-shaped clamp lower portion of the at least one clamp apparatus is configured to snap onto the at least one arm side contact rod.

In some embodiments, the at least one press partner sleeve apparatus is configured for installation on an exterior surface of a bumper of the plate-loaded weight machine, and comprises:

a main sleeve having a main sleeve interior portion; and a coupling means for releasably interconnecting the press partner sleeve apparatus to the bumper;

wherein the coupling means for releasably interconnecting the press partner sleeve apparatus to the bumper comprises the main sleeve interior portion; and wherein the main sleeve interior portion is configured to be releasably coupled to the exterior surface of the bumper of the plate-loaded weight machine, such that the main sleeve fits over at least a portion of the bumper and the press partner sleeve apparatus extends beyond the bumper;

whereby a user of the plate-loaded weight machine may install the press partner sleeve apparatus on the bumper of the plate-loaded weight machine to customize the range of motion of the plate-loaded weight machine.

In some embodiments, the at least one press partner sleeve apparatus further comprises a press partner sleeve cap.

In some embodiments, the press partner sleeve cap is integral with the press partner main sleeve.

In some embodiments, the press partner sleeve cap is configured for removable securement to the to the press partner main sleeve.

In some embodiments, the at least one press partner sleeve apparatus further comprises at least one press partner sleeve apparatus extension configured for removable securement to the press partner main sleeve to further extend the press partner sleeve apparatus and further customize the range of motion of the plate-loaded weight machine.

In some embodiments, the press partner sleeve cap and the press partner sleeve apparatus extension are removably securable to the press partner main sleeve by an interlocking coupling assembly.

In some embodiments, the interlocking coupling assembly comprises a press partner main sleeve coupling portion and a press partner sleeve cap coupling portion configured to removably secure the press partner main sleeve to the press partner sleeve cap.

In some embodiments of the press partner system:

the press partner main sleeve coupling portion comprises a channel having an inverted T-shaped cross-section;

the press partner sleeve cap coupling portion extends downwardly from the press partner sleeve cap and has an inverted T-shaped cross section; and the channel of the press partner main sleeve coupling portion is configured to receive the downwardly extending press partner sleeve cap coupling portion.

In some embodiments, the at least one press partner sleeve apparatus extension comprises:

a first lower press partner sleeve extension coupling portion which extends downwardly from the press partner sleeve apparatus extension and has an inverted T-shaped cross section, and a second upper press partner sleeve extension coupling portion comprising a channel having an inverted T-shaped cross-section;

wherein the channel of the press partner main sleeve coupling portion is configured to receive the downwardly extending first lower press partner sleeve extension coupling portion; and wherein the second upper press partner sleeve extension coupling portion is configured to receive the downwardly extending press partner sleeve cap coupling portion;

whereby the press partner sleeve apparatus extension may be coupled with the press partner main sleeve and the press partner sleeve cap may be coupled with the press partner sleeve extension, to extend the press partner sleeve apparatus and further customize the range of motion of the plate-loaded weight machine.

In some embodiments, the at least one press partner sleeve apparatus extension comprises a plurality of press partner sleeve apparatus extensions.

In some embodiments of the press partner system:

the plurality of press partner sleeve apparatus extensions comprises a first press partner sleeve apparatus extension and a second press partner sleeve apparatus extension;

the first lower press partner sleeve extension coupling portion of the first press partner sleeve apparatus extension is configured to be coupled with the press partner main sleeve coupling portion;

the second upper press partner sleeve extension coupling portion of the first press partner sleeve apparatus extension is configured to be coupled with the first lower press partner sleeve apparatus extension of the second press partner sleeve apparatus extension; and the press partner sleeve cap is configured to be coupled with the second upper press partner sleeve extension coupling portion of the second press partner sleeve apparatus extension; whereby the press partner main sleeve, the first press partner sleeve apparatus extension, the second press partner sleeve apparatus extension and the press partner sleeve cap may be releasably connected to further extend the press partner sleeve apparatus and further customize the range of motion of the plate-loaded weight machine.

A user of the plate-loaded weight machine may install the press partner clamp apparatus or the press partner sleeve apparatus to customize the range of motion of the plate-loaded weight machine.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A press partner system configured for installation on a plate-loaded weight machine having a machine arm, the press partner system comprising:

at least one press partner clamp apparatus;

at least one press partner sleeve apparatus;

wherein the at least one press partner clamp apparatus and the at least one press partner sleeve apparatus configured to be installed on the plate-loaded weight machine to modify a range of motion of the plate machine arm; and wherein the at least one press partner clamp apparatus is configured for removable installation on at least one arm side contact rod of the plate-loaded weight machine, and comprises a plurality of press partner clamp apparatus elements with coupling means for releasably interconnecting the plurality of press partner clamp apparatus elements.

2. The press partner system of claim 1 wherein the at least one press partner clamp apparatus further comprises:

a press partner clamp body having a clamp body top, a clamp body bottom, and clamp body sides;

a C-shaped clamp lower portion configured for removable attachment to the at least one arm side contact rod of the plate-loaded weight machine;

a clamp upper block portion extending upwardly from the C-shaped clamp lower portion, the clamp upper block portion having a longitudinal direction and an upper block longitudinal length; and at least one clamp block extension having a block extension longitudinal length, the at least one clamp block extension being configured to be releasably coupled to the clamp upper block portion of the press partner clamp apparatus to provide an extended upper block portion, the at least one clamp block extension having a block extension outer portion having a longitudinal direction and a block extension interior portion having a longitudinal direction, the at least one clamp block extension comprising a block extension coupling means for releasably interconnecting the at least one clamp block extension to the clamp upper block portion at the clamp body top to provide a composite press partner clamp body and clamp block extension having a composite extended longitudinal length to increase the length of the press partner clamp apparatus;

whereby a user of the plate-loaded weight machine may install the at least one press partner clamp apparatus to the at least one arm side contact rod of the plate-loaded weight machine to customize the range of motion of the plate-loaded weight machine.

3. The press partner system of claim 2 wherein the plate-loaded weight machine has two arms, the at least one arm side contact rod comprises two arm side contact rods, and the at least one press partner clamp apparatus comprises two press partner clamp apparatuses, whereby the user may install the two press partner clamp apparatuses on the two arm side contact rod of the two arms of the plate-loaded weight machine to customize the range of motion of the plate-loaded weight machine.

4. The press partner system of claim 2 wherein the C-shaped clamp lower portion and the clamp upper block portion are of unitary construction.

5. The press partner system of claim 2 wherein the clamp body comprises a single solid structure manufactured out of plastic, rubber, or foam.

6. The press partner system of claim 2 wherein the clamp body is manufactured using 3D printing or injection molding.

7. The press partner system of claim 2 wherein the block extension coupling means is selected from a force-fit, a magnetic attachment, an integrated snapping attachment, an interlocking coupling assembly, and combinations thereof.

8. The press partner system of claim 7 wherein the at least one clamp block extension comprises a plurality of clamp block extensions configured for attachment to another clamp block extension of said plurality of clamp block extensions.

9. The press partner system of claim 2 wherein the block extension coupling means comprises an interlocking coupling assembly comprising a clamp coupling portion and a block extension coupling portion configured for removable and reversible coupling.

10. The press partner system of claim 9 wherein the clamp coupling portion and the block extension coupling portion each have an inverted T-shaped cross-section.

11. The press partner system of claim 10 wherein:

the clamp coupling portion comprises a channel having an inverted T-shaped cross-section; and the block extension coupling portion extends downwardly from the block extension and has an inverted T-shaped cross section;

wherein the channel of the clamp coupling portion is configured to receive the downwardly extending block coupling portion.

12. The press partner system of claim 2 wherein the C-shaped clamp lower portion of the at least one clamp apparatus is configured to be removably attached to the weight machine, to the at least one arm side contact rod of the plate-loading weight machine.

13. The press partner system of claim 12 wherein the C-shaped clamp lower portion of the at least one clamp apparatus is configured to snap onto the at least one arm side contact rod.

14. A press partner system configured for installation on a plate-loaded weight machine having a machine arm, the press partner system comprising:

at least one press partner clamp apparatus;

at least one press partner sleeve apparatus;

wherein the at least one press partner clamp apparatus and the at least one press partner sleeve apparatus configured to be installed on the plate-loaded weight machine to modify a range of motion of the plate machine arm; and wherein the at least one press partner sleeve apparatus is configured for installation on an exterior surface of a bumper of the plate-loaded weight machine, and comprises:

a main sleeve having a main sleeve interior portion; and a coupling means for releasably interconnecting the press partner sleeve apparatus to the bumper; wherein the coupling means for releasably interconnecting the press partner sleeve apparatus to the bumper comprises the main sleeve interior portion;

wherein the main sleeve interior portion is configured to be releasably coupled to the exterior surface of the bumper of the plate-loaded weight machine, such that the main sleeve fits over at least a portion of the bumper and the press partner sleeve apparatus extends beyond the bumper; and whereby a user of the plate-loaded weight machine may install the press partner sleeve apparatus on the bumper of the plate-loaded weight machine to customize the range of motion of the plate-loaded weight machine.

15. The press partner system of claim 14 wherein the at least one press partner sleeve apparatus further comprises a press partner sleeve cap.

16. The press partner system of claim 15 wherein the press partner sleeve cap is integral with the press partner main sleeve.

17. The press partner system of claim 15 wherein the press partner sleeve cap is configured for removable securement to the to the press partner main sleeve.

18. The press partner system of claim 17 wherein the at least one press partner sleeve apparatus further comprises at least one press partner sleeve apparatus extension configured for removable securement to the press partner main sleeve to further extend the press partner sleeve apparatus and further customize the range of motion of the plate-loaded weight machine.

19. The press partner system of claim 18 wherein the press partner sleeve cap and the press partner sleeve apparatus extension are removably securable to the press partner main sleeve by an interlocking coupling assembly.

20. The press partner system of claim 19 wherein the interlocking coupling assembly comprises a press partner main sleeve coupling portion and a press partner sleeve cap coupling portion configured to removably secure the press partner main sleeve to the press partner sleeve cap.

21. The press partner system of claim 20 wherein:

the press partner main sleeve coupling portion comprises a channel having an inverted T-shaped cross-section;

the press partner sleeve cap coupling portion extends downwardly from the press partner sleeve cap and has an inverted T-shaped cross section; and the channel of the press partner main sleeve coupling portion is configured to receive the downwardly extending press partner sleeve cap coupling portion.

22. The press partner system of claim 21 wherein the at least one press partner sleeve apparatus extension comprises:

a first lower press partner sleeve extension coupling portion which extends downwardly from the press partner sleeve apparatus extension and has an inverted T-shaped cross section; and a second upper press partner sleeve extension coupling portion comprising a channel having an inverted T-shaped cross-section;

wherein the channel of the press partner main sleeve coupling portion is configured to receive the downwardly extending first lower press partner sleeve extension coupling portion; and wherein the second upper press partner sleeve extension coupling portion is configured to receive the downwardly extending press partner sleeve cap coupling portion;

whereby the press partner sleeve apparatus extension may be coupled with the press partner main sleeve and the press partner sleeve cap may be coupled with the press partner sleeve extension, to extend the press partner sleeve apparatus and further customize the range of motion of the plate-loaded weight machine.

23. The press partner system of claim 22 wherein the at least one press partner sleeve apparatus extension comprises a plurality of press partner sleeve apparatus extensions.

24. The press partner system of claim 23 wherein:

the plurality of press partner sleeve apparatus extensions comprises a first press partner sleeve apparatus extension and a second press partner sleeve apparatus extension;

the first lower press partner sleeve extension coupling portion of the first press partner sleeve apparatus extension is configured to be coupled with the press partner main sleeve coupling portion;

the second upper press partner sleeve extension coupling portion of the first press partner sleeve apparatus extension is configured to be coupled with the first lower press partner sleeve apparatus extension of the second press partner sleeve apparatus extension; and the press partner sleeve cap is configured to be coupled with the second upper press partner sleeve extension coupling portion of the second press partner sleeve apparatus extension;

whereby the press partner main sleeve, the first press partner sleeve apparatus extension, the second press partner sleeve apparatus extension and the press partner sleeve cap may be releasably connected to further extend the press partner sleeve apparatus and further customize the range of motion of the plate-loaded weight machine.

* * * * *